US011759015B2

(12) United States Patent
Duncan, III

(10) Patent No.: US 11,759,015 B2
(45) Date of Patent: Sep. 19, 2023

(54) DYNAMIC FURNITURE FEATURING PENDULUM-LIKE MOTION

(71) Applicant: Richard Johnson Duncan, III, Portland, OR (US)

(72) Inventor: Richard Johnson Duncan, III, Portland, OR (US)

( * ) Notice: Subject to any disclaimer, the term of this patent is extended or adjusted under 35 U.S.C. 154(b) by 0 days.

(21) Appl. No.: 18/053,216

(22) Filed: Nov. 7, 2022

(65) Prior Publication Data

US 2023/0086312 A1 Mar. 23, 2023

Related U.S. Application Data

(63) Continuation of application No. 17/281,492, filed as application No. PCT/US2020/064667 on Dec. 11, 2020, now Pat. No. 11,490,734.

(Continued)

(51) Int. Cl.
*A47C 1/14* (2006.01)
*A47C 1/024* (2006.01)

(Continued)

(52) U.S. Cl.
CPC ..... *A47C 3/0257* (2013.01); *A47C 1/025* (2013.01); *A47C 1/0242* (2013.01); *A47C 3/02* (2013.01); *A47C 3/025* (2013.01); *A47C 3/027* (2013.01); *A47C 3/0251* (2018.08); *A47D 9/02* (2013.01); *A47D 9/04* (2013.01); *A47D 9/053* (2022.08); *A47D 9/057* (2022.08); *A47D 13/10* (2013.01);

(Continued)

(58) Field of Classification Search
CPC ..... A47C 1/024; A47C 1/0242; A47C 1/025; A47C 1/0257; A47C 1/143; A47C 1/14; A47C 3/02; A47C 3/024; A47C 3/0251; A47C 3/027; A47C 3/0257; A47C 21/006; A47C 3/025; A47D 9/02; A47D 9/053; A47D 9/057; A47D 9/04; A47D 13/10; A47D 13/102; A47D 13/105
See application file for complete search history.

(56) References Cited

U.S. PATENT DOCUMENTS 160,624 A * 3/1875 Spencer ..... B60N 2/045 248/395
170,418 A * 11/1875 Van Dervort ..... A47D 9/02 5/103

(Continued)

*Primary Examiner* — Robert Canfield
(74) *Attorney, Agent, or Firm* — Alleman Hall Creasman & Tuttle LLP

(57) ABSTRACT

A dynamic furniture system includes a first frame portion; a set of rollers mounted to the first frame portion; a second frame portion including one or more rockers having a roller-interface surface having a curved profile; wherein the set of rollers interface with the roller-interface surface of the rockers such that the second frame portion is moveable relative to the first frame portion; a set of one or more electromagnets mounted to or integrated with the first frame portion or the second frame portion; a set of one or more magnetically-interactive elements mounted to or integrated with a different one of the first frame portion or the second frame portion; and an electronic control system configured to vary a parameter of electrical energy supplied to the set of electromagnets over time to induce back and forth motion of one of the first frame portion or the second frame portion.

11 Claims, 31 Drawing Sheets

Related U.S. Application Data

(60) Provisional application No. 62/946,799, filed on Dec. 11, 2019.

(51) Int. Cl.

| | |
|---|---|
| ***A47C 1/025*** | (2006.01) |
| ***A47C 3/025*** | (2006.01) |
| ***A47C 3/027*** | (2006.01) |
| ***A47D 9/02*** | (2006.01) |
| ***A47C 3/02*** | (2006.01) |
| ***A47D 13/10*** | (2006.01) |
| ***A47D 9/04*** | (2006.01) |
| *A47C 21/00* | (2006.01) |

(52) U.S. Cl.
CPC ..... *A47D 13/102* (2013.01); *A47D 13/105* (2013.01); *A47C 21/006* (2013.01)

(56) References Cited

U.S. PATENT DOCUMENTS 2,089,622 A * 8/1937 Schauss ..... A47C 1/024 248/395
3,232,574 A * 2/1966 Ferro ..... A47C 3/0257 248/576
3,232,575 A * 2/1966 Glass ..... A47C 1/022 297/329
3,235,304 A * 2/1966 Glass ..... A47C 1/143 297/282
3,999,799 A * 12/1976 Daswick ..... A47C 3/0251 297/270.3
4,028,753 A * 6/1977 Rios ..... B60N 2/2854 5/108
4,101,168 A * 7/1978 Ferro ..... A47C 3/0257 297/329
4,790,599 A * 12/1988 Goldman ..... A47C 3/03 297/282
6,056,363 A * 5/2000 Maddox ..... A47C 1/024 297/161
6,106,065 A * 8/2000 Carroll ..... A47C 1/0347 297/325
6,450,578 B1 * 9/2002 Taggett ..... A47C 7/72 297/423.38
8,474,848 B2 * 7/2013 Bernatsky ..... A61G 5/1075 280/250.1
8,806,682 B2 * 8/2014 Hornbach ..... A61G 7/018 5/619
8,936,315 B2 * 1/2015 Fienup ..... A61G 15/02 297/330
9,694,294 B1 * 7/2017 Petrov ..... A63F 13/5255
11,051,630 B1 * 7/2021 Barrott ..... A61G 7/018
2007/0120404 A1 * 5/2007 Bellows ..... A47D 9/02 297/256.16
2017/0258241 A1 * 9/2017 Russell ..... A47C 21/006
2018/0206642 A1 * 7/2018 Jones ..... A47C 7/68
2019/0208911 A1 * 7/2019 Zheng ..... A61H 7/007
2019/0246797 A1 * 8/2019 Shih ..... A47C 3/0251
2019/0298064 A1 * 10/2019 Shih ..... A47C 3/0255
2022/0312970 A1 * 10/2022 Nishino ..... A47C 3/0257
2022/0324356 A1 * 10/2022 Lee ..... A47C 3/0257

* cited by examiner

FIG. 26A
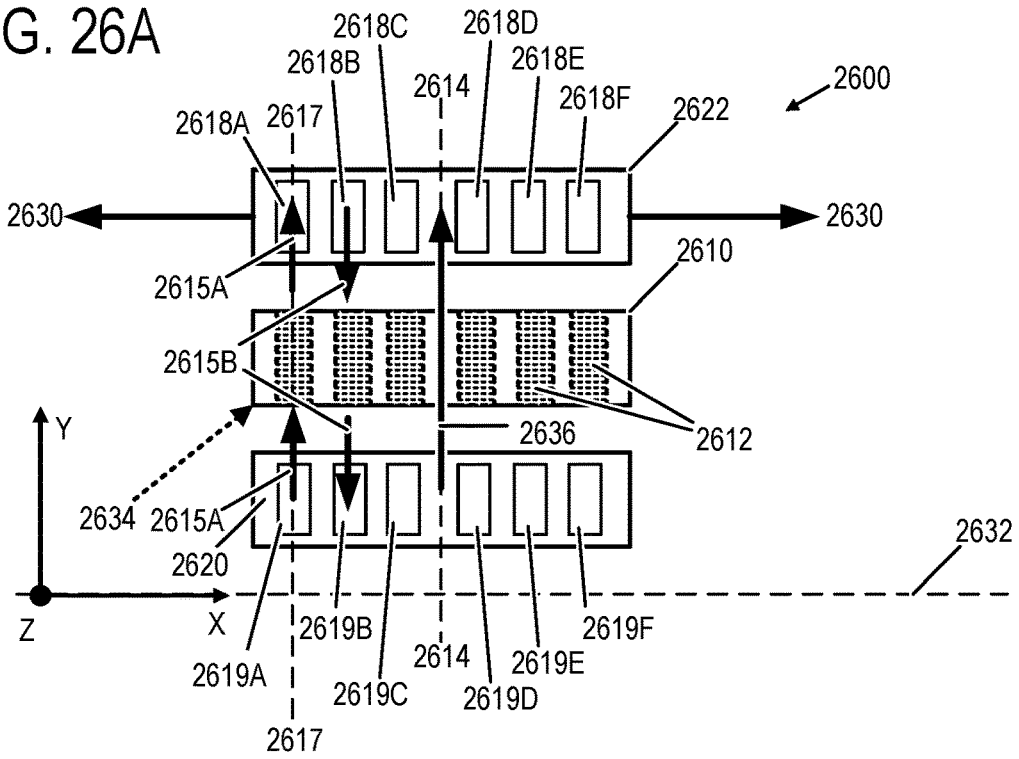
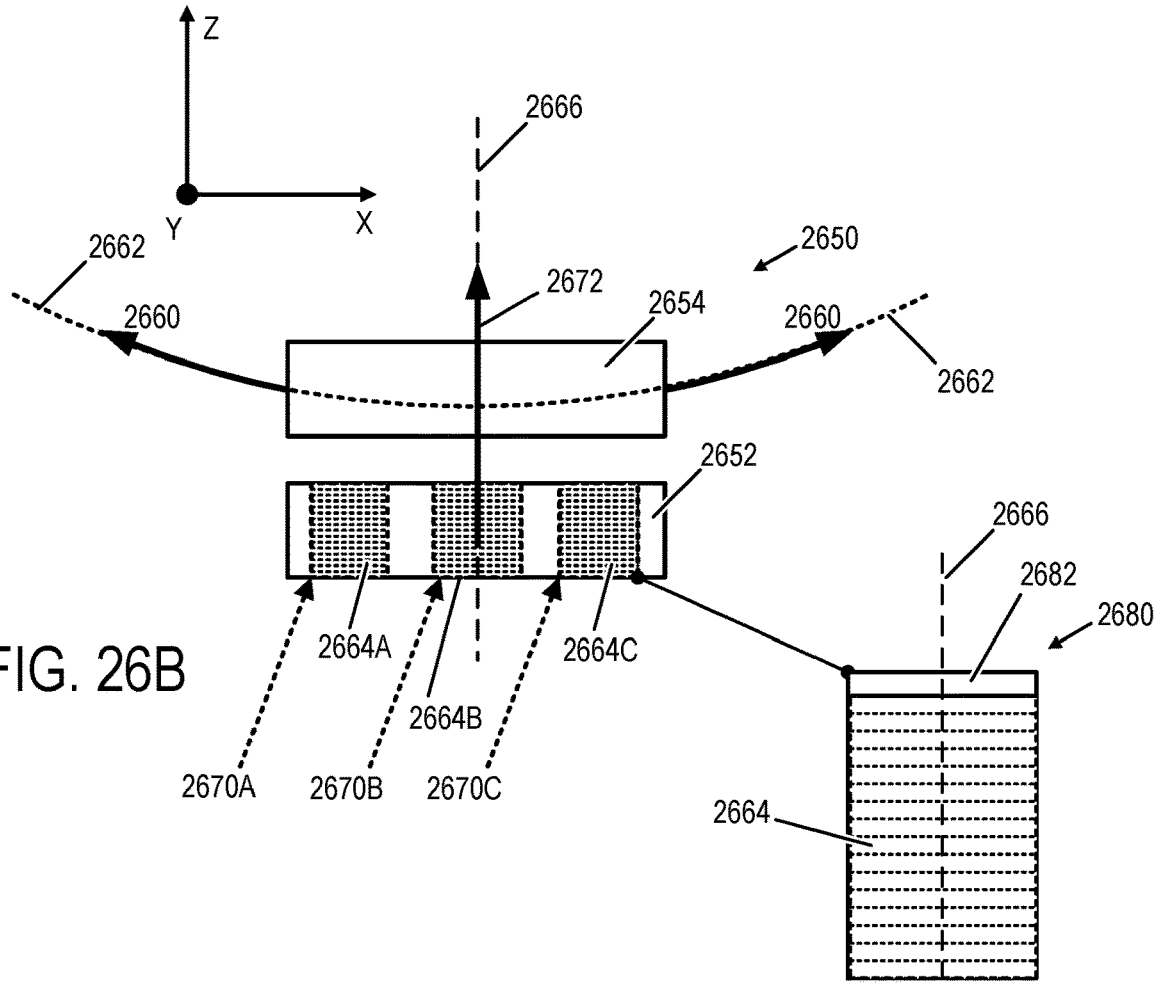
FIG. 26B

DYNAMIC FURNITURE FEATURING PENDULUM-LIKE MOTION

CROSS-REFERENCE TO RELATED APPLICATIONS

This application is a continuation of U.S. patent application Ser. No. 17/281,492 filed on Mar. 30, 2021, which claims the benefit of and priority to International Patent Application Serial No. PCT/US2020/064667 filed Dec. 11, 2020, which claims the benefit of and priority to U.S. provisional patent application Ser. No. 62/946,799, filed Dec. 11, 2019, the entirety of which is incorporated herein by reference for all purposes.

FIELD

An invention of the present disclosure relates generally to furniture capable of being operated to provide back and forth motion that can simulate motion of a pendulum or swing.

BACKGROUND

Dynamic forms of furniture such as rocking chairs, swings, and cribs for infants can be manually moved in a back and forth motion by a person through manual effort such as rocking, pumping, or pushing. Some forms of furniture may be too large, too heavy, or unsuitably positioned to enable a person to impart motion to the furniture through manual effort. Furthermore, maintaining motion of furniture while using the furniture for its intended purpose may be challenging or impractical.

SUMMARY

A variety of dynamic furniture systems and methods of operation are disclosed herein that can be operated to provide back and forth motion that simulates a pendulum motion or swinging motion. The back and forth motion can be provided via electromagnetic actuation in an example. Alternatively or additionally the back and forth motion can be provided via movement of a ballast located on-board the dynamic furniture system. This ballast can alternatively or additionally provide balance control with respect to the dynamic furniture system.

According to a first example of the present disclosure, a dynamic furniture system comprises a first frame portion, a set of rollers mounted to the first frame portion, and a second frame portion including one or more rockers. Each of the rockers can define a roller-interface surface having a curved profile. The set of rollers interface with the one or more roller-interface surfaces such that the second frame portion is moveable relative to the first frame portion by rotation of the set of rollers along the one or more roller-interface surfaces.

The system can further include a set of one or more electromagnets mounted to or integrated with the first frame portion or the second frame portion; and a set of one or more magnetically-interactive elements mounted to or integrated with a different one of the first frame portion or the second frame portion from the set of one or more electromagnets. Collectively, the set of electromagnets and the set of magnetically-interactive elements form one or more electromagnetic actuators that can induce back and forth motion of the first frame portion relative to the second frame portion. The electromagnetic actuators can be configured for operation as an axial flux electric motor, a radial flux electric motor, or an alternating current induction motor.

The system can further include an electronic control system interfacing electrically with the set of electromagnets. In an example, the electronic control system is configured to provide motion control for the dynamic furniture system by varying a parameter of electrical energy (e.g., an amount of electrical power or a frequency of alternating current) supplied to the set of electromagnets over time to induce back and forth motion of one of the first frame portion or the second frame portion relative to the other of the first frame portion or the second frame portion. In at least some examples, the back-and-forth motion can be a pendulum-defined motion having a pendulum-defined period of oscillation of a fixed length pendulum.

According to a second example, a dynamic furniture system comprises a first frame portion, a set of rollers mounted to the first frame portion; a second frame portion, and a mass transfer subsystem mounted to the first frame portion or the second frame portion. The second frame portion includes one or more rockers that can each define a roller-interface surface having a curved profile. The set of rollers interface with the one or more roller-interface surfaces such that the second frame portion is moveable relative to the first frame portion by rotation of the set of rollers along the one or more roller-interface surfaces.

The mass transfer subsystem includes a ballast portion, a ballast pathway, and a set of one or more actuators (e.g., electro-mechanical, electromagnetic, or a combination thereof) operable to move the ballast portion back and forth along the ballast pathway.

The dynamic furniture system further comprises an electronic control system interfacing with and configured to control the set of actuators to adjust a positioning of the ballast portion along the ballast pathway. In at least some examples, a back-and-forth motion can be induced between the first frame portion and the second frame portion by movement of the ballast portion. The back and forth motion can be a pendulum-defined motion having a pendulum-defined period of oscillation of a fixed length pendulum. Additionally, the ballast portion can be used to provide balance control with respect to a frame portion of the dynamic furniture system.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIGS. 26A and 26B schematically depict examples of electromagnetic actuators that can be used at an interface between first and second frame portions of the dynamic furniture systems disclosed herein.

DETAILED DESCRIPTION

Figure 1:
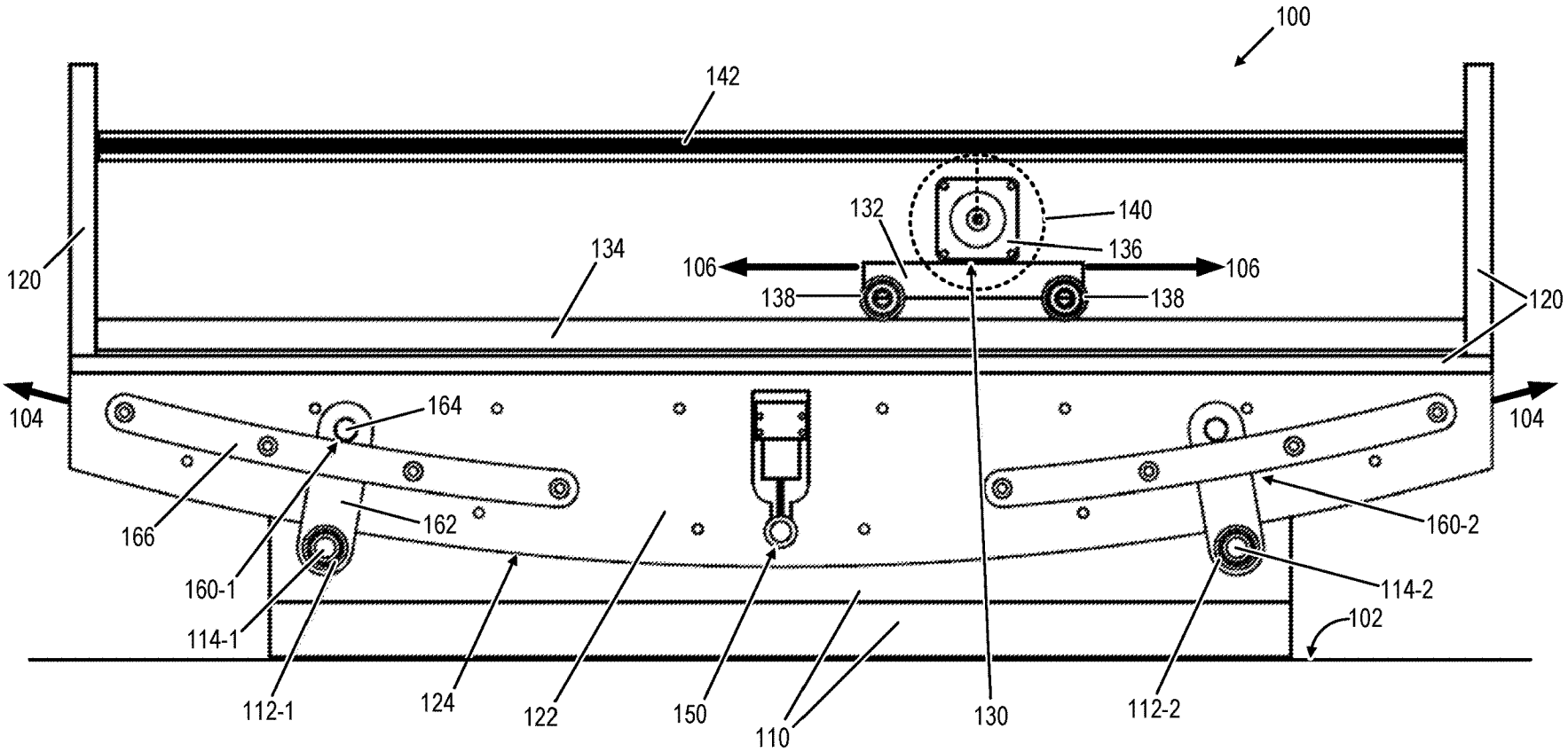
FIGS. 1-7 depict a first example of a dynamic furniture system.

A variety of dynamic furniture systems and methods of operation are disclosed herein that can be operated to provide back and forth motion that simulates a pendulum motion or swinging motion. The back and forth motion can be provided via electromagnetic actuation in an example. Alternatively or additionally the back and forth motion can be provided via movement of a ballast located on-board the dynamic furniture system. This ballast can alternatively or additionally provide balance control with respect to the dynamic furniture system.

The dynamic furniture systems disclosed herein may take various forms, including beds, bed frames, chairs, recliners, etc. that rest upon an underlying ground surface, as well as swings or baskets that are suspended above the ground. However, the dynamic furniture systems can take other suitable forms.

According to a first example of the present disclosure, a dynamic furniture system comprises a first frame portion, a set of rollers mounted to the first frame portion, and a second frame portion including one or more rockers. Each of the rockers can define a roller-interface surface having a curved profile. The set of rollers interface with the one or more roller-interface surfaces such that the second frame portion is moveable relative to the first frame portion by rotation of the set of rollers along the one or more roller-interface surfaces.

The system can further include a set of one or more electromagnets mounted to or integrated with the first frame portion or the second frame portion; and a set of one or more magnetically-interactive elements mounted to or integrated with a different one of the first frame portion or the second frame portion from the set of one or more electromagnets. Collectively, the set of electromagnets and the set of magnetically-interactive elements form one or more electromagnetic actuators that can induce back and forth motion of the first frame portion relative to the second frame portion. The electromagnetic actuators can be configured for operation as an axial flux electric motor, a radial flux electric motor, or an alternating current induction motor.

The system can further include an electronic control system interfacing electrically with the set of electromagnets. In an example, the electronic control system is configured to provide motion control for the dynamic furniture system by varying a parameter of electrical energy (e.g., electrical power or a frequency of alternating current) supplied to the set of electromagnets over time to induce back and forth motion of one of the first frame portion or the second frame portion relative to the other of the first frame portion or the second frame portion. In at least some examples, the back-and-forth motion can be a pendulum-defined motion having a pendulum-defined period of oscillation of a fixed length pendulum.

According to a second example, a dynamic furniture system comprises a first frame portion, a set of rollers mounted to the first frame portion; a second frame portion, and a mass transfer subsystem mounted to the first frame portion or the second frame portion. The second frame portion includes one or more rockers that can each define a roller-interface surface having a curved profile. The set of rollers interface with the one or more roller-interface surfaces such that the second frame portion is moveable relative to the first frame portion by rotation of the set of rollers along the one or more roller-interface surfaces.

The mass transfer subsystem includes a ballast portion, a ballast pathway, and a set of one or more actuators (e.g., electro-mechanical, electromagnetic, or a combination thereof) operable to move the ballast portion back and forth along the ballast pathway.

The dynamic furniture system further comprises an electronic control system interfacing with and configured to control the set of actuators to adjust a positioning of the ballast portion along the ballast pathway. In at least some examples, a back-and-forth motion can be induced between the first frame portion and the second frame portion by movement of the ballast portion. The back and forth motion can be a pendulum-defined motion having a pendulum-defined period of oscillation of a fixed length pendulum.

In addition to inducing back and forth motion, the dynamic furniture systems disclosed herein can additionally provide balance control to accommodate various loading scenarios that may arise when people utilize the furniture or objects are placed on the furniture. In one example, both motion control and balance control can be implemented using an electro-mechanically actuated mass transfer system that selectively moves a ballast portion (i.e., a mass) back and forth along a ballast pathway.

Control of the dynamic furniture systems disclosed herein by an electronic control system may seek to preserve the natural period of back and forth motion (e.g., a pendulum-defined period of a fixed length pendulum) across a variety of loading conditions. The electronic control system can observe the period of pendulum-like motion based on sensor feedback.

The dynamic furniture systems disclosed herein may provide enjoyment, relaxation, therapy, improved health and sleep, among other potential benefits. The electronic control system of the dynamic furniture systems disclosed herein may interface with handheld smartphones or other computers and IoT technologies, and can respond in real-time to sleep or other actions of its users, and provide various responses. As one example, when an Apnea event is sensed via a sensor of a smartphone or other suitable sensor, the dynamic furniture systems may be programmatically operated to provide a quick jolt to awaken the person, and then operated to provide a gentle rocking to encourage relaxation and sleep. Motion of the dynamic furniture systems may also be initiated responsive to detecting shifting of a person during sleep, a nightmare, or other identifiable sleeping event. The electronic control system may include programs for inducing relaxation and sleep, or to induce the person to wake up at a programmed time (e.g., as an alarm function).

Figure 3:
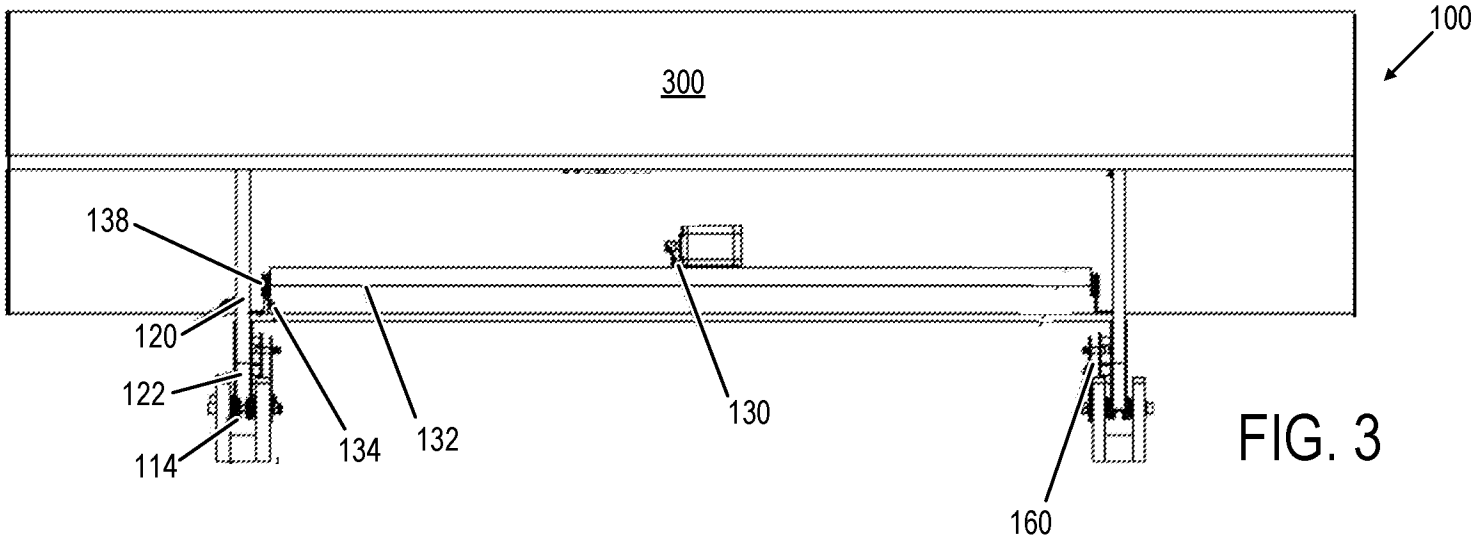
Figure 4:
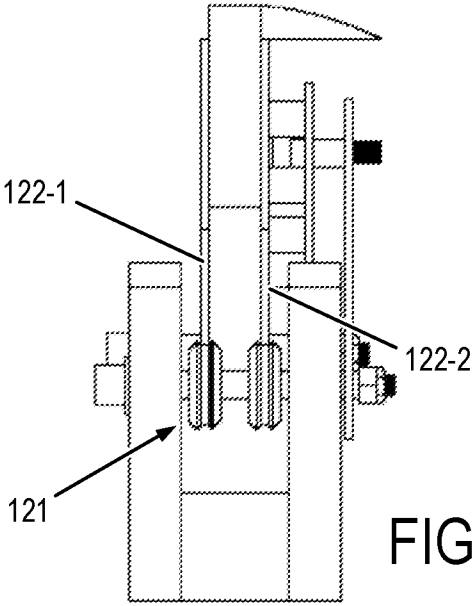
Figure 5:
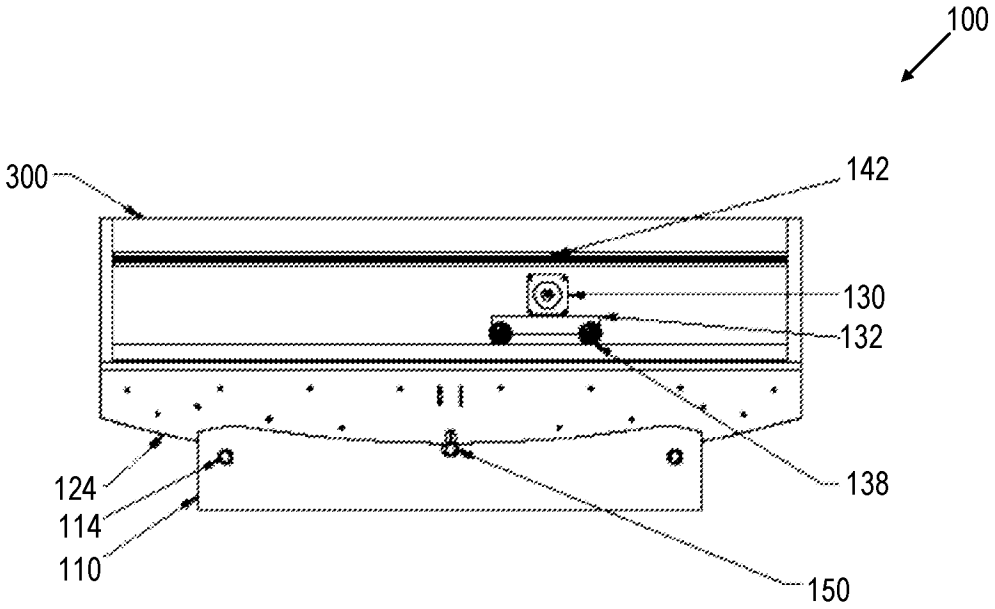
Figure 22:
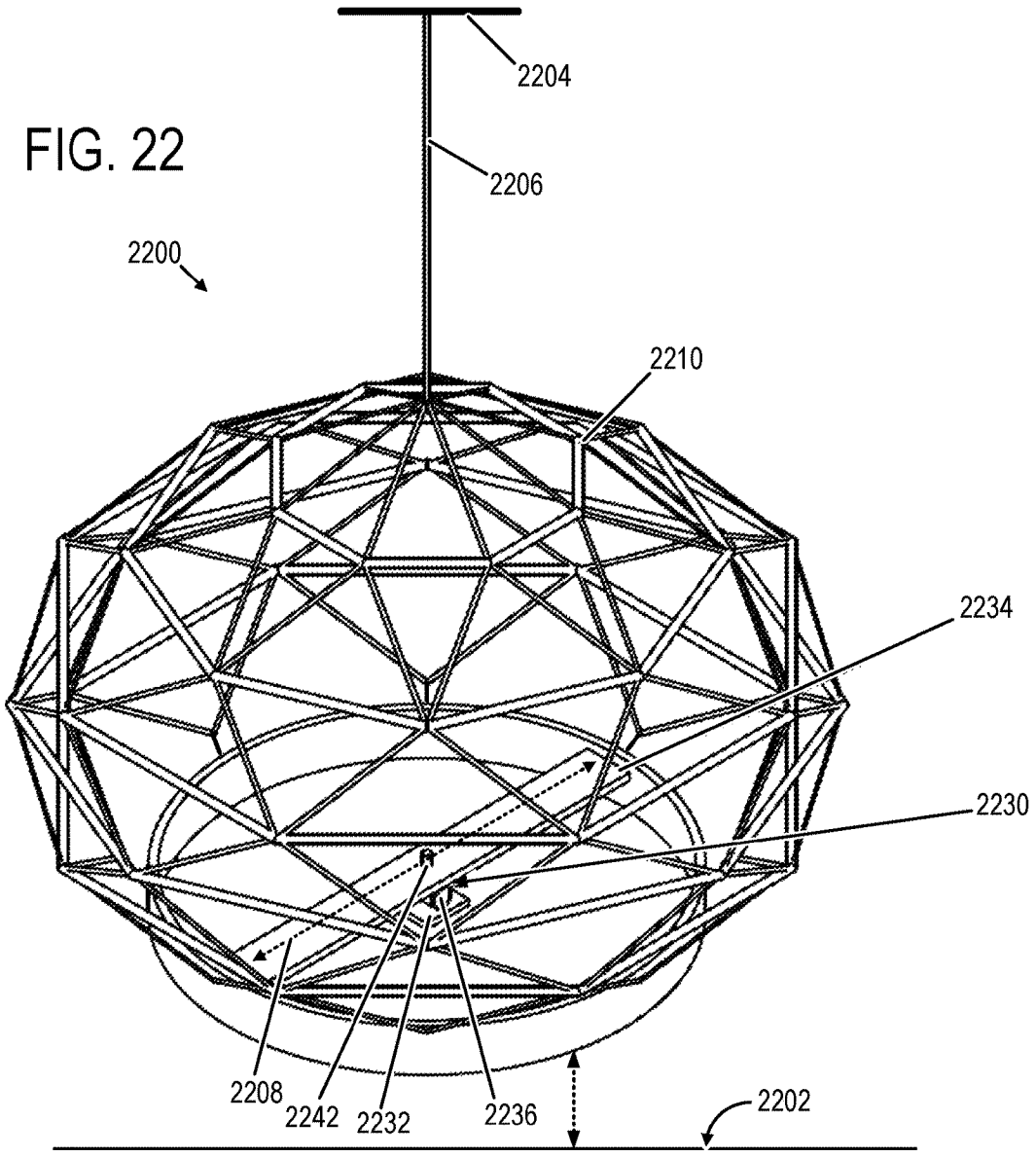
FIGS. 22-24 depict a sixth example of a dynamic furniture system.
Figure 23:
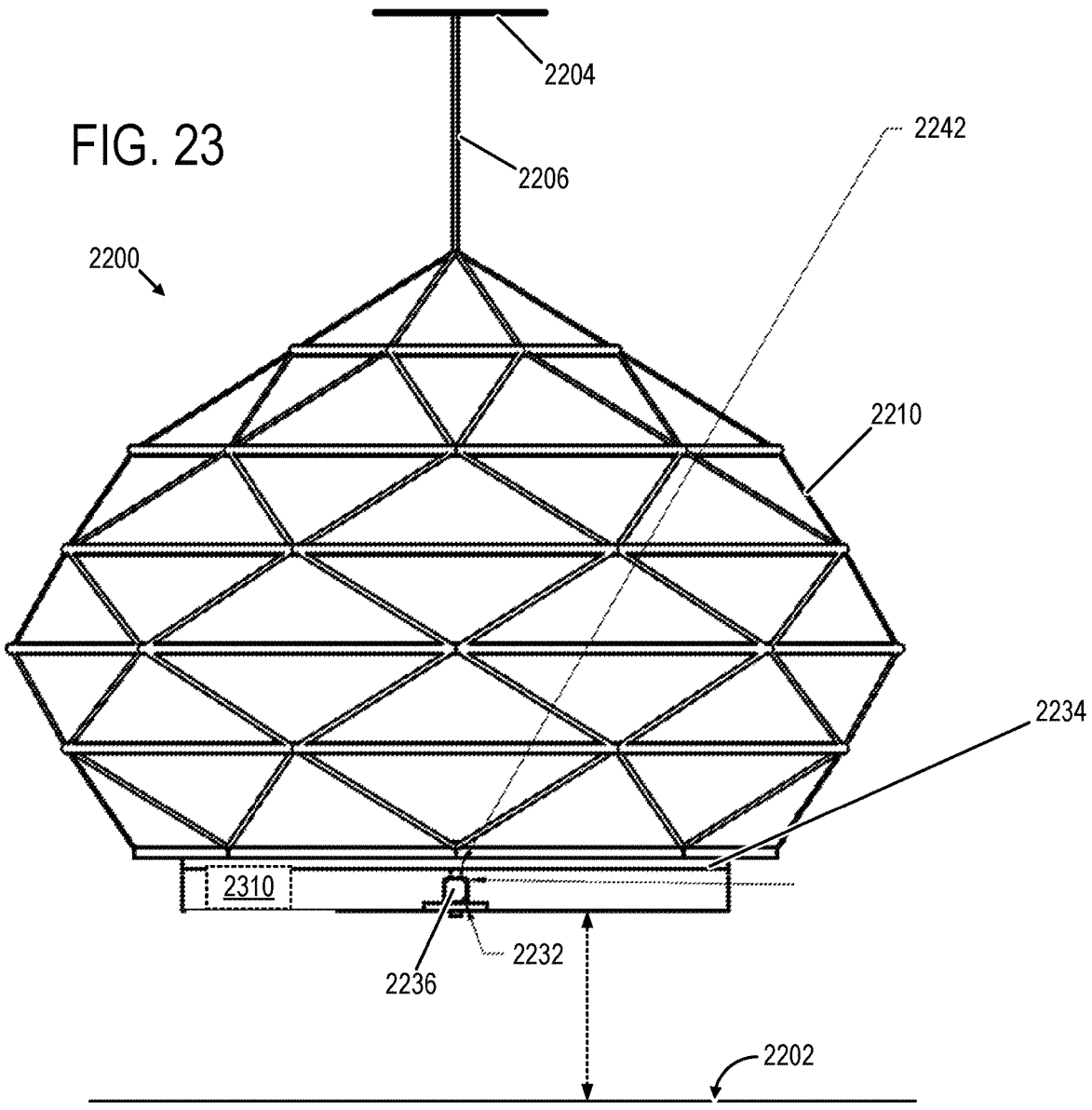
Figure 24:
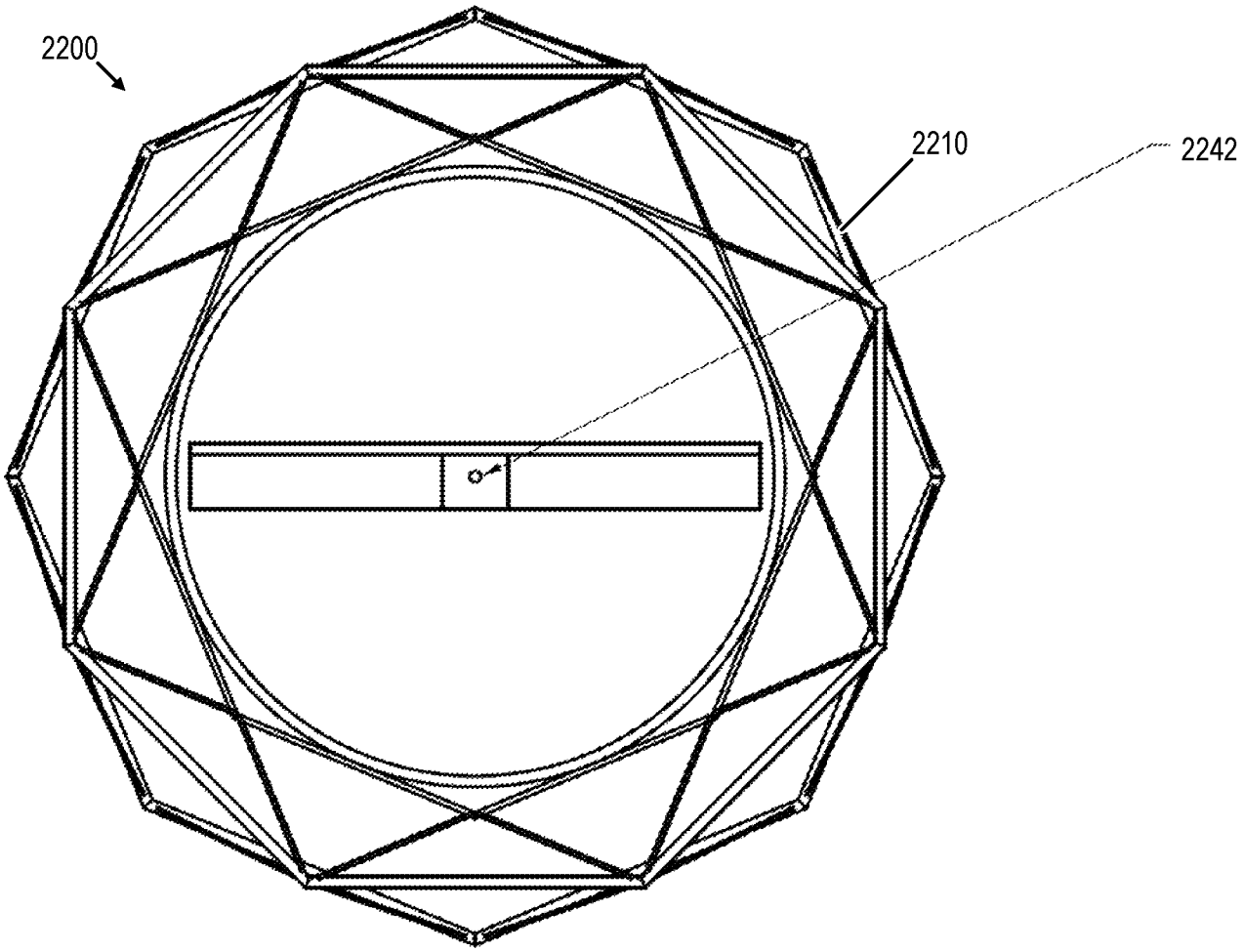

FIGS. 1-7 depict a first example of a dynamic furniture system 100. FIG. 1 depicts dynamic furniture system 100 from a first perspective that reveals a portion of the components of the system. In the example depicted in FIG. 1, dynamic furniture system 100 rests upon an underlying surface 102. For example, dynamic furniture system 100 takes the form of a bed frame that supports a mattress (e.g., as depicted in FIG. 5). In other examples disclosed herein, a dynamic furniture system may be suspended from an overhead structure and above an underlying surface, such as depicted in FIGS. 22-24.

Dynamic furniture system 100 includes a first frame portion 110 and a set of one or more rollers 112-1, 112-2, etc. that are each mounted to the first frame portion via a respective axis of rotation 114-1, 114-2, etc. Each axis of rotation 114-1, 114-2, etc. may take the form of an axle about which its respective roller 112-1, 112-2, etc. can rotate.

Dynamic furniture system 100 further includes a second frame portion 120 that includes a rocker 122. Rocker 122 may be integrated with or mounted to second frame portion 120. Rocker 122 defines a roller-interface surface 124. The set of rollers 112-1, 112-2, etc. interface with (e.g., physically contact) roller-interface surface 124 of rocker 122 such that second frame portion 120 is moveable relative to first frame portion 110 by rotation of the set of rollers along the roller-interface surface of the rocker. For example, second frame portion 120 can move back and forth (e.g., rock or sway) relative to first frame portion 110 as indicated by motion vectors 104.

Roller-interface surface 124 has a curved profile in the example depicted in FIG. 1. In one example, the curved profile of roller-interface surface 124 may take the form of an arc segment of a circle having a constant radius about a point. As described in further detail herein, a constant radius of the roller-interface surface may be used to simulate motion of a pendulum that travels in an arc about a pivot point. While roller-interface surfaces disclosed herein can have curved profiles, in other examples roller-interface surfaces can have straight, non-curved profiles by which linear back and forth motion can be provided.

While FIG. 1 depicts an example in which the set of rollers 112-1, 112-2, etc. are mounted to first frame portion 110 that rests upon underlying surface 102 and second frame portion 120 includes rocker 122, the set of rollers may instead be mounted to second frame portion 120, and first frame portion 110 may instead include one or more rockers or other roller interface surfaces having straight, non-curved profiles. In an alternative example, the roller-interface surface of the rocker may instead refer to an interior of the curved profile in contrast to the exterior of the curved profile of roller-interface surface 124 of FIG. 1. Thus, in this alternative example, the set of rollers would instead be located above the curved profile of the rocker relative to the underlying surface 102 rather than being located below the curved profile of the rocker as depicted in FIG. 1.

Dynamic furniture system 100 further includes a mass transfer subsystem 130 mounted to one of first frame portion 110 or to second frame portion 120. Mass transfer subsystem 130 can be selectively operated to provide motion control, balance control, or a combination of motion control and balance control with respect to a frame portion (e.g., second frame portion 120 in this example.

In the example depicted in FIG. 1, mass transfer subsystem 130 is mounted to second frame portion 120, and first frame portion 110 supports second frame portion 120 relative to underlying ground surface 102. However, in other examples disclosed herein, the mass transfer subsystem is instead mounted to first frame portion 110, and second frame portion 120 supports first frame portion 110 relative to another structure (e.g., an overhead structure).

Mass transfer subsystem 130 includes a ballast portion 132, a ballast pathway 134, and an electro-mechanical actuator 136 operable to move the ballast portion back and forth along the ballast pathway as indicated by motion vectors 106. In the example depicted in FIG. 1, ballast portion 132 interfaces with ballast pathway 134 via a set of rollers 138 that enable the ballast portion to roll back and forth along the ballast pathway. Thus, ballast portion 132 in this example is not directly linked to second frame portion 120 through a mechanical coupling, which eliminates or reduces sensations of forces or impulses from electro-mechanical actuator 136 and/or ballast portion 132, thereby simulating a smooth pendulum motion during operation. By not directly linking the input provided by the actuator to the frame, the system can absorb forces that are out of phase with the natural period of the back and forth motion of the system. This feature can be similarly achieved using the various electromagnetic actuation techniques and configurations disclosed herein that do not rely on a moveable ballast to achieve back and forth motion. Ballast portion 132 may include a relatively dense, solid material, such as a block of metal, hardwood, stone, etc. However, in other examples disclosed herein, a ballast portion may take the form of a fluid contained within a vessel, such as liquid water.

Electro-mechanical actuator 136 can take various forms. In the example depicted in FIG. 1, electro-mechanical actuator 136 includes an electric motor that drives a pinion 140 that interfaces with a rack 142 that is mounted to second frame portion 120. By supplying electrical energy to the electric motor (as an electromagnetic component) of electro-mechanical actuator 136, pinion 140 is driven relative to rack 142 to thereby move ballast portion 132 relative to second frame portion 120. In this configuration, mass transfer system 130 provides linear motion of mass in the form of ballast portion 132 moving back and forth relative to second frame portion 120. In the example depicted in FIG. 1, electro-mechanical actuator 136 is mounted to ballast portion 132. In an alternative example, the electro-mechanical actuator may be mounted to second frame portion 120 and an output of the actuator may drive the ballast portion, such as via a pinion mounted to the output of the actuator and a rack mounted to the ballast portion that interfaces with the pinion. Further examples of mass transfer subsystems are disclosed herein, including mass transfer systems that utilize a liquid as a ballast.

Dynamic furniture system 100 may include a brake or lock mechanism 150 (and/or an electromagnetic locking feature) that may be selectively operated to inhibit or preclude movement of first frame portion 110 relative to second frame portion 120. As one example, lock mechanism 150 includes a pin that passes through a portion of second frame portion 120 (e.g., rocker 122) and first frame portion 110 to mechanically join the two frame portions at a particular orientation. In the example depicted in FIG. 1, the second frame portion when locked to the first frame portion via locking mechanism 150 provides a level upper surface that supports a mattress at a level orientation relative to the gravity vector. In at least some examples, lock mechanism 150 may be electronically controlled via an electro-mechanical or electromagnetic actuator that is selectively locked or unlocked responsive to user input received via a control interface.

Dynamic furniture system 100 may further include one or more anti-lift mechanisms 160-1, 160-2, etc. that inhibit or preclude second frame portion 120 from being lifted from rollers 112-1, 112-2, etc. of first frame portion 110. In this example, each anti-lift mechanism includes a linkage 162 that joins the first frame portion 110 to an axis of rotation 164 (e.g., an axle) that is mounted to second frame portion 120, and a curved strap 166 that retains linkage 162 while enabling the linkage to rotate about axes 164.

Figure 2:
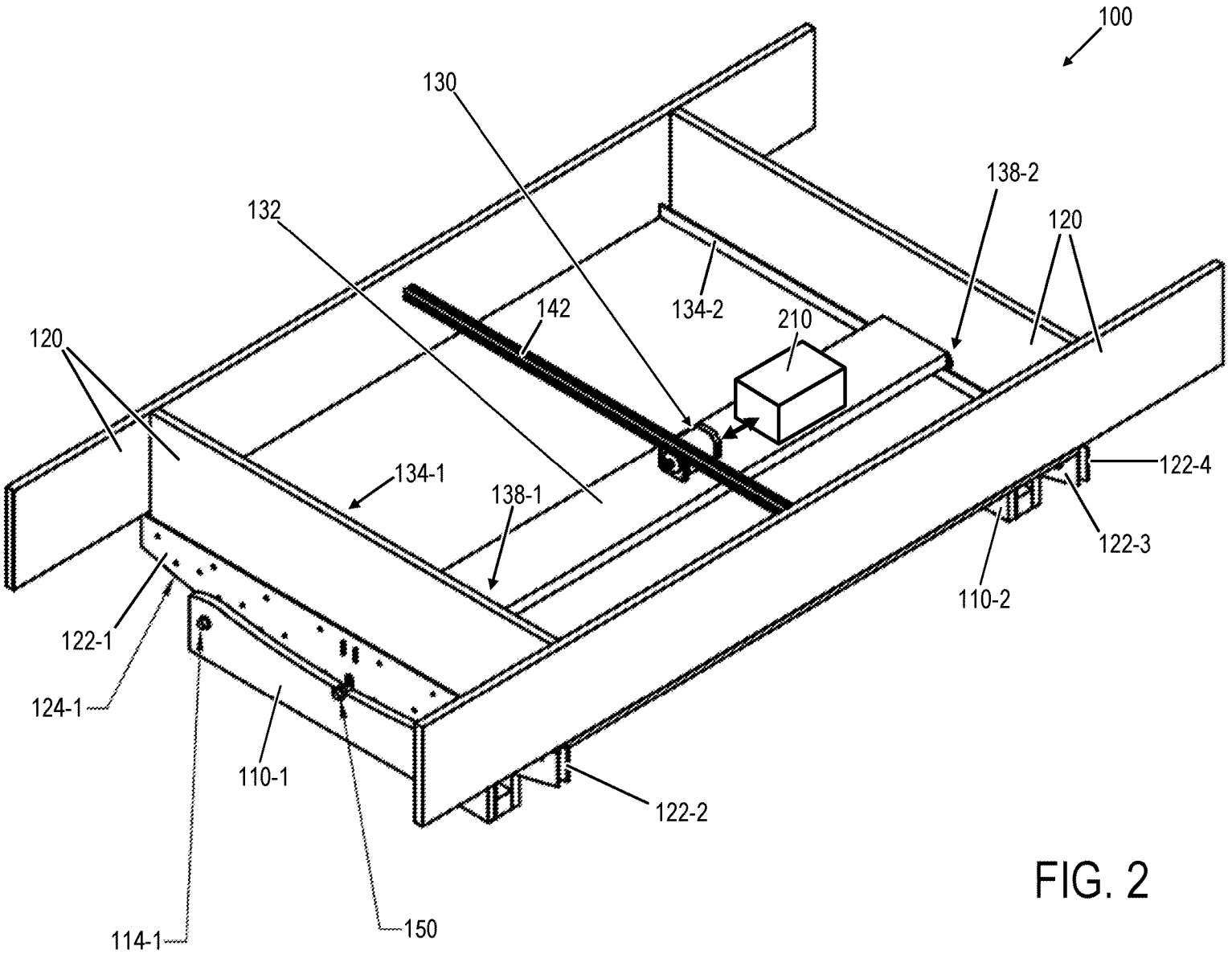

FIG. 2 depicts dynamic furniture system 100 from a second perspective. Within FIG. 2, a control architecture 210 is depicted schematically on-board dynamic furniture system 100. Control architecture 210 can refer to any of the components of control architecture 1200 described in further detail with reference to FIG. 12. As an example, control architecture 210 can include an electronic control system, a power delivery system, sensors, and other electronic components disclosed herein. It will be understood that control architecture 210 can be configured at various locations on-board the dynamic furniture system from the location depicted schematically in FIG. 1, and can include components distributed among different locations on-board the dynamic furniture system.

Additionally, within FIG. 2, multiple instances or portions of the previously described components of dynamic furniture system 100 are shown. For example, first frame portion 110 of FIG. 1 is included as instances 110-1 and 110-2 within FIG. 2, which form respective sets of feet or legs of dynamic furniture system 100. Also within FIG. 2, each rocker forms a rocker pair (e.g., 112-1 and 112-2; and 112-3 and 112-4) that are spaced apart from each other and share a common roller. An example of this rocker pair configuration is depicted in further detail in FIGS. 3 and 4. FIG. 2 also depicts mass transfer system 130 including a set of rollers 138-1, 138-2 located at each end of ballast portion 130, and which facilitate translation of the ballast portion along respective ballast pathways 134-1, 134-2.

FIG. 3 depicts dynamic furniture system 100 as viewed along ballast pathways 134-1, 134-2 of FIGS. 1 and 2. Within FIG. 3, the rocker pairs are visible with each rocker pair sharing a commonly mounted set of rollers 121, a detailed view of which is depicted in FIG. 4. The use of rocker pairs may serve to increase stability of the system, particularly in a direction that is orthogonal to direction of motion of the rockers relative to the rollers. It will be understood that rocker pairs can be used in any of the examples disclosed in place of each instance of an individual rocker. Rollers 121 are depicted in the example of FIG. 4 as each including a groove that accommodates the roller-interface surface of each rocker. However, other suitable rollers can be used.

FIG. 5 depicts dynamic furniture system 100 from an opposite side of the rocker from the view depicted in FIG. 1. FIG. 5 also shows the dynamic furniture system supporting a mattress 300.

Figure 6:
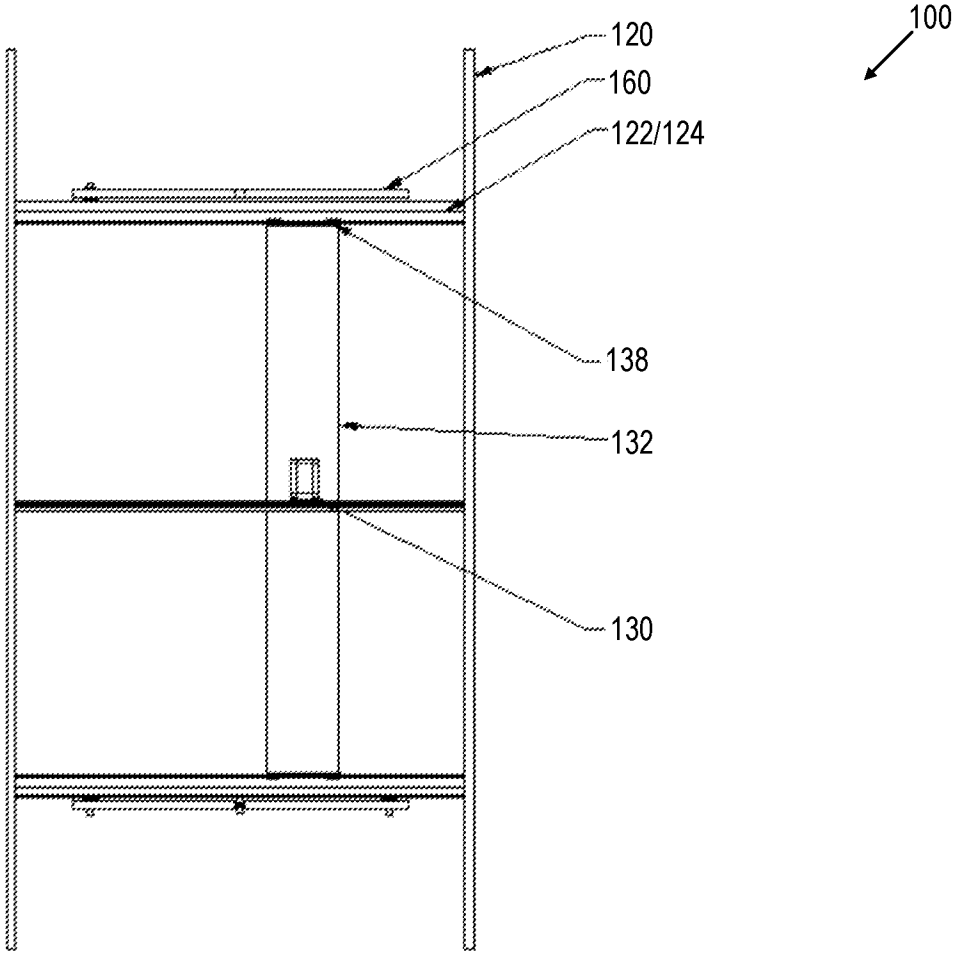
Figure 7:
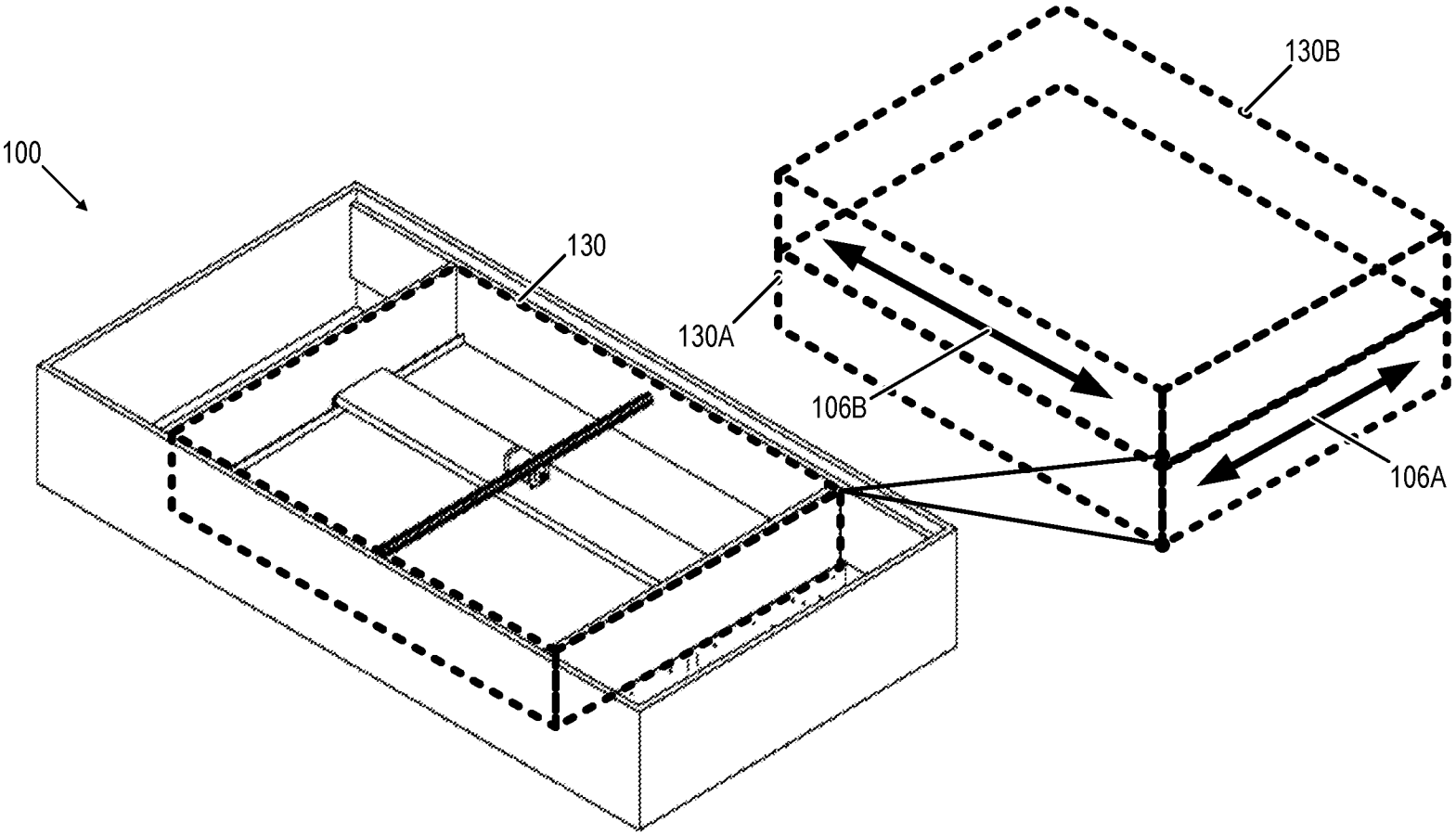

FIG. 6 depicts dynamic furniture system 100 from an above view looking down onto the system and the underlying surface. FIG. 7 depicts dynamic furniture system 100 with additional frame features that can be used to encapsulate the rockers and other mechanical features of the system.

Mass transfer system 130 of FIGS. 1-7 may be referred to as a gantry-style mass transfer system. In further examples, two or more instances of a gantry-style mass transfer system may be stacked in a vertical configuration, at different ballast pathway orientations (e.g., 90 degrees) within the horizontal plane, to provide multiple degrees of freedom of motion control and/or balance control for a dynamic furniture system. Referring to FIG. 7, as an example, multiple instances of mass transfer system 130 are represented schematically as mass transfer systems 130A and 130B that can induce motion in motion vectors 106A and 106B, respectively, that are orthogonal to each other.

FIGS. 8-11 depict a second example of a dynamic furniture system 800, which also takes the form of a bed frame in this example, and includes some of the features previously described with reference to dynamic furniture system 100. However, in this example, motion of dynamic furniture system 800 is controlled via an electromagnetic actuation system that includes an electromagnetic actuator 810 (e.g., including a set of one or more electromagnets) that magnetically interact with one or more magnetically-interactive elements 812-1, 812-2, 812-3, 812-4, 812-5, etc. Electromagnetic actuator 810 can utilize any of the electromagnetic actuation techniques disclosed herein, including the configurations and methods described with respect to actuation of dynamic furniture system 2500 and the electromagnetic actuators described in further detail with reference to FIGS. 26A and 26B.

These magnetically-interactive elements may include a ferromagnetic object, a permanent magnet, or an electromagnet. By selectively supplying electrical energy (e.g., current) to electromagnetic actuator 810, a magnetic force imparted by electromagnetic actuator 810 to at least one of the magnetically-interactive elements can be timed according to an actuation sequence to impart motion of a frame member (e.g., spine 910 shown in FIG. 9) to which the magnetically-interactive elements are mounted, thereby providing a back and forth motion to an upper frame portion 820 relative to a lower frame portion 822 of the system as indicated by motion vector 804 (e.g., having a constant radius curve as defined by the shape of the rocker).

Figure 8:
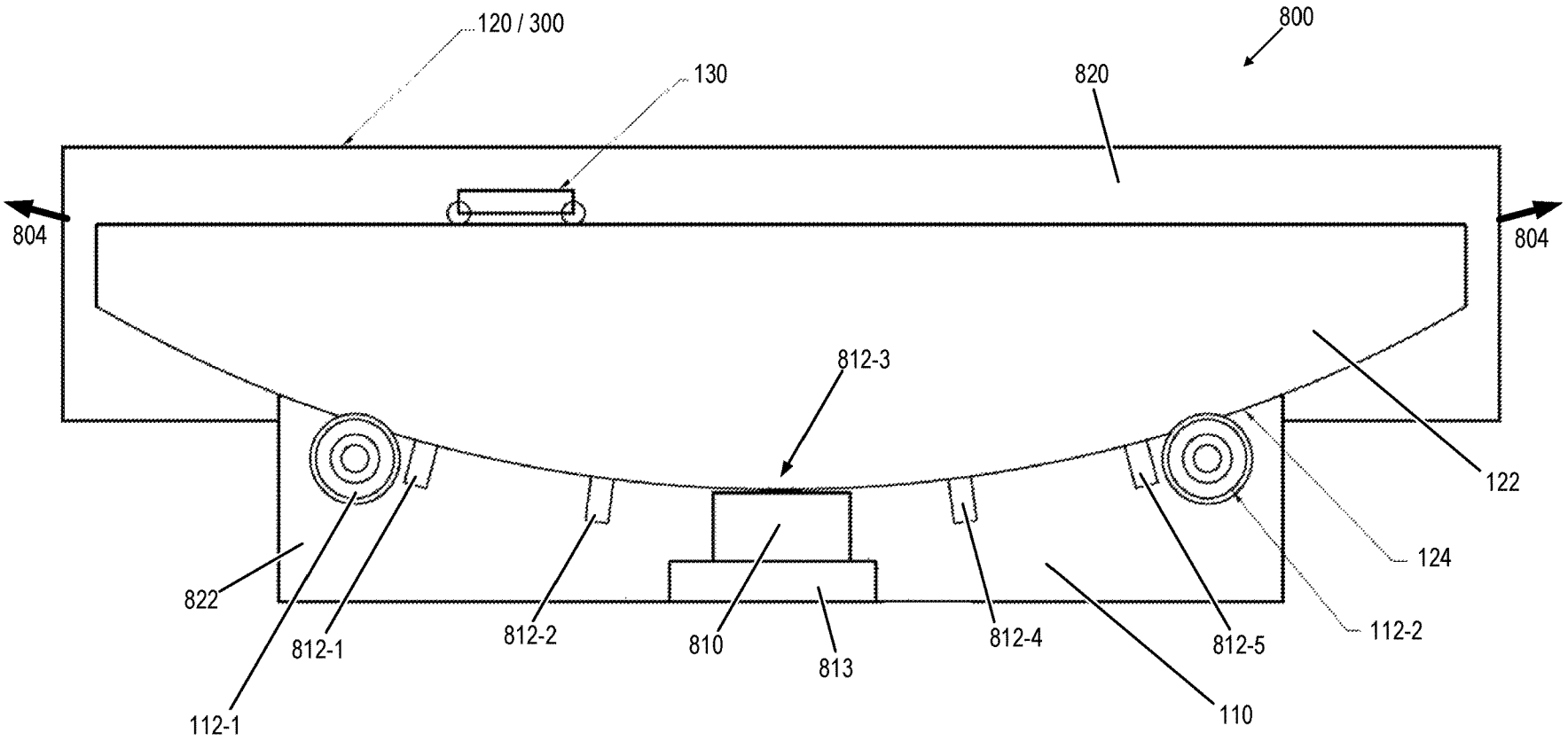
FIGS. 8-11 depict a second example of a dynamic furniture system.

An example control architecture 813 is depicted schematically in FIG. 8 for controlling operation of electromagnetic actuator 810 (e.g., to provide motion control) and operation of mass transfer system 130 (e.g., to provide balance control, motion control, or a combination of balance control and motion control). Control architecture 813 can refer to any of the components of control architecture 1200 described in further detail with reference to FIG. 12. As an example, control architecture 813 can include an electronic control system, a power delivery system, sensors, and other electronic components disclosed herein. It will be understood that electronic control architecture 813 can be configured at various locations on-board the dynamic furniture system from the location depicted schematically in FIG. 8, and can include components distributed among a variety of different locations on-board the dynamic furniture system.

Figure 9:
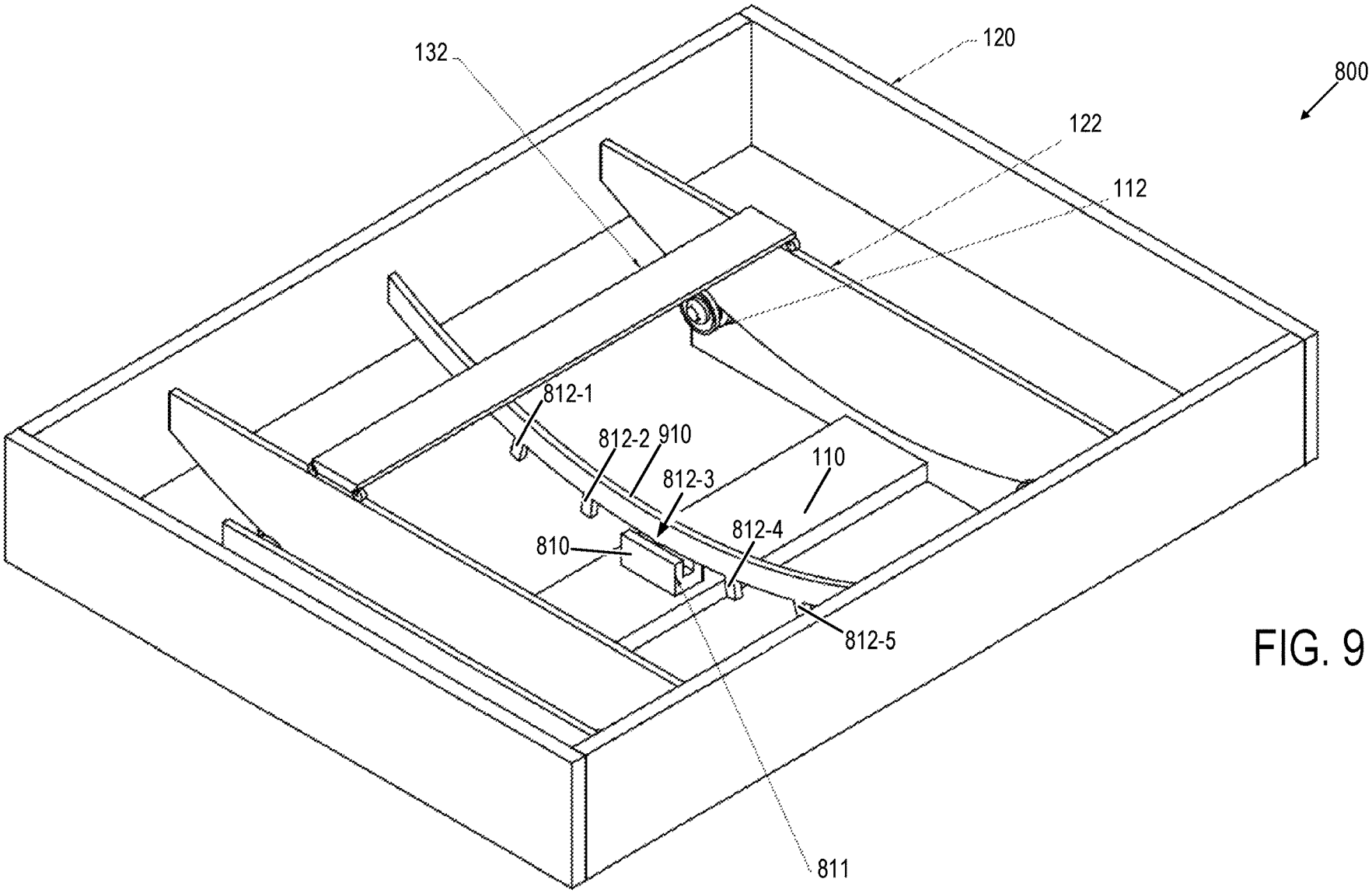
Figure 10:
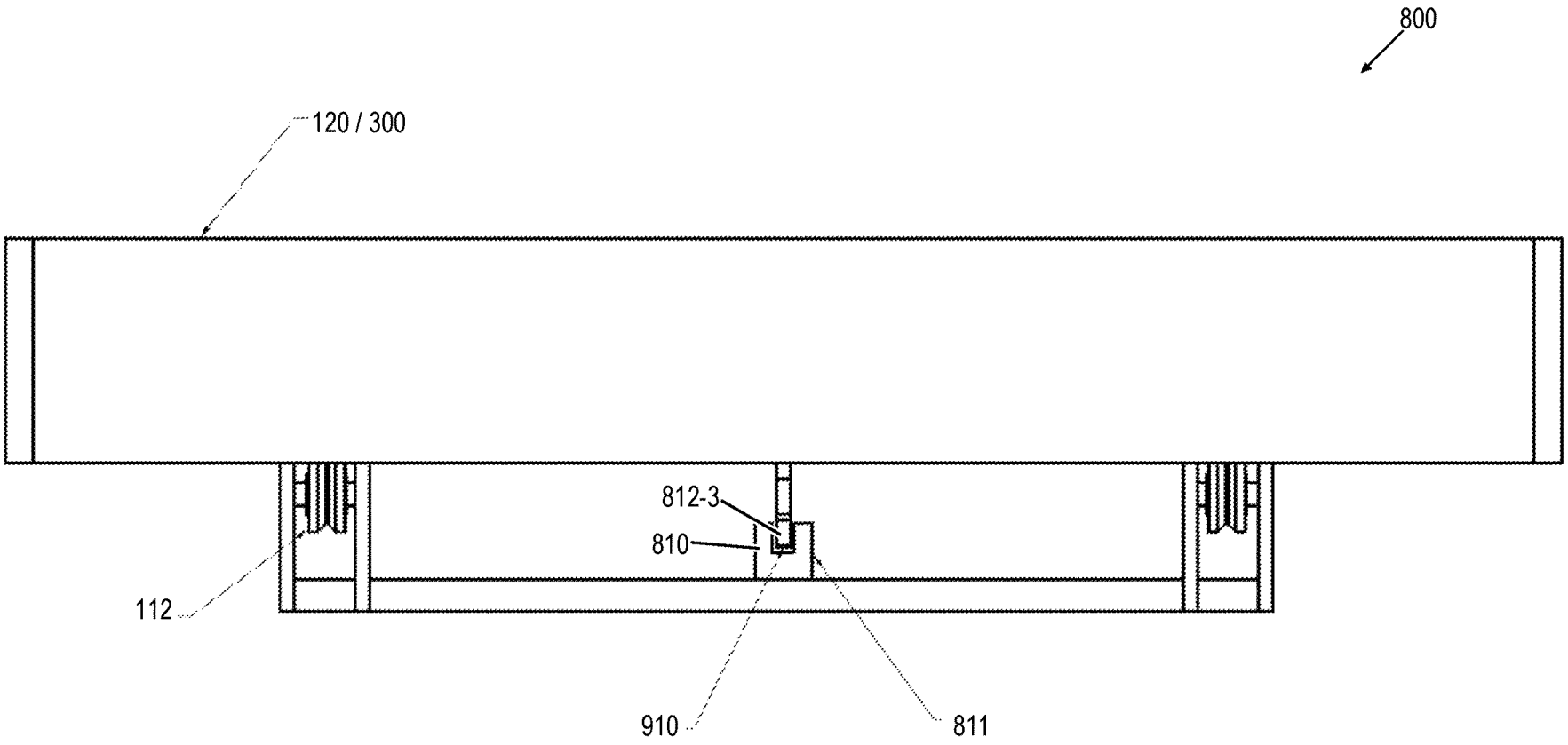
Figure 11:
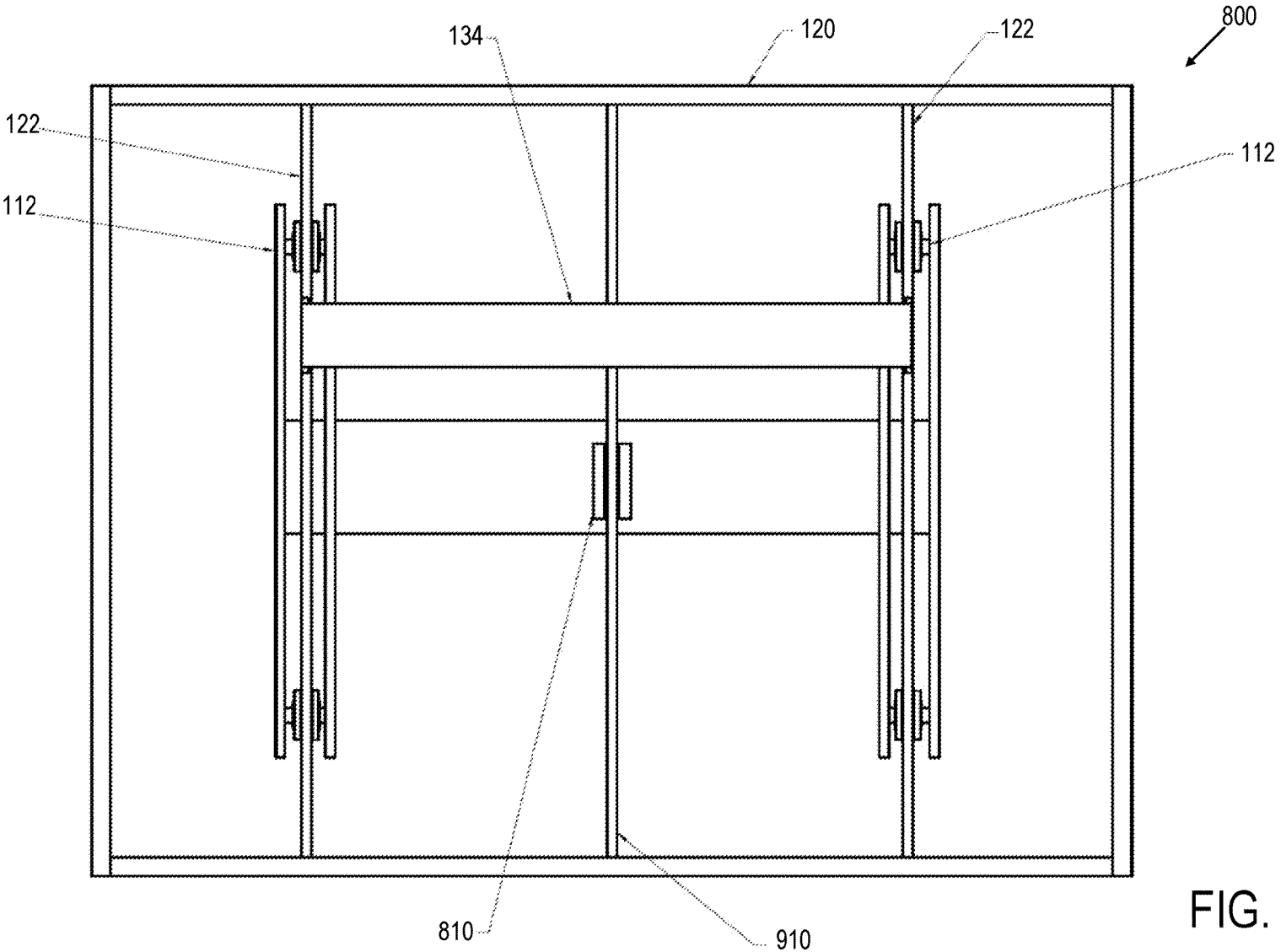

FIG. 9 depicts dynamic furniture system 800 from a different perspective in which magnetically-interactive elements 812-1, 812-2, 812-3, 812-4, 812-5, etc. are shown mounted to a curved spine 910 that has the same radius of curvature as the rockers. FIG. 9 also depicts electromagnetic actuator 810 mounted to the lower frame portion, and spine 910 containing the magnetically-interactive elements mounted to the upper frame portion of dynamic furniture system 800. Spine 910 including its magnetically-interactive elements are shown in FIG. 9 passing through or between opposing portions of electromagnetic actuator 810, while enabling spine 910 to freely pass back and forth. FIG. 10 depicts another view of dynamic furniture system 800 along spine 910. FIG. 11 depicts another view of dynamic furniture system 800 from above, looking down on the system. As indicated generally at 811 in FIG. 9, the dynamic furniture system can include a plurality of sensors to measure a position of the second frame portion relative to the first frame portion. Example sensors are described in further detail with reference to FIGS. 12, 29A, 29B, and 30.

Figure 12:
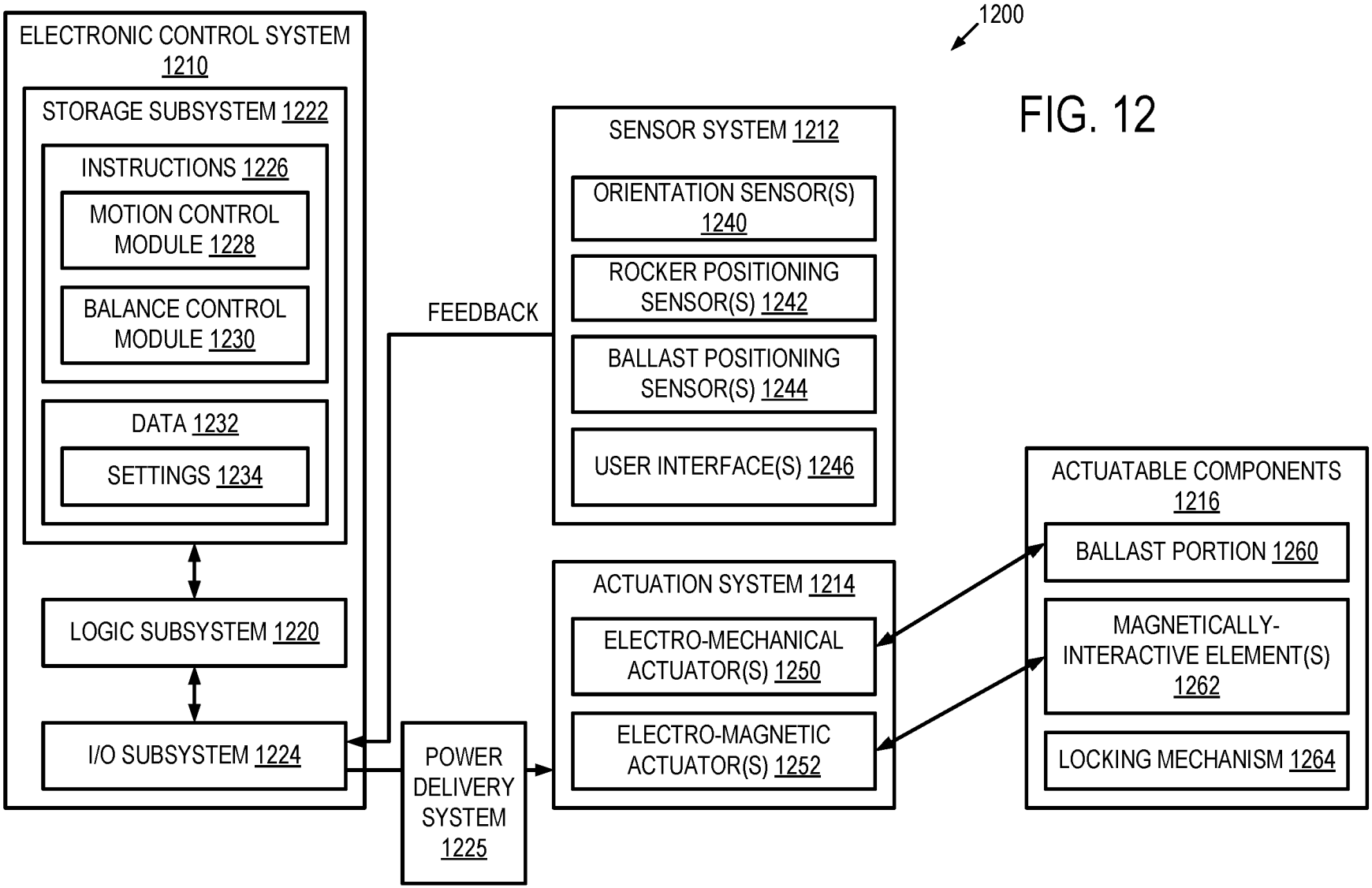
FIG. 12 depicts an example control architecture for a dynamic furniture system.

FIG. 12 depicts an example control architecture 1200 for a dynamic furniture system, such as example dynamic furniture system 100 of FIGS. 1-7 that provides motion control via a mass transfer system or example dynamic furniture system 800 of FIGS. 8-11 that provides motion control via an electromagnetic actuation system. Control architecture 1200 may also be used for any of the other dynamic furniture systems disclosed herein, including systems 1400 of FIGS. 14-15, 1600 of FIGS. 16-19, 2000 of FIGS. 20-21, 2200 of FIGS. 22-24, 2500 of FIGS. 25A-25E, or combinations thereof.

Figure 30:
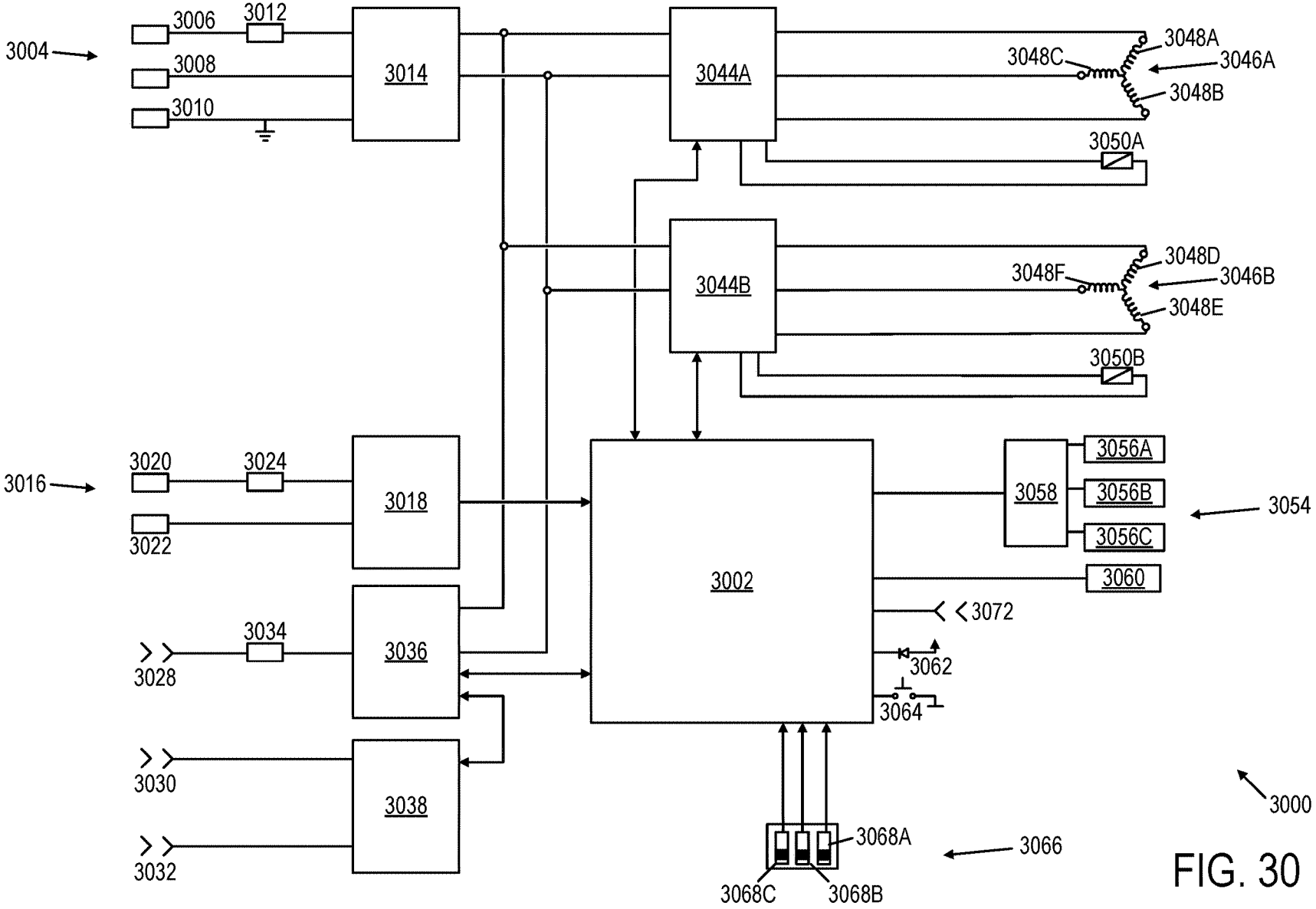
FIG. 30 is a circuit diagram of an example control architecture.

Control architecture 1200 includes an electronic control system 1210, a power supply system 1225, a sensor system 1212, an actuation system 1214, and a set of actuatable components 1216. While aspects of control architecture 1200 are briefly described in the paragraphs below, the control architecture is described in further detail at the conclusion of the Detailed Description. Additionally, control architecture 3000 of FIG. 30 is an example implementation of control architecture 1200 of FIG. 12.

Electronic control system 1210 includes a logic subsystem 1220, a data storage subsystem 1222, and an input/output subsystem 1224. In an example, electronic control system 1210 takes the form of a computing system one or more computing devices. (e.g., a microcontroller) Electronic control system 1210 may be mounted on a frame portion of the dynamic furniture system (e.g., within an enclosure) or may be located remotely from the dynamic furniture system utilizing communications in wired or wireless configurations.

Data storage subsystem 1222 includes instructions 1226 stored thereon that are executable by logic subsystem 1220 to perform one or more of the methods or operations disclosed herein. An example method 1300 that maybe performed by electronic control system 1210 is described in further detail with reference to FIG. 13. Instructions 1226 may include a set of instruction components, such as a motion control module 1228 for controlling motion of the dynamic furniture system and a balance control module 1230 for controlling balance of the dynamic furniture system. Data storage subsystem 1222 may further include other forms of data 1232 stored thereon, such as settings data 1234, as an example. Settings data 1234 may include system-defined settings and/or user-defined settings. Examples of settings include: Sleep mode—bed swings you to sleep, then after set time (30 minutes, 1 hour, etc.) stops swinging and locks flat; Snoring mode—bed will sense snoring episode (nightmare, restlessness) and gentry rock for a set amount of time before locking again; Alarm mode—wake up in the morning with a gentle swing—or, perhaps—a not so gently swing to get your attention.

Electronic control system 1210 receives sensor input (e.g., sensor feedback) from sensor system 1212 via input/output subsystem 1224. Sensor system 1212 includes a set of one or more sensors. At least some of sensors 1212 may be mounted to or integrated with the dynamic furniture system. For example, one or more of sensors 1212 may be mounted to a first frame portion or a second frame portion of a dynamic furniture system to provide an indication of a relative positioning of the first frame portion relative to the second frame portion. One example of sensors 1212 includes one or more orientation sensors 1240 (e.g., an inclinometer, inertial sensor, accelerometer, gyroscope, multi-axis IMU, etc.) that provide a measurement of an orientation (e.g., an angle) of a component of the dynamic furniture system relative to a reference datum (e.g., a gravity vector, a horizontal plane, etc.). For example, an orientation sensor may be mounted to second frame portion 120 of dynamic furniture system 100 or upper frame portion 820 of dynamic furniture system 800 to measure a current state of the portion of the system that moves back and forth relative to another frame portion that rests upon the underlying ground surface. Another example of sensors 1212 includes one or more rocker positioning sensors 1242 (e.g., an optical sensor, magnetic sensor, Hall-effect sensor, etc.) that provides a measurement of a position of a rocker (e.g., rocker 122) or a spine (e.g., spine 900) relative to another frame portion (e.g., frame portions 110, 822, etc.) with respect to which the rocker or spine moves back and forth. Another example of sensors 1212 includes one or more ballast positioning sensors 1244 that provides a measurement of a position of the ballast portion along a ballast pathway of the dynamic furniture system. In one example, ballast positioning sensors 1244 may include a sensor associated with an electro-mechanical actuator (e.g., a stepper motor) that provides an indication of a position of the actuator that is directly tied to the position of the ballast portion that is controlled by the actuator. Sensors 1212 may further include user interfaces 1246 by which the dynamic furniture system can be controlled via electronic control system 1210. User interfaces 1246 include hardware interfaces (e.g., buttons, switches, touch screens, etc.) and graphical user interfaces (e.g., GUIs) displayed by a graphical display. For example, a mobile computing device may be configured (e.g., via a paired mobile application program) to present a GUI for controlling a paired dynamic furniture system over a wireless communications link. Sensor input received from one or more sensors of sensor system 1212 may be referred to as a control input, and electronic control system 1210 may be configured to perform respective operations responsive to a plurality of different control inputs. While not depicted in FIG. 12, input/output subsystem may receive electrical energy from a power source, such as a wall outlet via an electrical cord or a battery system that is integrated with the dynamic furniture system, and may send electrical energy to other components (e.g., actuators) of the hardware architecture associated with the dynamic furniture system.

Electronic control system 1210 is configured to store data captured from the sensor system as data 1232 in storage subsystem 1222. For example, the electronic control system may interface with any suitable type of sensor to determine snoring, temperature, heart rate and adjust the bed performance based on these inputs. The electronic control system can also sync with third-party sleep health systems to provide data for doctors and patients.

Electronic control system 1210 is configured to provide control outputs to actuation system 1214 that are based on control inputs received from sensor system 1212. Actuation system 1214 may include one or more actuators, including one or more electro-mechanical actuators 1250 (e.g., electric motors, servos, etc.), and one or more electromagnetic actuators 1252 (e.g., electromagnets). As previously described with reference to dynamic furniture system 100 of FIGS. 1-7, an electro-mechanical actuator may be used to control a positioning of a ballast portion (e.g., ballast portion 1260 in FIG. 12) of a mass transfer system along a ballast pathway, thereby supporting motion control and/or balance control for the dynamic furniture system. Also, as previously described with reference to dynamic furniture system 800 of FIGS. 8-11, an electromagnetic actuator may be used to control a positioning of one or more magnetically-interactive elements (e.g., elements 1262 in FIG. 12) to provide motion control for the dynamic furniture system. In at least some examples, an actuator of actuation system 1214 may be associated with a locking mechanism 1264 of the dynamic furniture system, such as previously described with reference to locking mechanism 150 of FIG. 1. In these examples, the electronic control system may be capable of locking or unlocking the locking mechanism responsive to a control input, such as a user input received via user interfaces 1246.

In one example, electronic control system 1210 may implement a proportional-integral-derivative (PID) control algorithm or other suitable closed loop control algorithm on actuators of actuation system 1214 based on sensor feedback received from sensor system 1212 to achieve a target response from the dynamic furniture system. However, other suitable control algorithms may be used.

In one example, motion control module 1228 may implement a timing control feature that activates and deactivates an electromagnet or series of electromagnets, according to a timing schedule based on feedback from position and/or orientation sensors to induce motion in a spine or other moveable frame feature that includes or incorporates a plurality of magnetically-interactive elements. For example, as a magnetically-interactive element approaches the electromagnet, the electromagnet may be activated to cause the magnetically-interactive element to be attracted to the electromagnet, however, as the magnetically-interactive element passes the electromagnet, the electromagnet may be deactivated to allow the magnetically-interactive element to travel away from the electromagnet without resistance caused by the magnetic attraction. This process may be repeated for each magnetically-interactive element of a series of elements.

With regard to motion control using mass transfer, a period of a virtual pendulum can be determined by a length from a virtual pivot point (e.g., a center point of the rocker arc) to the center of gravity of the furniture portion being moved. As the center of gravity changes (e.g., occupant changes location or a person joins or leaves the furniture), the sensor system (e.g., one or more inertial sensors) provides sensor input data that a program of the electronic control system can use to determine the new center of gravity and compute the desired natural frequency of the moving frame portion. The ballast portion is then adjusted in terms of oscillation speed and distance from a midplane of the ballast pathway to maintain a natural pendulum period and harmonics.

Figure 13:
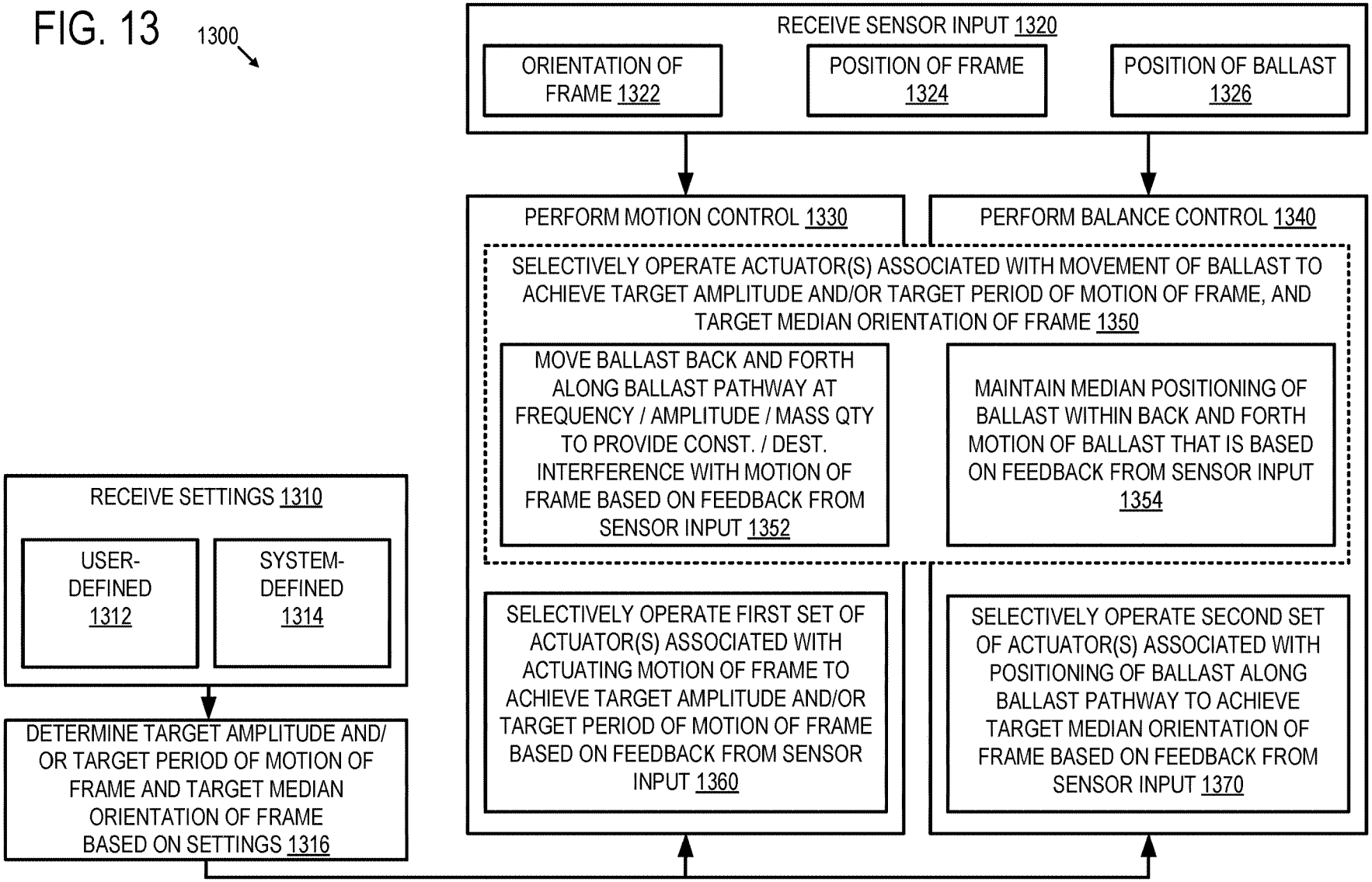
FIG. 13 depicts an example method for a dynamic furniture system.

FIG. 13 depicts an example method 1300 for a dynamic furniture system, such as example dynamic furniture system 100 of FIGS. 1-7 or dynamic furniture system 800 of FIGS. 8-11. However, method 1300 may be applied to any of the dynamic furniture systems disclosed herein. Method 1300 or portions thereof may be performed by an electronic control system, such as example electronic control system 1210 of FIG. 12 in combination with other features of control architecture 1200.

At 1310, settings may be received, including user-defined settings and/or system-defined settings. Settings may be retrieved from a data storage subsystem and/or may be received via a user interface over a communications network.

At 1312, a target amplitude of motion and/or a target median orientation of the frame of the dynamic furniture system may be determined based on the settings received at 1310. The target median orientation of the frame may refer to a level orientation or other suitable orientation of the frame between two extreme ends of the back and forth motion. For example, the target median orientation may refer to the level orientation or default orientation of the frame in the absence of motion. The median orientation corresponds to a midpoint between opposing end points (e.g. apex) of an arc of motion of the frame within the context of back and forth motion. For example, within the context of a bed frame, the target median orientation may refer to the level orientation of an upper surface of the bed frame and mattress to thereby provide a level sleeping surface.

At 1320, sensor input is received, which may indicate one or more of: an orientation of the frame relative to a reference datum (e.g., a gravity vector), a position of the frame relative to a reference datum (e.g., a point along an arc defined by the rocker), a position of the ballast along the ballast pathway, or other suitable position and/or orientation of system components. However, other suitable sensor inputs may be received at 1320. Within method 1300, sensor input may be received at 1320 at a sampling frequency (e.g., 100 Hz, 500 Hz, 1,000 Hz, etc.) for each sensor associated with the dynamic furniture system. The sampling frequency may be continuous during motion control and/or balance control operations.

At 1330, motion control is performed based on the settings received at 1310 and the sensor input received at 1320. In at least some examples, balance control is performed at 1340 (e.g., by implementation of balance control module 1230) in parallel with motion control performed at 1330 (e.g., by implementation of motion control module 1228).

In a first example, both motion control at 1330 and balance control at 1340 are performed by controlling the positioning of the ballast along the ballast pathway. This approach may be used within the context of dynamic furniture system 100 of FIGS. 1-7, for example. In this example, at 1350, one or more actuators associated with the movement of the ballast along the ballast pathway are selectively operated to achieve the target amplitude and/or the target period, and the target median orientation of the frame, as determined at 1316. For example, at 1352, the ballast is moved back and forth along the ballast pathway at a frequency, amplitude, and/or mass quantity (see e.g., the fluid-based ballast of FIG. 14 having a selectable quantity) to provide constructive interference, no interference, or destructive interference with motion of the frame based on feedback from the sensor input received at 1320. Constructive interference includes maintaining or increasing the amplitude of back and forth motion of the frame, whereas no interference or destructive interference includes reducing the amplitude of the back and forth motion of the frame over one or more cycles of the back and forth motion.

In at least some examples, at 1354, the method can include maintaining a median positioning of the ballast along the ballast pathway within the back and forth motion of the ballast that is based on feedback from the sensor input received at 1320.

In a second example, motion control at 1330 and balance control at 1340 are performed using different sets of actuators. In this example, at 1360, a first set of one or more actuators associated with actuating motion of the frame are selectively operated to achieve the target amplitude and/or target period of motion of the frame based on feedback from the sensor input received at 1320. Further, in this example, at 1370, a second set of one or more actuators associated with the positioning of the ballast along the ballast pathway are selectively operated to achieve the target median orientation of the frame based on feedback from the sensor input received at 1320. Operation 1370 may be omitted in examples where a moveable ballast is not provided as part of the dynamic furniture system.

In contrast to operations 1350, 1352, and 1354 in which the ballast is moved back and forth along the ballast pathway as part of both balance control and motion control, operation 1370 may instead include moving the ballast to a position along the ballast pathway and maintaining that position for a plurality of back and forth cycles of the frame as provided by the first set of actuators at operation 1360. Responsive to a dynamic loading event with respect to the frame (e.g., a person moves upon the frame, a person gets onto the frame, a person gets off of the frame, etc.), the ballast may be repositioned along the ballast pathway as part of balance control performed at 1370 to again achieve the target median orientation of the frame. The repositioned ballast may be maintained at the updated position along the ballast pathway for a plurality of back and forth cycles of the frame until another dynamic loading event occurs.

In an example, the electronic control system can be pre-programmed with an initial "seed" period that represents an estimate of the natural period for the unweighted center of mass of a movable frame portion and the radius of curvature of the rocker. A user (i.e., human operator) could also be asked to operate the dynamic furniture system unweighted during an initial calibration phase prior to use to enable the electronic control system to measure the period of back and forth motion of the frame portion. The electronic control system can update this initial "seed" period in real-time as the center of mass changes—e.g., as mass is added or removed from the frame portion undergoing back and forth motion. Another measurement by the electronic control system can include feedback as to the amount of resistance encountered each time an actuator is operated to impart motion to the frame. Optimizing and solving for the minimal resistance while still maintaining a consistent or target amplitude and/or target period can be performed by the electronic control system to correct an amount and timing of current or electrical energy being applied to the actuators so that the forced pendulum period is in harmony with the natural period of the system. During operation, actuators of the dynamic furniture system may be operated to provide constructive interference that supports a steady state or increasing back and forth motion by imparting a force to the frame portion that is timed with the observed period of that frame portion, which may be preprogrammed or learned by the electronic control system based on feedback from the sensors. The resulting control strategy can provide a back and forth motion that simulates motion of a pendulum, such as a fixed length pendulum.

Figure 14:
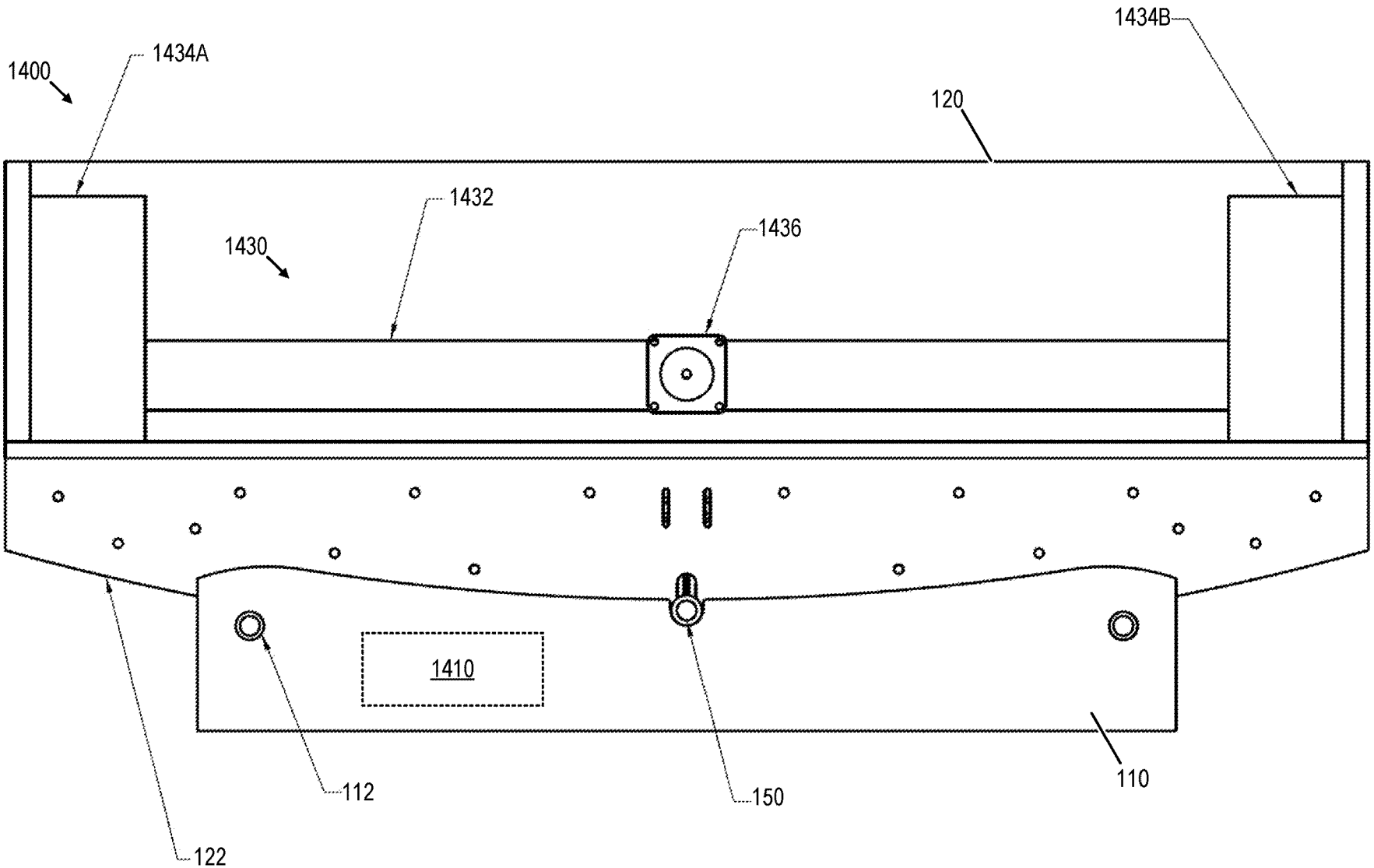
FIGS. 14 and 15 depict a third example of a dynamic furniture system.
Figure 15:
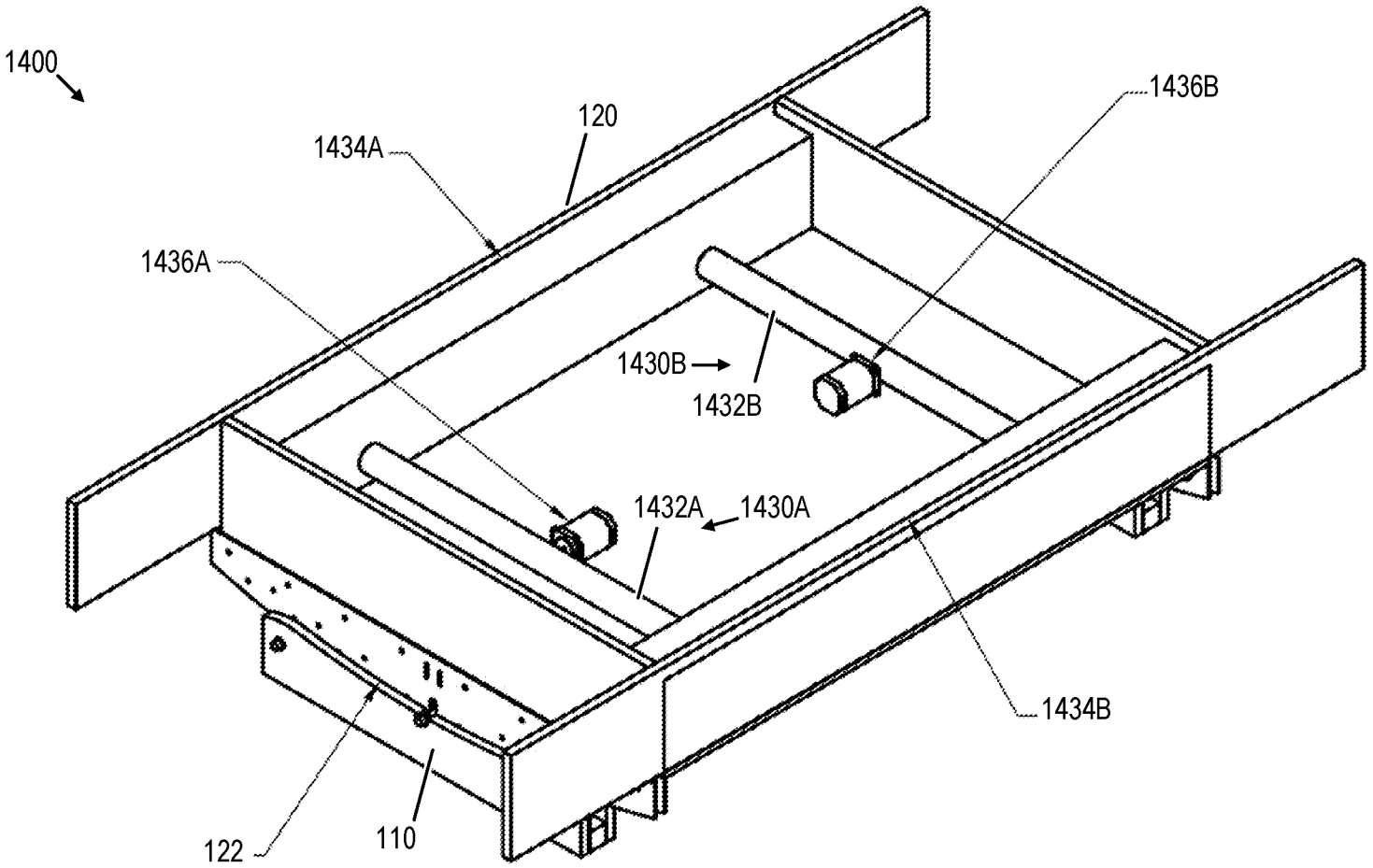

FIGS. 14 and 15 depict a third example of a dynamic furniture system 1400. In this example, dynamic furniture system 1400 again takes the form of a bed frame. Dynamic furniture system 1400 is similar to previously described dynamic furniture system 100 of FIGS. 1-7 in many respects. However, dynamic furniture system 1400 includes a mass transfer subsystem 1430 that utilizes transfer of a fluid (e.g., water) along one or more fluid pathways 1432 between fluid reservoirs 1434A and 1434B located on opposite sides of a midplane of the frame portion to which the mass transfer subsystem is mounted. The mass transfer subsystem includes an electro-mechanical actuator 1436 in the form of one or more fluid pumps that are operable to transfer the fluid back and forth along the fluid pathway.

FIG. 15 depicts an example of dynamic furniture system 1400 including two instances of mass transfer subsystem 1430 of FIG. 14 as indicated at 1430A and 1430B that each utilizes the transfer of a fluid between fluid reservoirs 1434A and 1434B along a respective fluid pathway 1436A and 1436B by operation of a respective electro-mechanical actuator 1436A and 1436B. The fluid-based mass transfer subsystems described with reference to FIGS. 14 and 15 may be used to implement motion control and/or balance control with respect to a frame of a dynamic furniture system.

Within FIG. 14, an example control architecture 1410 is depicted schematically for controlling operation of electromagnetic actuator 1436 of mass transfer system 1430 to provide balance control, motion control, or a combination of balance control and motion control. Control architecture 1410 can refer to any of the components of control architecture 1200 described in further detail with reference to FIG. 12. As an example, control architecture 1410 can include an electronic control system, a power delivery system, sensors, and other electronic components disclosed herein. It will be understood that electronic control architecture 1410 can be configured at various locations on-board the dynamic furniture system from the location depicted schematically in FIG. 14, and can include components distributed among a variety of different locations on-board the dynamic furniture system.

Figure 16:
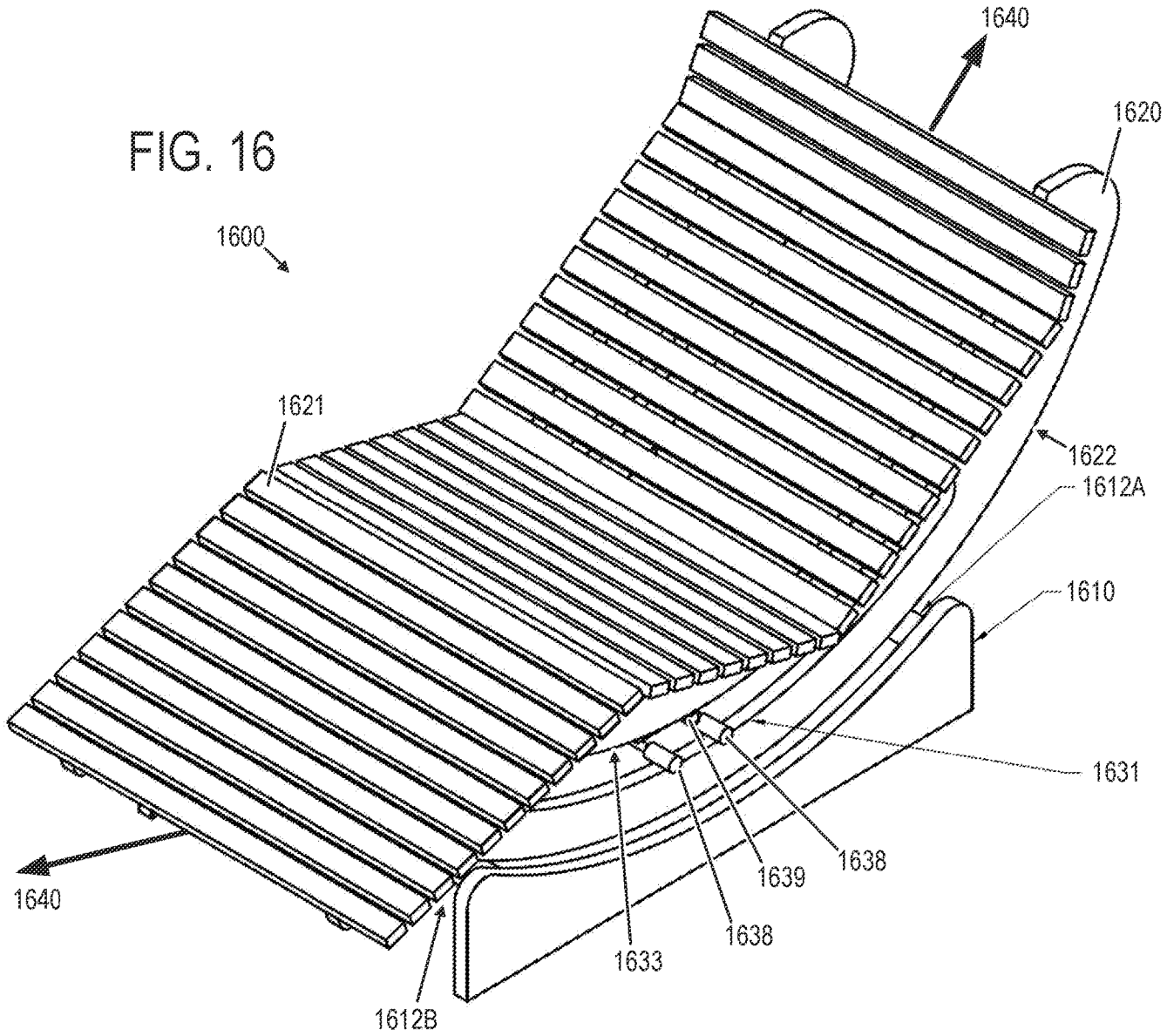
FIGS. 16-19 depict a fourth example of a dynamic furniture system.

FIGS. 16-19 depict a fourth example of a dynamic furniture system 1600. In this example, dynamic furniture system 1600 takes the form of a chair having an upper frame portion 1620 that is moved back and forth relative to a lower frame portion 1610 (e.g., its base) as indicated by path of motion 1640 by back and forth motion of a ballast portion 1632 provided by a mass transfer system 1630. In FIG. 16, supports (e.g., slats) forming an upper surface 1621 of the chair are depicted as one example of a chair shape.

Figure 18:
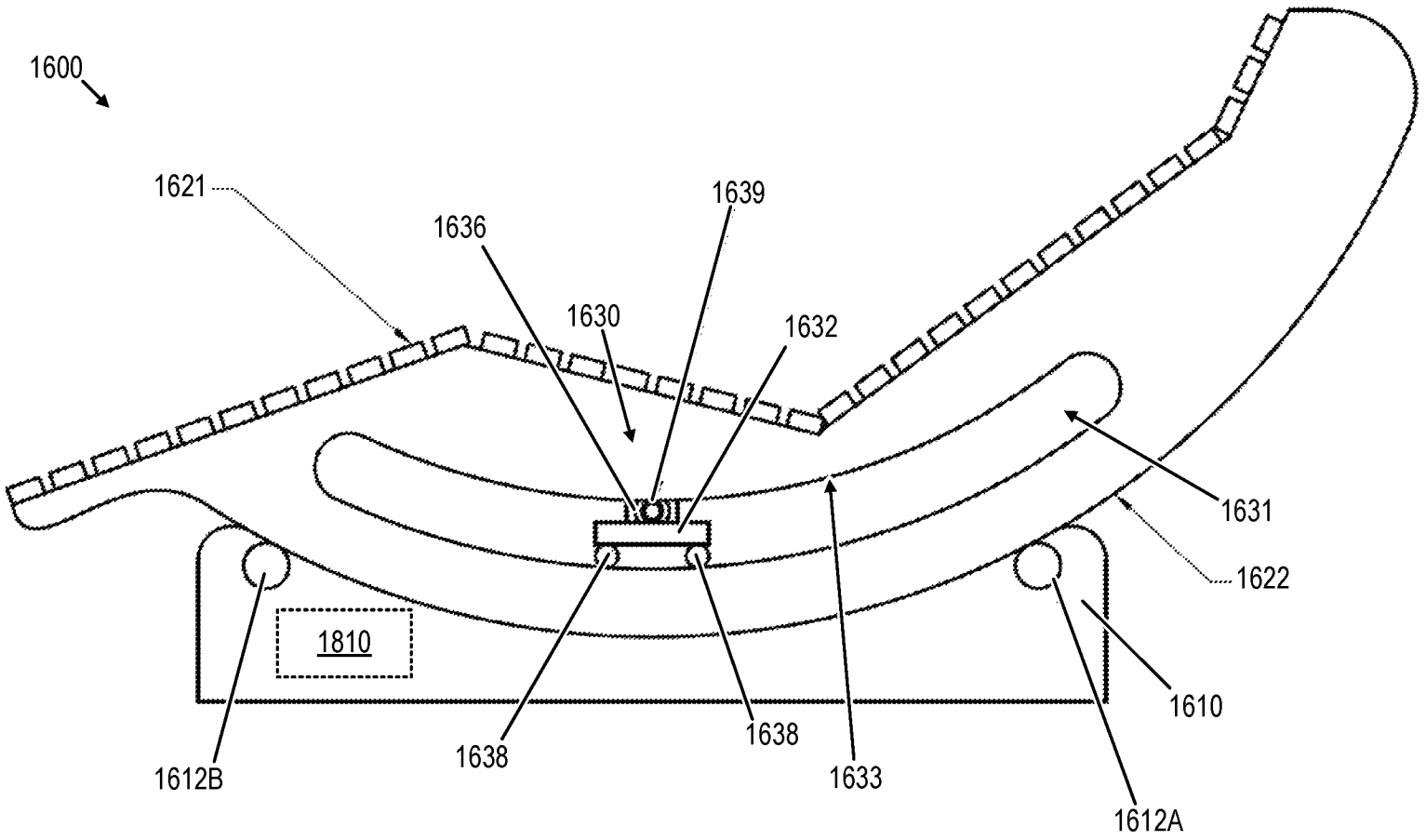

Upper frame portion 1620 defines rockers that have roller-interface surfaces 1622 that have curved shape as viewed in profile (e.g., within FIG. 18). This curved shape can form an arc segment that has a fixed radius of curvature (e.g., to simulate motion of a fixed length pendulum). Roller-interface surfaces 1622 interface with a set of rollers 1612A and 1612B mounted to lower frame portion 1610 to enable upper frame portion 1620 to move back and forth by rolling of the rollers along the roller-interface surfaces.

Mass transfer system 1630 includes an electric motor 1636 that drives a pinion 1639 that engages with a rack 1633 that configured along an interior facing surface of curved channel 1631 (e.g., a track) formed in upper frame portion 1620. In an example, rack 1633 defines a profile (as viewed in FIG. 18) that forms an arc having a fixed radius. The back and forth motion of the upper frame portion of the chair relative to its lower frame portion in this example is oriented along a direction that a person would face if seated upon the chair, in contrast to the side to side motion of the bed configuration depicted in FIG. 1. Also in contrast to the example dynamic furniture systems of FIGS. 1-11, dynamic furniture system 1600 includes a mass transfer subsystem having a curved ballast pathway (e.g., a curved rack 1633 having of fixed radius or other suitable radius of curvature) that engages with pinion 1639 of electric motor 1636 (as one example of an electro-mechanical actuator). Furthermore in this example, ballast portion 1632 has rollers 1638 mounted thereon that ride upon a lower surface of channel 1631.

Figure 17:
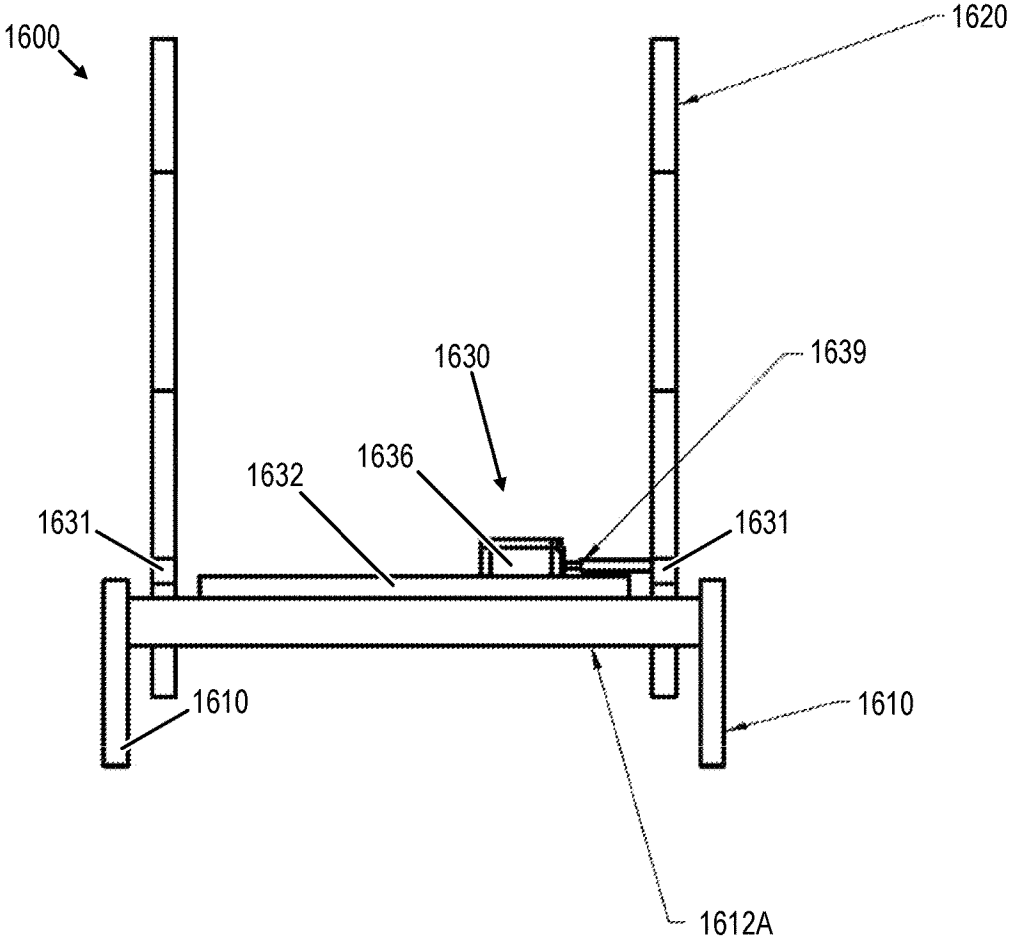
Figure 19:
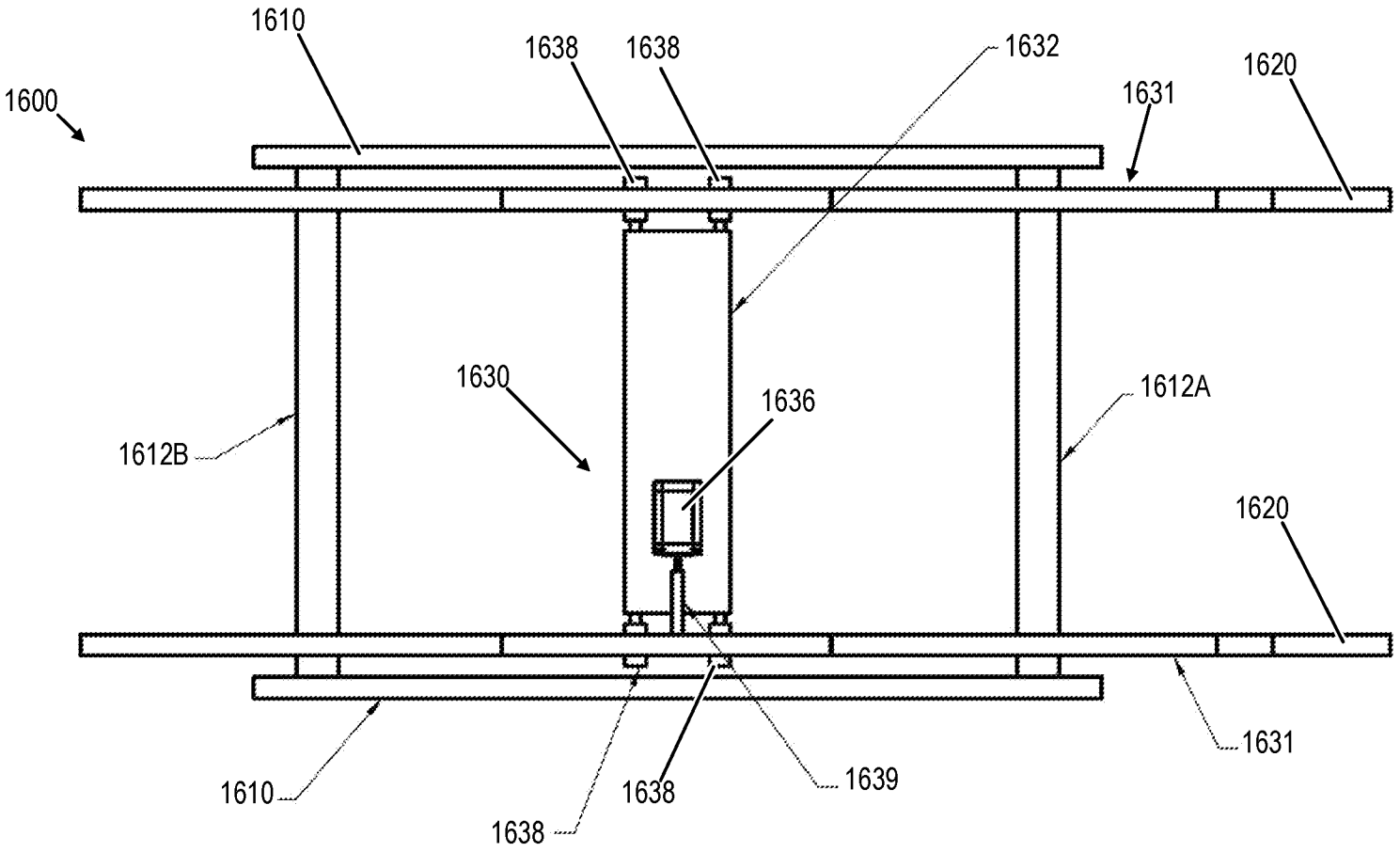

In FIG. 17, dynamic furniture system 1600 is viewed along the direction of motion of the upper frame portion. In FIG. 18, dynamic furniture system 1600 is viewed from a side. In FIG. 19, dynamic furniture system 1600 is viewed from above with supports (e.g., slats) removed, looking down upon an underlying surface upon which the lower frame portion rests.

Within FIG. 18, an example control architecture 1810 is depicted schematically for controlling operation of electric motor 1636 (as an example electromagnetic actuator) of mass transfer system 1630 to provide balance control, motion control, or a combination of balance control and motion control. Control architecture 1810 can refer to any of the components of control architecture 1200 described in further detail with reference to FIG. 12. As an example, control architecture 1810 can include an electronic control system, a power delivery system, sensors, and other electronic components disclosed herein. It will be understood that electronic control architecture 1810 can be configured at various locations on-board the dynamic furniture system from the location depicted schematically in FIG. 18, and can include components distributed among a variety of different locations on-board the dynamic furniture system.

Figure 20:
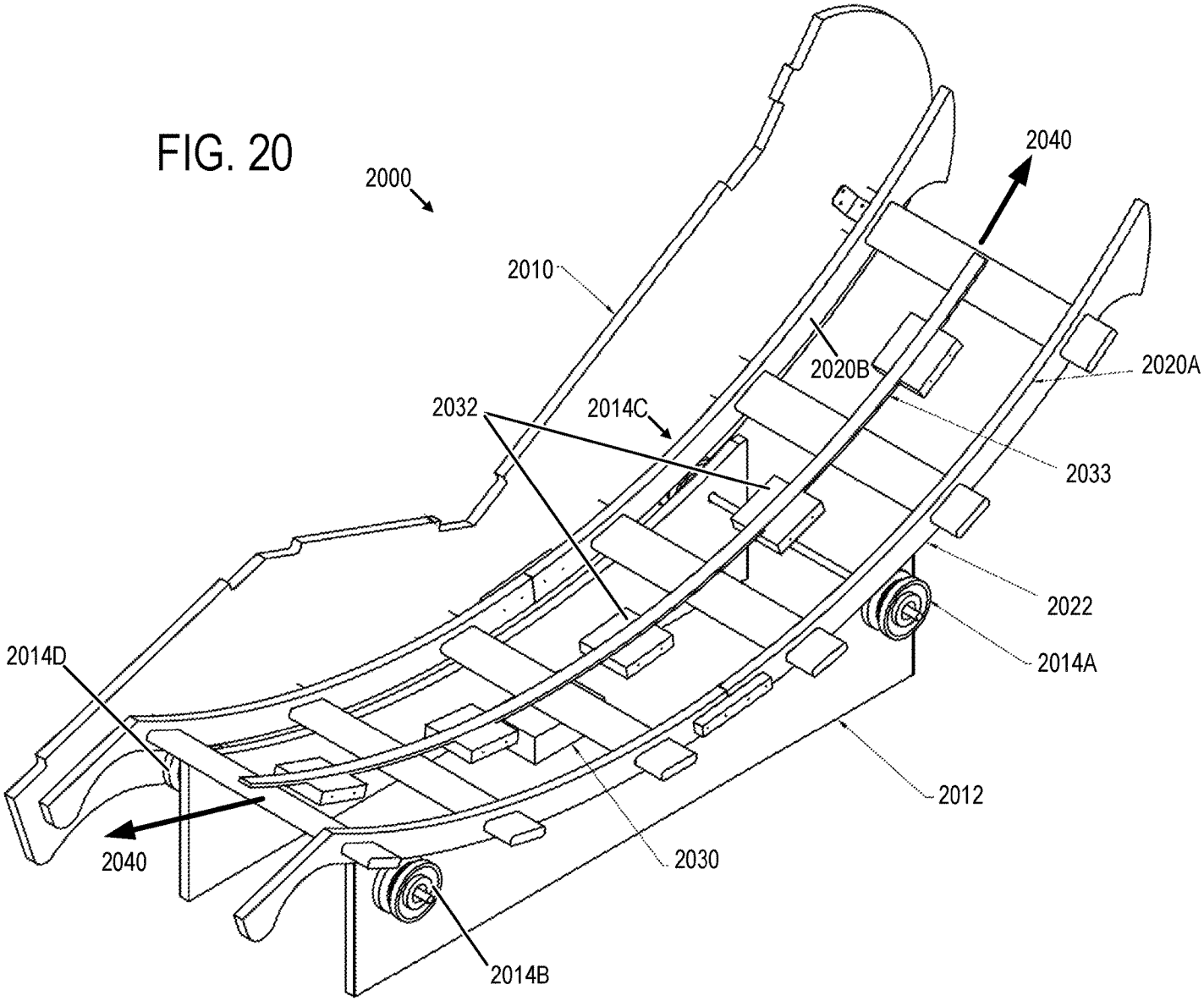
FIGS. 20 and 21 depict a fifth example of a dynamic furniture system.
Figure 21:
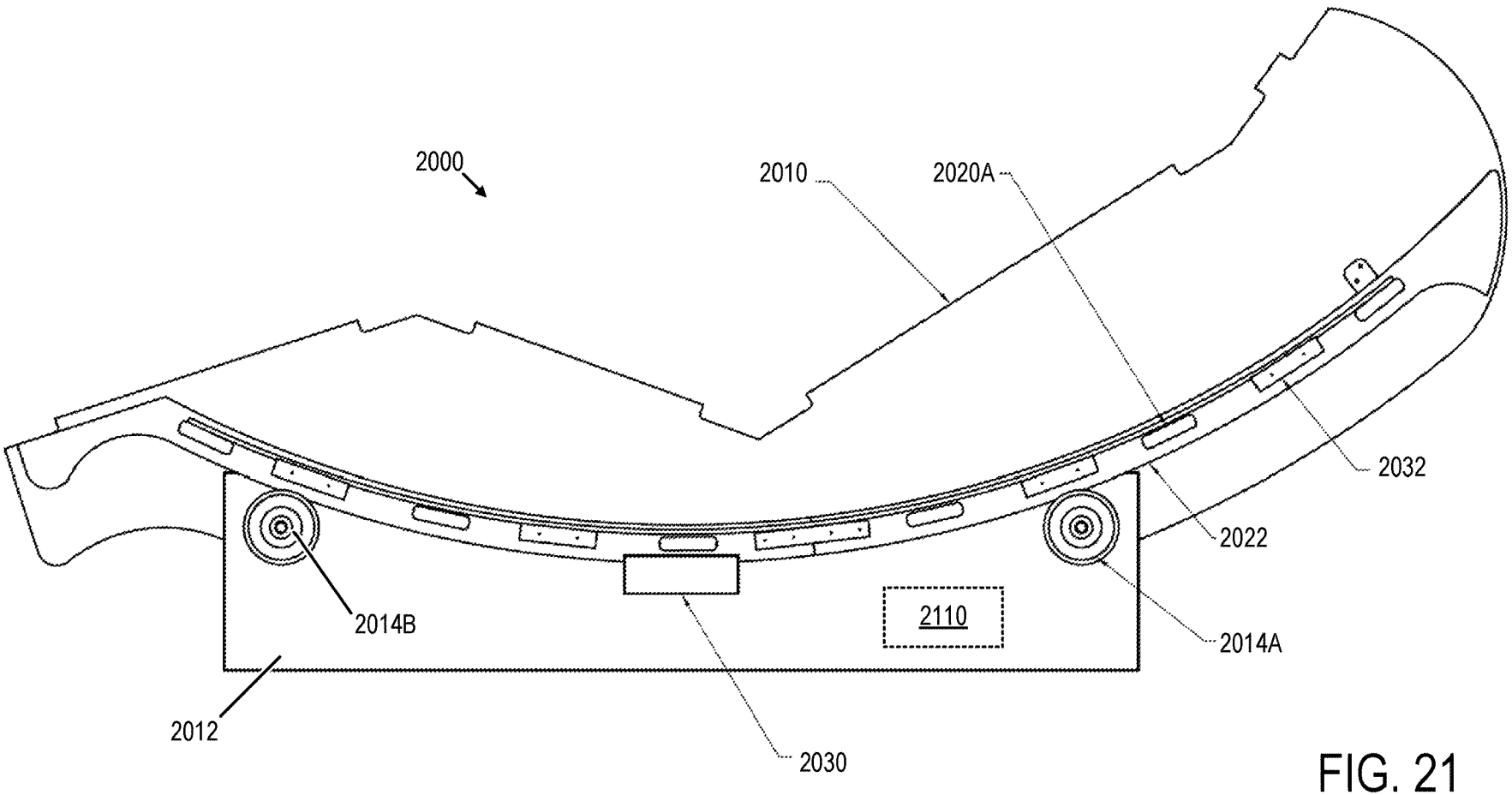

FIGS. 20 and 21 depict a fifth example of a dynamic furniture system 2000. In this example, dynamic furniture system 2000 again takes the form of a chair having an upper frame portion 2010 that is moved back and forth relative to a lower frame portion 2012 (e.g., its base) by back and forth motion. For example, upper frame portion includes a set of rockers 2020A and 2020B, each defining a roller-interface surface 2022 having a curved profile (e.g., having a fixed radius). Lower frame portion 2012 includes a set of rollers 2014A, 2014B, 2014C, and 2014D. The set of rollers interface with the roller-interface surface of each of the one or more rockers such that the second frame portion is moveable relative to the first frame portion by rotation of the set of rollers along each roller-interface surface. For example, rollers 2014A and 2014B interface with surface 2022 of rocker 2020A, and rollers 2014C and 2014D interface with a corresponding surface of rocker 2020B.

In this example, the back and forth motion is provided via an electromagnetic actuator including a set of one or more electromagnets 2030 mounted to lower frame portion 2012 that interacts with one or more electromagnetically-interactive elements 2032 (e.g., a permanent magnet, an electromagnet, a ferromagnetic object, etc.), such as previously described with reference to dynamic furniture system 800 of FIGS. 8-11. Dynamic furniture system 2000 can use the electromagnetic actuation techniques and configuration described in further detail with reference to FIG. 26B, which depicts an example electromagnetic actuator 2650 that can be operated as a radial flux electric motor or an alternating current induction motor. The one or more electromagnetically-interactive elements 2032 are mounted to and distributed at intervals along frame member 2033 in this example. Frame member 2033 can position elements 2032 along an arc that has the same radius of curvature as the roller-interface surfaces of the rockers.

The back and forth motion of the upper frame portion of the chair relative to its lower frame portion in this example is again orientated along a direction 2040 that a person would face if seated upon the chair. Within FIGS. 21 and 22, a side and cross-framing supports are removed to show features located within the chair.

Within FIG. 21, an example control architecture 2110 is depicted schematically for controlling operation of electromagnets 2030 (as part of an electromagnetic actuator) to provide balance control, motion control, or a combination of balance control and motion control. Control architecture 2110 can refer to any of the components of control architecture 1200 described in further detail with reference to FIG. 12. As an example, control architecture 2110 can include an electronic control system, a power delivery system, sensors, and other electronic components disclosed herein. It will be understood that electronic control architecture 2110 can be configured at various locations on-board the dynamic furniture system from the location depicted schematically in FIG. 21, and can include components distributed among a variety of different locations on-board the dynamic furniture system.

Within the preceding examples of dynamic furniture systems, a curved rocker is used to guide a frame back and forth along a curved path that simulates motion of a pendulum. In further examples, a curved rocker may be replaced by a section (e.g., a concave side or dish) of a spherical surface, and a frame portion may be supported above the section of the spherical surface by a set of wheels or rollerball casters. Alternatively, a section of a spherical surface may be provided for each wheel or caster of the frame portion (e.g., three or four sections of spherical surface for each of three or four wheels or casters). In either case, the section or sections of spherical surfaces allow for yaw, pitch, and roll of the frame portion. In still further examples, the rollers, wheels, casters, etc. disclosed herein may be replaced by magnetic levitation systems that provide an airgap and/or reduce friction between the rocker/section of spherical surface and follower elements that are guided along the rocker/section.

FIGS. 22-24 depict a sixth example of a dynamic furniture system 2200. In this example, dynamic furniture system 2200 includes a frame 2210 that takes the form of a swing or basket that can be suspended above a ground surface 2202 from a structure 2204 by a tether 2206. In an example, frame 2210 is sized accommodate one or more people within an interior region of frame 2210. Surface finishing such as decking, cushions, coverings, etc. have been omitted from FIGS. 22-24 to reveal components that can be used as part of motion control and/or balance control with respect to frame 2210.

In this example, dynamic furniture system 2200 includes a mass transfer system 2230 (e.g., mounted at a lower, distal end of frame 2210) that is operable to move back and forth along path of travel 2208 to provide motion control and/or balance control with respect to frame 2210. Mass transfer system 2230 includes a ballast portion 2232, a ballast pathway 2234, and an electro-mechanical actuator 2236. In an example, ballast pathway 2234 can take the form of a track and electro-mechanical actuator 2236 can take the form of an electric motor having a motor shaft that operatively engages with the track such that operation of the electric motor results in translation of the electric motor and ballast portion 2232 mechanically coupled to body of the electric motor along path of travel 2208.

While mass transfer system 2230 is described within the context of dynamic furniture system 2200, it will be understood that other actuation techniques described herein may be used in combination with furniture that is suspended from a structure above an underlying ground surface, including non-linear electro-mechanical actuation techniques (e.g., via curved ballast pathways) and electromagnetic actuation techniques.

Additionally, in this example, another electro-mechanical actuator 2242 (e.g., an electric motor) can operatively couple mass transfer system 2230 to frame 2210, which enables the mass transfer system to be selectively rotated relative to the frame (e.g., in the horizontal plane depicted in FIG. 24) by operation of the motor. Alternatively, electro-mechanical actuator 2242 can operatively couple frame 2210 to tether 2206, enabling the frame to be selectively rotated relative to the tether by operation of the motor. By varying the rotational relationship between structure 2204 and mass transfer system 2230, a frame 2210 of the dynamic furniture system can be adjusted through motion control of ballast portion 2232 to be in any direction within polar coordinates of the horizontal plane. Additionally, balance control can be provided within three dimensions relative to the horizontal plane by selectively moving the ballast portion along path of travel 2208 and/or by rotating the ballast portion relative to structure 2204.

Within FIG. 23, an example control architecture 2310 is depicted schematically for controlling operation of electromechanical actuators (e.g., 2036, 2042) to provide balance control, motion control, or a combination of balance control and motion control. Control architecture 2310 can refer to any of the components of control architecture 1200 described in further detail with reference to FIG. 12. As an example, control architecture 2310 can include an electronic control system, a power delivery system, sensors, and other electronic components disclosed herein. It will be understood that electronic control architecture 2310 can be configured at various locations on-board the dynamic furniture system from the location depicted schematically in FIG. 23, and can include components distributed among a variety of different locations on-board the dynamic furniture system.

FIGS. 25A-25E depict aspects of another example dynamic furniture system 2500. System 2500 in this example takes the form of a lounge chair in which an upper portion (e.g., additional structural features and/or surface finishes such as pillows, textile coverings, etc. shown schematically at 2540 of FIGS. 25C and 25D) of the lounge chair has been removed in FIG. 25A to reveal various components of the system.

Figure 25A:
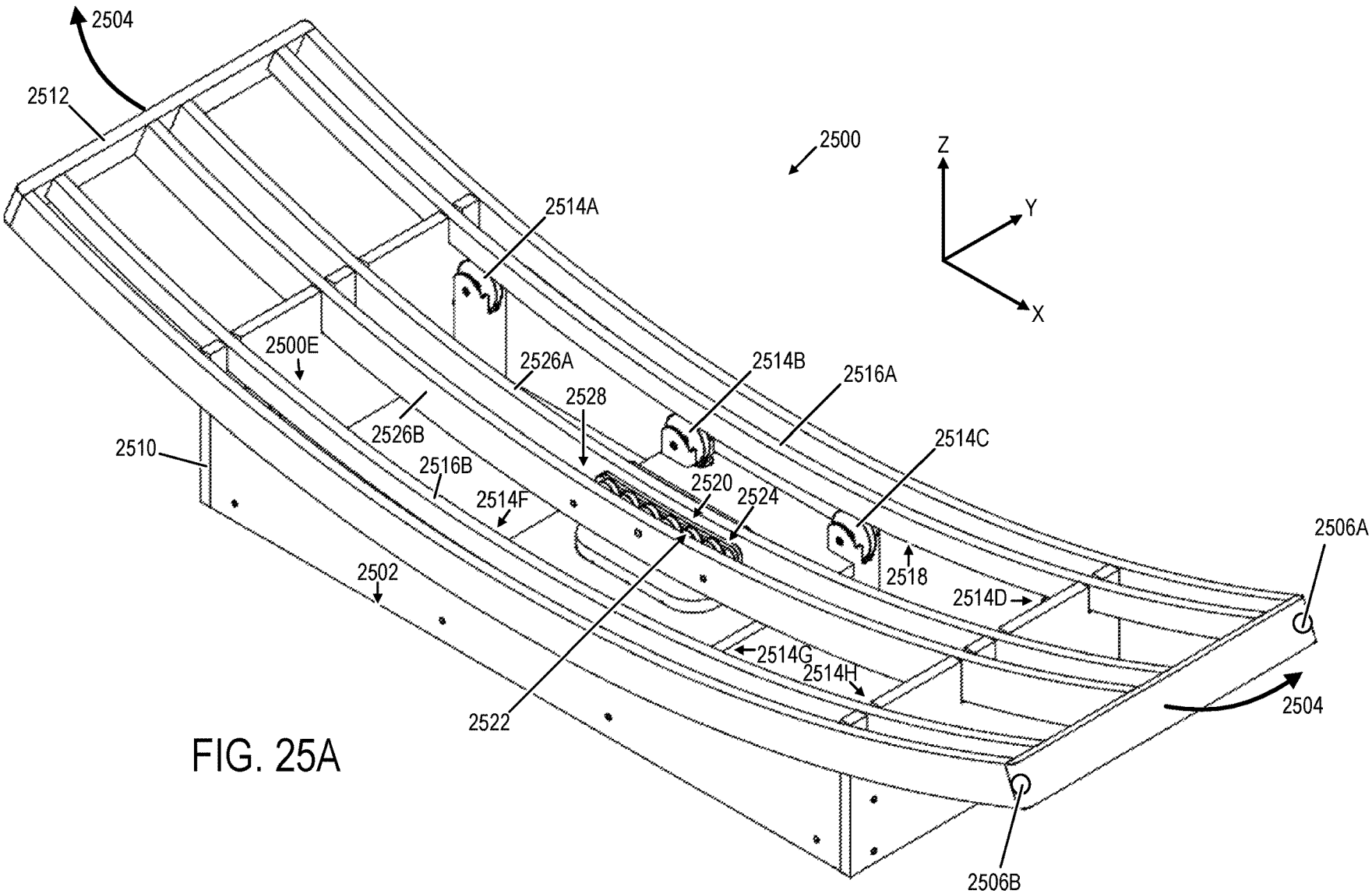
FIGS. 25A-25E depict a seventh example of a dynamic furniture system.
Figure 25B:
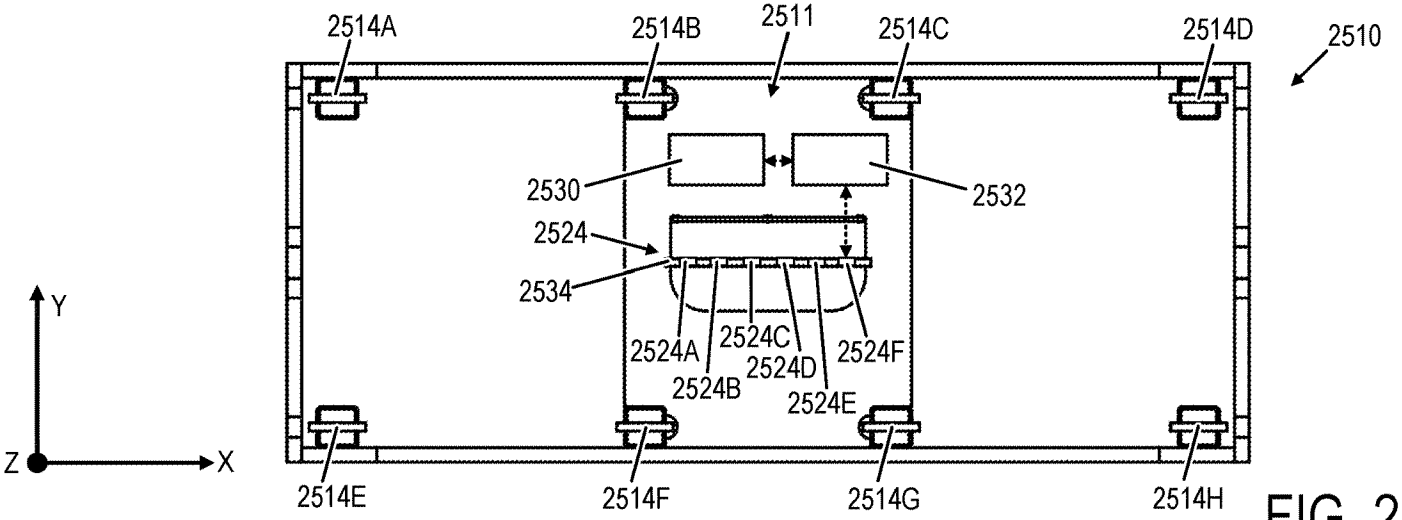
Figure 25C:
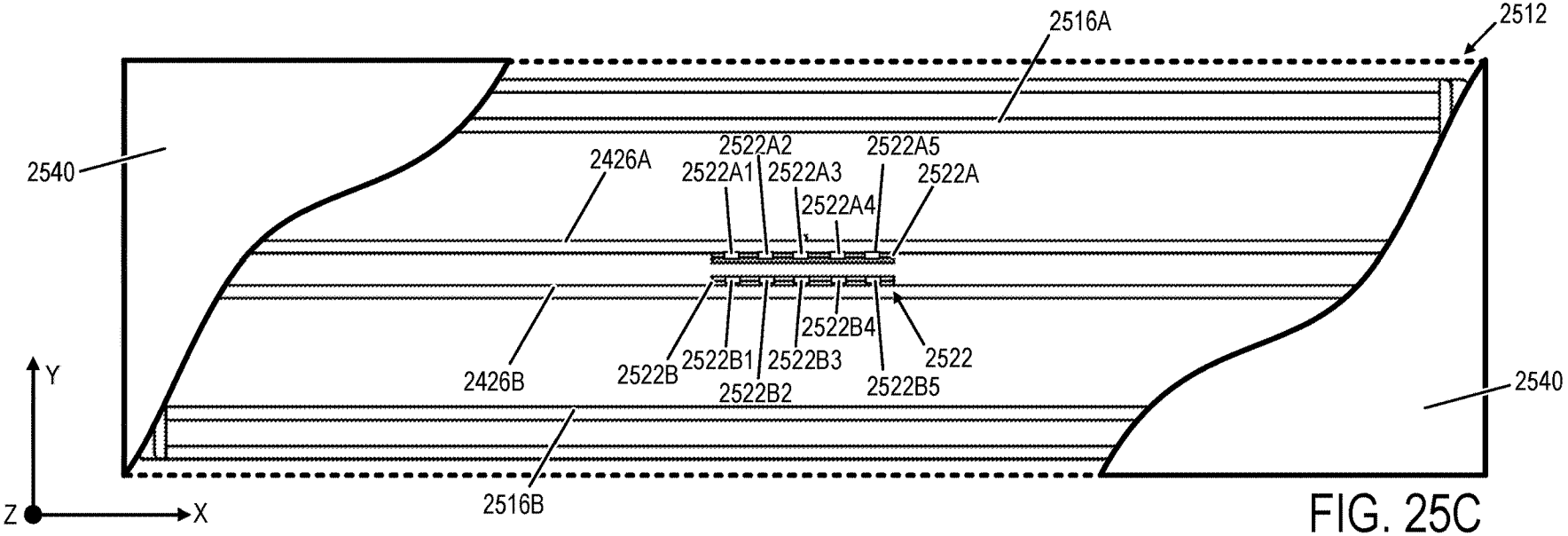
Figure 25D:
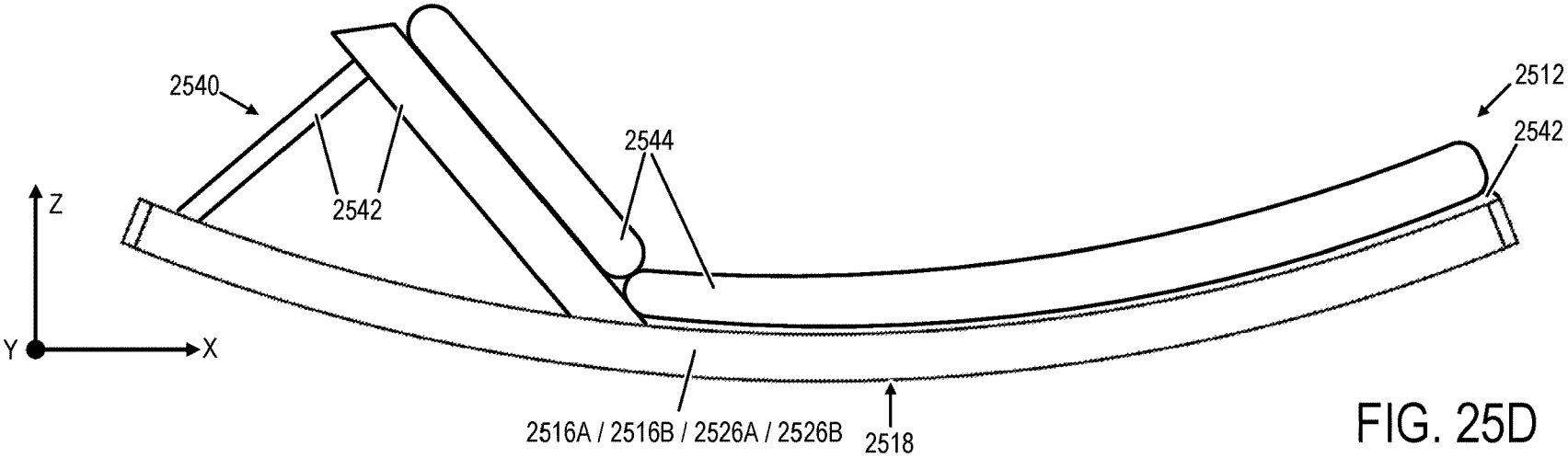

System 2500 includes a first frame portion 2510 and a second frame portion 2512 that is moveable relative to the first frame portion. FIGS. 25B and 25C depict additional aspects of first frame portion 2510 and second frame portion 2512, respectively, in a plan view as may be viewed along the Z-axis. FIGS. 25C and 25D depict additional aspects of second frame portion 2512 and first frame portion 2510, respectively, in a side view or elevation view as may be viewed along the Y-axis.

System 2500 includes a set of rollers (e.g., rollers 2514A-2514H) mounted to first frame portion 2510. Second frame portion 2512 includes one or more rockers (e.g., rockers 2516A and 2516B). Each rocker of the one or more rockers defines a roller-interface surface 2518 having a curved profile. The set of rollers (2514A-2514H) can interface with the roller-interface surface 2518 of the one or more rockers 2516A and 2516B such that the second frame portion is moveable relative to the first frame portion by rotation of the set of rollers along the roller-interface surface of each of the one or more rockers. In this example, rollers 2516A-2516D interface with roller-interface surface 2518 of rocker 2516A, and rollers 2516E-2516H interface with another instance of roller-interface surface 2518 of rocker 2516B.

In this example, first frame portion 2510 forms a base of system 2500 that supports second frame portion 2512 upon a ground surface 2502. However, system 100 can have other suitable configurations, such as where first frame portion 2510 is supported by or upon second frame portion 2512. In the configuration of FIG. 25A, second frame portion 2512 can move back and forth relative to first frame portion 2510 along a curved path of motion 2504 that is curved within the X-Z plane as viewed along the Y-axis, the shape of which is defined by the curved profile of roller-interface surface 2518.

In at least some examples, any of the dynamic furniture systems disclosed herein can include one or more optical sensors located along exterior edges of the frame and that image the environment in a direction of the primary path(s) of motion of a frame portion. These optical sensors can interface with the electronic control system and be used to detect the presence of objects near or within a range of motion of the frame portion. Responsive to detection of an object, the electronic control system can be configured to discontinue inducing motion of the frame portion and/or apply braking of the frame portion to stop or reduce its motion. As an example, FIG. 25A shows second frame portion 2512 having optical sensors 2506A and 2506B (e.g., cameras or other suitable optical sensor) mounted thereon at first end of the second frame portion (e.g., at the corners). One or more other optical sensors can be similarly mounted at a second end of the second frame portion opposite the first end.

System 2500 further includes an electromagnetic actuation system 2520 including one or more electromagnetic actuators, one example of which is depicted in FIGS. 25A-25C. Electromagnetic actuation system 2520 can include a set of one or more electromagnets 2522 mounted to or integrated with first frame portion 2510 or second frame portion 2512, and a set of one or more magnetically-interactive elements 2524 mounted to or integrated with a different one of the first frame portion or the second frame portion from the set of electromagnets. Within the example of system 2500, the set of electromagnets 2524 can be mounted to or integrated with first frame portion 2510, and the set of magnetically-interactive elements 2522 can be mounted to or integrated with second frame portion 2512. For example, second frame portion 2512 in this example includes frame members 2526A and 2526B that are parallel to and spaced apart from each other to form a channel 2528 therebetween to which the magnetically-interactive elements 2522 can be mounted to or integrated. Frame members 2526A and 2526B can have the same curvature as rockers 2516A and 2516B, in at least some examples. Further, in this example, the set of electromagnets 2522 can be mounted to or integrated with a fin (e.g., 2534 of FIG. 25B) that projects into channel 2528, enabling the set of electromagnets 2522 to be located proximate to and/or between the magnetically-interactive elements 2522 on one or both sides of the channel.

Within FIG. 25B, an example control architecture 2511 is depicted schematically for controlling operation of electromagnets 2524 (as part of an electromagnetic actuator) to provide balance control, motion control, or a combination of balance control and motion control. Control architecture 2511 can refer to any of the components of control architecture 1200 described in further detail with reference to FIG. 12. As an example, control architecture 2511 can include electronic control system 2530, a power delivery system 2532, sensors, and other electronic components disclosed herein. It will be understood that electronic control architecture 2511 can be configured at various locations on-board the dynamic furniture system from the location depicted schematically in FIG. 25B, and can include components distributed among a variety of different locations on-board the dynamic furniture system.

As shown in FIG. 25C, system 2500 can further include an electronic control system 2530 that interfaces electrically with the set of electromagnets 2524, for example, via a power delivery system 2532. In this example, the set of electromagnets 2524 includes six electro magnets 2524A-2524F. However, other suitable number of electromagnets can be used. Electronic control system 2530 is an example of previously described electronic control system 1210 of FIG. 12, and power delivery system 2532 is an example of previously described power delivery system 1225 of FIG. 12. In at least some examples, electronic control system 2530 is configured to provide motion control for system 2500 by varying a parameter of electrical energy supplied to the set of electromagnets 2524 over time to induce back and forth motion of one of the first frame portion or the second frame portion relative to the other of the first frame portion or the second frame portion. In this example, back and forth motion along the curved path of motion 2504 can be induced in second frame portion 2512 relative to first frame portion 2510 (e.g., which interfaces with ground surface 2502).

Within FIG. 25D, the curved profile of roller-interface surface 2518 of second frame portion 2512 is shown, along with as example structural features 2542 (e.g., chair back and decking) and surface finishes 2544 (e.g., pillow cushions with textile coverings) as examples of the features and finishes shown schematically in FIG. 25C at 2540.

Figure 25E:
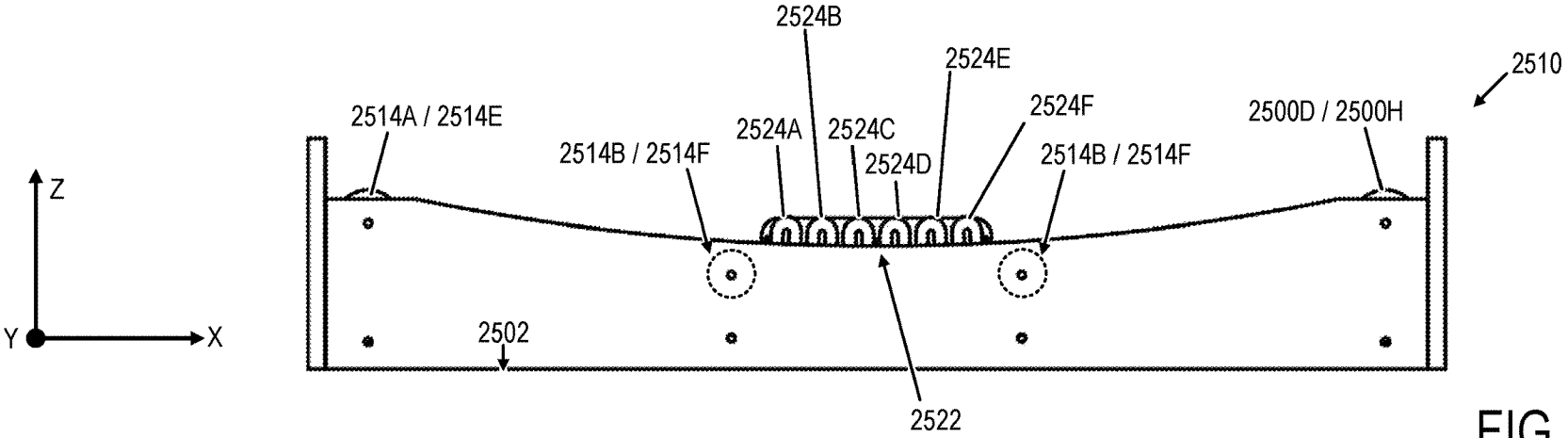

Within FIG. 25E, a relative position of rollers 2514 of first frame portion 2510 are depicted as viewed within the X-Z plane, as well as an orientation of coils of electromagnets 2524A-2524F each having an axis that orientated parallel to the Y-axis.

FIGS. 26A and 26B are schematic diagrams depicting examples of electromagnetic actuators that can be used with any of the dynamic furniture systems disclosed herein at an interface between a first frame portion and a second frame portion.

In FIG. 26A, an electromagnetic actuator is formed collectively by a set of one or more electromagnets (e.g., 2610) and a set of one or more magnetically interactive elements (e.g., 2620 and/or 2622). The set of electromagnets 2610 can be mounted to or integrated with a first frame portion of a dynamic furniture system, and the set of magnetically interactive elements 2620 and 2622 can be mounted to or integrated with a second frame portion of the dynamic furniture system that is moveable relative to the first frame portion. As an example, the set of electromagnets 2610 can refer to an example of the set of electromagnets 2524 of FIGS. 25A and 25B, and the set of magnetically interactive elements 2620 and 2622 can refer to an example of magnetically interactive elements 2522A and 2522B of FIGS. 25A and 25C.

Furthermore, in this example, a first set of magnetically interactive elements 2620 can include a plurality of magnets 2618A-2618F (e.g., permanent magnets or electromagnets) and a second set of magnetically interactive elements 2622 can include a plurality of magnets 2619A-2619F (e.g., permanent magnets or electromagnets). Each magnet of set 2620 can be aligned along an axis with a corresponding magnet of set 2622 to form a magnet pair. For example, magnet 2618A is aligned along an axis 2617 with magnet 2619A to form a magnet pair. In at least some examples, the primary magnetic field of each magnet of each magnet pair (e.g., 2618A and 2619A) of the plurality of magnets can be orientated in the same direction along the axis (e.g., 2617) that this shared by that magnet pair. For example, primary magnetic fields 2615A are shown aligned with each other and pointing in the same direction in FIG. 26A for magnets 2618A and 2619A (e.g., orientated along the Y-axis). This configuration can reinforce the magnetic flux across a channel through which the set of electromagnets 2610 travel back and forth. Furthermore, in at least some examples, each magnet pair can have a primary magnetic field that points in the opposite direction of the neighboring magnet pair(s). For example, a magnet pair formed by magnets 2618B and 2619B can have primary magnetic fields 2615B that are aligned with each other, but point in an opposite direction (e.g., along the Y-axis) as compared to primary magnetic fields 2615A.

In this example, electromagnetic actuator 2600 has a configuration that approximates an arc segment of an axial flux electric motor operable on direct current. Within FIG. 26A, the X, Y, Z coordinate space can refer to the X, Y, Z coordinate space of FIGS. 25A-25E, as an example. The Z-axis, for example, can be orientated parallel to the gravity vector to provide a view looking down upon features of a dynamic furniture system that rests on a ground surface that is parallel to the X-Y plane.

Back and forth motion 2630 of the set of electromagnets 2610 relative to the set of magnetically interactive elements 2620 and 2622 is shown in FIG. 26A within the X-Z plane that is orthogonal to the Y-axis. As an example, back and forth motion 2630 can refer to the curved path of motion 2504 of FIG. 25A. A schematic representation of an orientation 2632 of a path of travel of rollers of the dynamic furniture system relative to the rockers is shown within FIG. 26A parallel to the X-Z plane that is orthogonal to the Y-axis and parallel to the relative back and forth motion 2630.

The set of one or more electromagnets 2610 can include one or more coils 2612, each forming a respective electromagnet. As an example, a respective coil 2612 can form each of electromagnets 2524A-2524F of FIGS. 25B and 25E. In this example, an axis 2614 of each coil 2612 is oriented parallel to the Y-axis. The set of magnetically interactive elements 2622, 2622 in this example take the form of one or more magnets (e.g., permanent magnets or electromagnets) located on opposite sides of the set of electromagnets 2612. This configuration can has the potential to double magnetic flux usage in an axial direction that is parallel to the Y-axis.

Within the example of FIG. 26A, electrical energy 2634 in the form of direct current is provided to the set one or more electromagnets 2610 to generate a magnetic field that has a primary magnetic vector 2636 orientated parallel to the Y-axis, and is orthogonal to the relative back and forth motion 2630 and orientation 2632 of a path of travel of the rollers along the rockers of the dynamic furniture system. For example, the primary magnetic vector 2636 can be orientated parallel to axis 2614 of each coil 2612 of the set of electromagnets 2610.

In examples where the rockers provide a path of travel of the rollers of the dynamic furniture system that forms an arc within the X-Z plane (e.g., FIG. 25D), the configuration of FIG. 26A can be referred to as a forming or approximating an arc segment of an axial flux electric motor in which the primary magnetic vector 2636 is orientated parallel to a hypothetical motor axis passing through a center of the arc.

In FIG. 26B, another electromagnetic actuator 2650 is formed collectively by a set of one or more electromagnets (e.g., 2652) and a set of one or more magnetically interactive elements (e.g., 2654). In this example, electromagnetic actuator 2650 has a configuration that can be operated to approximate either an arc segment of a radial flux direct current (DC) motor or an alternating current induction motor.

Within FIG. 26B, the X, Y, Z coordinate space can again refer to the X, Y, Z coordinate space of FIGS. 25A-25E, as an example. Back and forth motion 2660 of the set of magnetically interactive elements 2654 relative to the set of electromagnets 2652 is shown in FIG. 26B parallel to the X-Z plane and orthogonal to the Y-axis. As an example, back and forth motion 2660 can refer to the curved path of motion 2504 of FIG. 25A. A schematic representation of path of travel 2662 of rollers of the dynamic furniture system relative to the rockers is shown within the X-Z plane that is orthogonal to the Y-axis and parallel to the relative back and forth motion 2660.

The set of electromagnets 2652 includes three electromagnets each formed by a respective coil 2664A, 2664B, and 2664C. In contrast coil orientation of the configuration of FIG. 26A, the configuration of FIG. 26B orientates an axis of coils 2664A, 2664B, and 2664C represented schematically as axis 2666 orthogonal to the X-axis and toward a hypothetical center of the radius formed by path of travel 2662 along the Z-axis.

In a first example, electromagnetic actuator 2650 can be operated to approximate an arc segment of a radial flux direct current motor by supplying electrical energy 2670A, 2670B, 2670C, etc. in the form of direct current to the respective coils 2664A, 2664B, 2664C, etc. to generate a magnetic field having a primary magnetic vector 2672. In this example, primary magnetic vector 2672 is orthogonal to the X-axis and is orientated toward a hypothetical center of the radius formed by path of travel 2662 along the Z-axis.

In a second example, electromagnetic actuator 2650 can be operated to approximate an arc segment of an alternating current induction motor by supplying electrical energy 2670A, 2670B, 2670C, etc. in the form of alternating current to the respective coils 2664A, 2664B, 2664C, etc. to generate a magnetic field having primary magnetic vector 2672. In this example, the set of magnetically interactive elements 2654 can be formed by one or more magnetically interactive ferromagnetic materials (e.g., steel, aluminum, or other metal or combination of metals), and an amount of magnetic force can be induced in the set of magnetically interactive elements 2654 by varying a frequency of the alternating current supplied to coils 2664A, 2664B, 2664C, etc. in addition to or as an alternative to varying electrical power including an amount of current or an amount voltage.

In each of the above examples of direct current or alternating current, individual coils 2664A, 2664B, and 2664C can be operated as a single phase electromagnet or as a multi-phase (e.g., three phase) electromagnet. For example, a modulated parameter (e.g., an amount of electrical energy or a frequency of alternating current) of electrical energy 2670A, 2670B, and 2670C can be timed responsive to a position, direction of motion, and velocity of the set of magnetically interactive elements 2654.

FIG. 26B further depicts a detailed view 2680 of coil 2664 that can refer to any of 2664A, 2664B, and 2664C. Within detailed view 2680, an intermediate magnetically interactive element 2682 formed from one or more metals (e.g., laminated steel) is included along axis 2666 between coil 2664 and the set of magnetically interactive elements 2654 that are moved relative to the set of electromagnets 2652. For example, this intermediate element 2682 can interface with an end of coil 2664 located on the near-side of the set of magnetically interactive elements 2654. This intermediate element can serve to increase the magnetic field generating efficiency of the coil.

Figure 27:
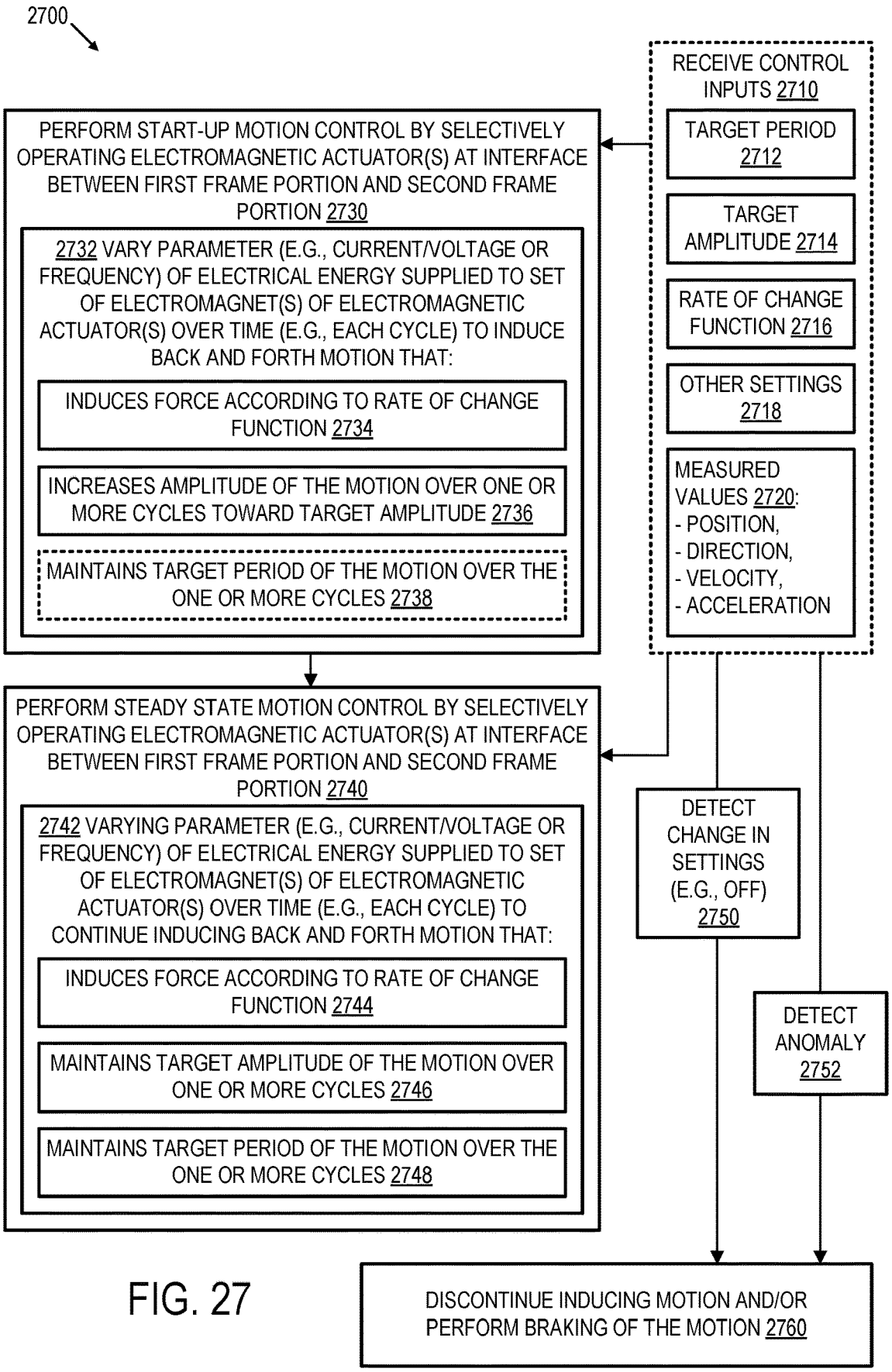
FIGS. 27 and 28 depict example methods for providing motion control for a dynamic furniture system via electromagnetic actuators.

FIG. 27 depicts example method 2700 for providing motion control for a dynamic furniture system via electromagnetic actuators, such as may be used at an interface between first and second frame portions. As an example implementation of method 2700, the electromagnetic actuators previously described with reference to FIGS. 26A and 26B can be controlled by an electronic control system (e.g., 1210 of FIG. 12, 2530 of FIG. 25B, etc.) to induce back and forth motion in a frame portion of a dynamic furniture system relative to another frame portion. Method 2700 can be used in combination with previously described method 1300 of FIG. 13. For example, aspects of method 2700 can form part of motion control 1330, and more specifically operation 1360 of FIG. 13. While method 2700 is described using electromagnetic actuators to provide motion control, it will be understood that electro-mechanical actuators can be similarly operated using the techniques of method 2700 in combination with a moveable ballast portion of a mass transfer system to provide motion control.

At 2710, various inputs can be received, including a target period 2712 of back and forth motion for the dynamic furniture system, a target amplitude 2714 of the back and forth motion, a rate of change function 2716, other settings 2718 (e.g., user-defined settings 1312 and/or system-defined settings 1314 of FIG. 13), and measured values 2720 from sensor input (e.g., received at 1320 of FIG. 13). As an example, measured values 2720 can include a current position of a frame portion, a direction of motion of the frame portion, a velocity of the motion of the frame portion, an acceleration of the motion of the frame portion, etc. FIG. 27B depicts examples of how control inputs 2710 can be obtained by an electronic control system. In at least some examples, target period 2712 can be calculated based on an equation for a fixed length pendulum that defines the period as the square root of pendulum length (e.g., the fixed radius of the roller-interface surface of the rockers) divided by the acceleration of gravity, which is multiplied by $2\pi$ ((Pi).

At 2730, the method can include performing start-up motion control by selectively operating one or more electromagnetic actuators at an interface between a first frame portion and a second frame portion. As an example, the electromagnetic actuators selectively operated at 2730 can include electromagnetic actuators 2600 and 2650 of FIGS. 26A and 26B. Start-up motion control can be used to induce back and forth motion from a rest state of the dynamic furniture system and/or to increase amplitude from a lower amplitude state of the dynamic furniture system.

As part of operation 2730, the method at 2732 can include varying a parameter of electrical energy supplied to the set of electromagnets over time to induce back and forth motion. In the case of direct current, the parameter varied at operation 2732 can include an amount of current or voltage of the direct current. In the case of alternating current, the parameter varied at operation 2732 can include a frequency of the alternating current.

In at least some examples, the parameter can be varied at operation 2732 to induce back and forth motion that: at 2734, induces a force at the set of magnetically interactive elements according to the rate of change function 2716; at 2736, and increases the amplitude of the back and forth motion over one or more cycles toward target amplitude 2714. In at least some examples, at 2738, the method can include maintaining target period 2712 of the back and forth motion over the one or more cycles as the amplitude of motion is increased. However, in other examples, start-up motion control may not maintain the target period, but may permit a threshold deviation from the target period during start-up.

Upon attaining target amplitude 2714, steady state motion control can be performed at 2740 by selectively operating one or more electromagnetic actuators at the interface between the first frame portion and the second frame portion. As part of operation 2740, the method at 2742 can include varying the parameter of electrical energy supplied to the set of electromagnets over time to continue inducing the back and forth motion. Again, in the case of direct current, the parameter varied at operation 2732 can include an amount of current or voltage of the direct current. In the case of alternating current, the parameter varied at operation 2732 can include a frequency of the alternating current.

Again, in at least some examples, the parameter can be varied at operation 2742 to continue inducing the back and forth motion that: at 2744, induces a force at the set of magnetically interactive elements according to the rate of change function 2716; at 2746, maintains target amplitude 2714 of the back and forth motion over one or more cycles; and at 2748, maintains target period 2712 of the back and forth motion over the one or more cycles as the amplitude of the motion is maintained.

At 2750, changes in settings (e.g., motion of the dynamic furniture system is switched off by a user) can be detected at 2750 and/or anomalies can be detected at 2752 based on the control inputs received at 2710. Responsive to certain changes in settings detected at 2750 and/or anomalies detected at 2752, the method at 2760 can include discontinuing inducing motion via the one or more electromagnetic actuators and/or performing braking to stop or reduce the amplitude of the back and forth motion. As an example, the set of electromagnetic actuators can be selectively operated to induce a force in the set of magnetically interactive elements at a timing that causes destructive interference with the back and forth motion to reduce the amplitude of the motion. In at least some examples, discontinuing inducing motion and/or braking can be performed responsive to detection of an object near or within a vicinity of a path of motion of a frame portion, such as by using one or more optical sensors (e.g., optical sensors 2506A and 2506B of FIG. 25A.

Figure 28:
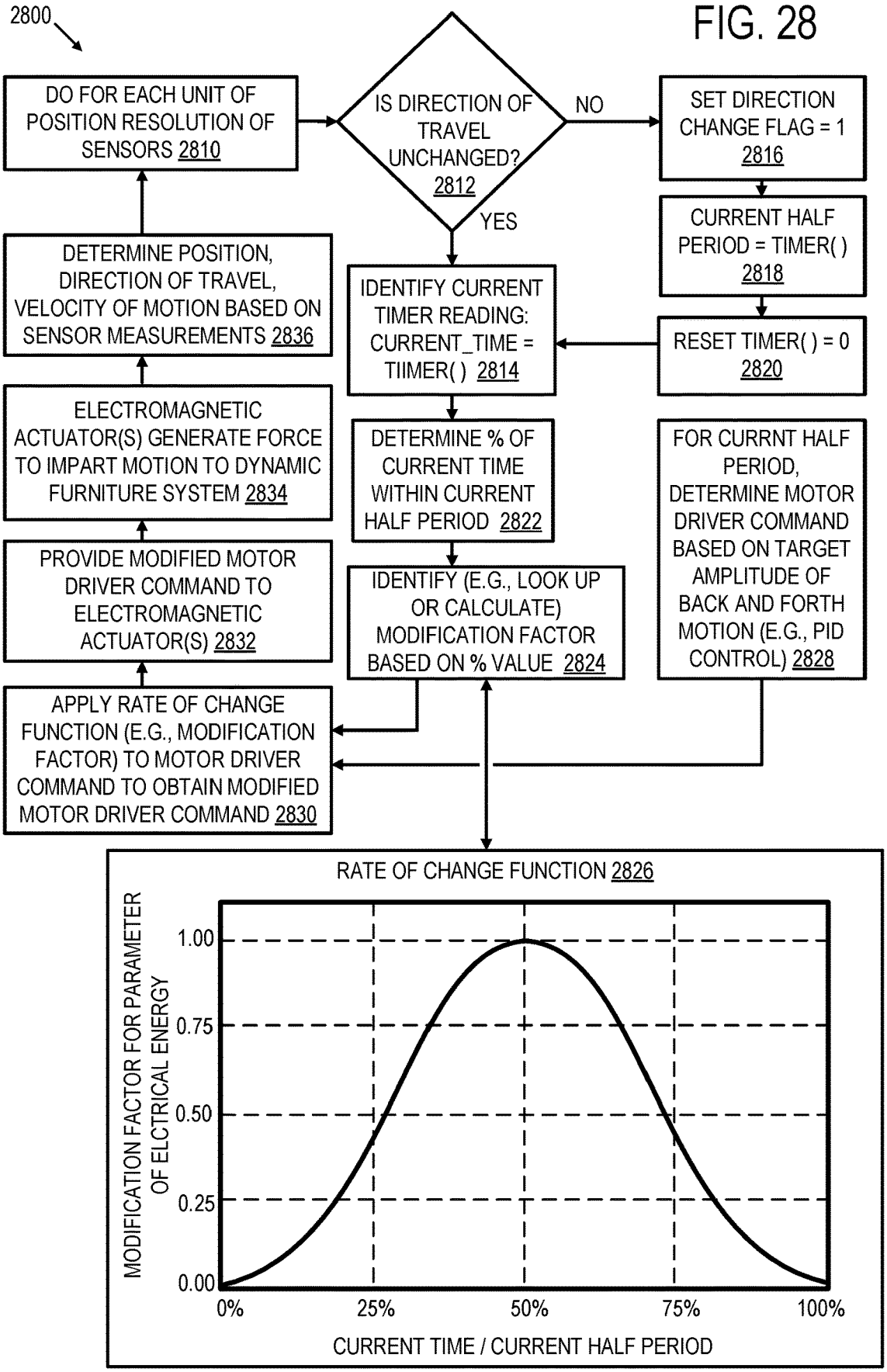

FIG. 28 depicts example method 2800 for providing motion control for a dynamic furniture system via electromagnetic actuators, such as may be used at an interface between first and second frame portions. As an example, method 2800 can form part of operations 2730 and 2740 of FIG. 27, and can form part of motion control 1330 of FIG. 13, including operation 1360. Method 2700 can be performed by any of the electronic control system disclosed herein, including electronic control system 1210 of FIG. 12, as an example.

Beginning at 2810, for each unit of position resolution that can be measured by the sensors of the dynamic furniture system, a determination can be made at 2812 whether the direction of travel as part of back and forth motion of a frame portion of the dynamic furniture system is unchanged. As an example, one or more previous measurements of the position of the frame portion can be compared to the current position of the frame portion measured by the sensors.

If the direction of travel is unchanged, the method at 2814 includes identifying the current reading of a timer (e.g., CURRENT_TIME=TIMER( )), in which the timer provides a measurement of time from the previous change in the direction of travel. If the direction of travel is not unchanged (i.e., the direction is determined to have changed), at 2816, a direction change flag can be set to a predefined value of e.g., "1". At 2818, the current half period is identified by the timer (i.e., TIMER( )), and at 2820, the timer is reset to zero (i.e., TIMER ( )=0 and the timer begins measuring time from the time of reset. From operation 2820, the method proceeds to previously described operation 2814 in which the current timer reading is obtained for the timer.

At 2822, a percentage (%) or relative proportion of the current time is identified within a current half period (i.e., the current transit of the frame portion between a previous change in direction and an expected future change in direction) for a target period for the dynamic furniture system. As an example, the target period can be a pendulum-defined period for a fixed length pendulum as can be predefined within the electronic control system.

At 2824, a modification factor can be identified based on the percentage (%) or relative proportion determined at 2822 using a rate of change function 2826. Rate of change function 2826 is represented by a graph in this example. However, a rate of change function can take other suitable forms, including a look-up table, an index, a map, a set of one or more equations, etc. Within the example rate of change function 2826, a given modifier (e.g., a modification value) can be identified along the vertical axis for a given percentage or relative proportion of the current time to the current half period. It will be understood that various techniques can be used to identify the modification factor at 2824, including referencing a look-up table, index, map, etc., or calculating the modification factor based on one or more equations.

In at least some examples, the rate of change function has the shape of a bell curve or segment of a sine function. As an example, the rate of change function can define: a change of the parameter in a first value direction (e.g., an increase or decrease of the parameter value) at an increasing rate of change from a change of direction of the back and forth motion over a first portion of each half cycle (e.g., that ends at 25% of the half cycle), and at a decreasing rate of change from an end of the first portion of each half cycle over a second portion of each half cycle (e.g., that ends at 50% or the midpoint of the half cycle), and a subsequent change of the parameter in a second value direction opposite the first value direction at a subsequently increasing rate of change from an end of the second portion of each half cycle over a third portion of each half cycle (e.g., that ends at 75% of the half cycle), and at a subsequently decreasing rate of change from an end of the third portion of each half cycle over a fourth portion of each half cycle that concludes at another change of direction of the back and forth motion (e.g., at the next change of direction of the back and forth motion). This rate of change function can simulate the effect a gentle push and reduce the perception of jolting or other high impulse force. Within the example of modification factor 2824, the first value direction is an increase of the parameter value from zero and the second value direction is a decrease of the parameter value to zero. However, in other examples, other suitable floor values can be used other than zero.

At 2828, for the current half period, a motor driver command (i.e., the set of electromagnetic actuators) is determined based on a target amplitude of the back and forth motion, for example, using feedback from the amplitude (e.g., position) measured for the previous change in the direction of travel. As an example, proportional-integral-derivative control can be implemented by the electronic control system to increase amplitude over time until the target amplitude is reached, and then maintain the target amplitude over each cycle of back and forth motion.

At 2830, the rate of change function is applied to the motor driver command to obtain a modified motor driver command. For example, the modification factor can be multiplied by the motor driver command determined at 2828. Because the motor driver command prior to application of the rate of change function considers feedback from the application of a previous modified motor driver command, the driver command determined at 2828 accounts for scaling of the motor driver command.

At 2832, the modified motor driver command is provided to the set of one or more electromagnetic actuators. As an example, the motor driver command can take the form of electrical energy of direct current or alternating current having a set of parameters, including electrical power, voltage, current, and/or frequency of current (in the case of alternating current). The motor driver command can take the form of direct current or alternating current.

At 2834, the electromagnetic actuators generate a force responsive to the modified motor driver command that imparts motion to the frame portion of the dynamic furniture system.

At 2836, the position, direction of travel, velocity of motion, etc. are determined for the frame portion based on sensor measurements. The process flow can then return to operation 2810. By repeating method 2800 for each unit of position resolution or for other suitable resolution (e.g., time increment), application of the rate of change function results in a parameter of the electrical energy provided to the electromagnetic actuators varying over time, including within the period and half period of the back and forth motion. As previously described with reference to method 2700 of FIG. 27, the parameter of the electrical energy provided to the electromagnetic actuators can include an amount of electrical power (e.g., by varying one or both of: current, voltage) or a frequency of the electrical current (e.g., in the case of alternating current being used to provide induction). Thus, in at least some examples, the electronic control system detects a change of a direction of motion of one of the first frame portion or the second frame portion, and the parameter of electrical energy can be varied according a predefined function that is timed relative to the change of the direction of motion and relative to a subsequent change of the direction of motion.

Figure 29A:
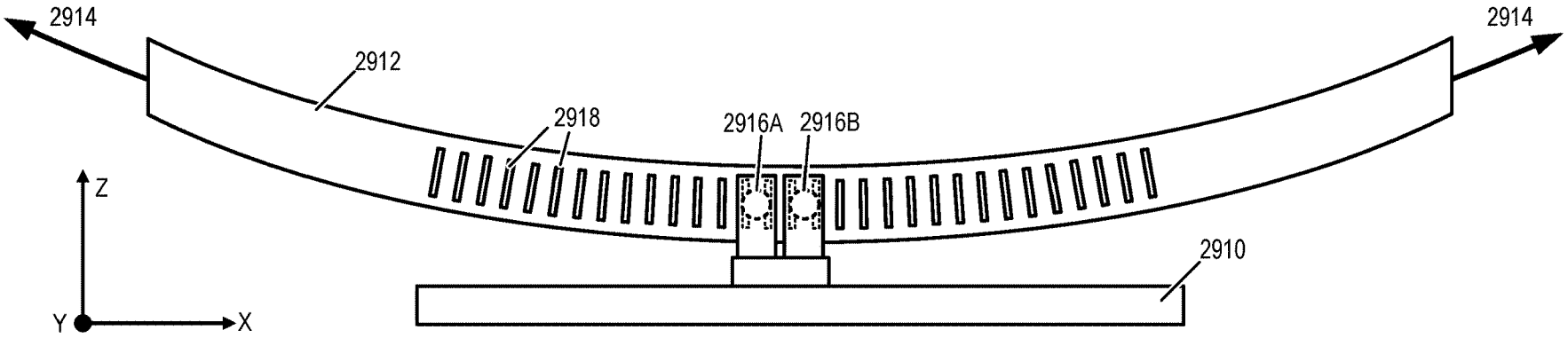
FIGS. 29A and 29B depict example sensor configurations that can form part of the disclosed dynamic furniture systems.
Figure 29B:
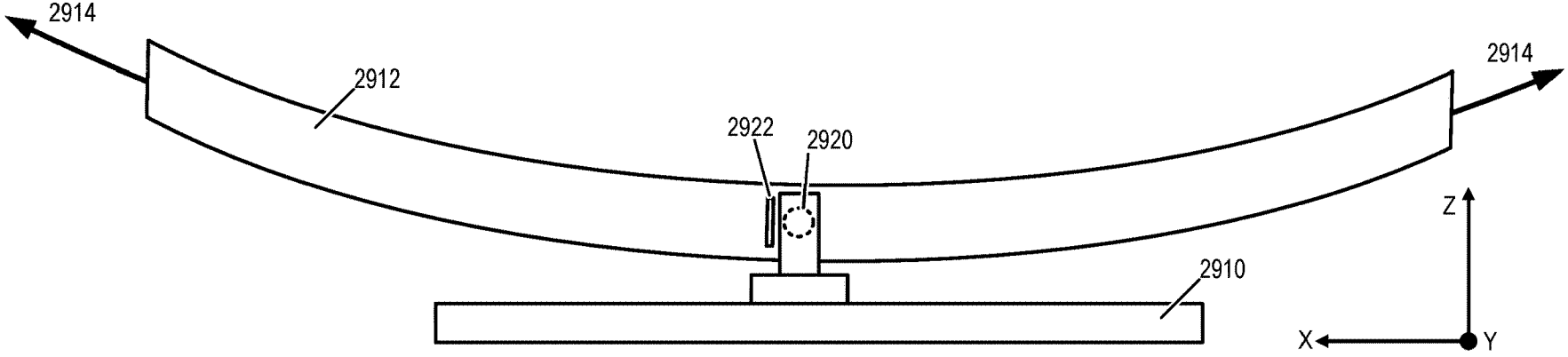

FIGS. 29A and 29B depict example sensor configurations that can form part of the dynamic furniture systems disclosed herein. Within FIGS. 29A and 29B, a first frame portion 2910 and a second frame portion 2912 are moveable relative to each other. For example, second frame portion 2912 can move back and forth relative to first frame portion 2910 along a curved path of travel 2914. First frame portion 2910 and second frame portion 2912 can refer to any of the frame portions of the various furniture systems disclosed herein that are movable relative to each other. As an example, first frame portion 2910 can refer to part of first frame portion 2510, and second frame portion 2912 can refer to part of second frame portion 2512, including any of rockers 2516A or 2516B, frame members 2526A or 2526B, etc. of dynamic furniture system 2500 of FIG. 25A.

Second frame portion 2912, in this example, includes sensors 2916A and 2916B mounted to first frame portion 2910 that can detect the presence of features 2918 on-board second frame portion 2912. Sensors 2916A and 2916B are represented by broken lines in this example, because the are orientated toward second frame portion 2912 that passes behind the sensors within FIG. 29A. Features 2918 in this example include a plurality of features that are spaced apart from each other at equal increments along second frame portion 2912 to form the shape of an arc having the same shape as curved path of travel 2914. Data representing a spatial relationship between or among features 2918 can be stored within the electronic control system of the dynamic furniture system. As second frame portion 2912 is moved back and forth along path of travel 2914, sensors 2916A and 2916B can detect the presence of each of the plurality of features that passes by or in front of the sensors.

In a first example, position sensors 2916A and 2916B can take the form of optical sensors, and features 2918 can form three-dimensional openings, depressions, or protrusions within or upon second frame portion 2914, or can take the form of visual markers located on a surface of second frame portion 2914. In a second example, position sensors 2916A and 2916B can take the form of electromagnetic sensors (e.g., Hall effect sensors), and features 2918 can take the form of magnetically-interactive elements, such as magnets or objects formed of metals that otherwise influence a magnetic field in the vicinity of the sensors.

By detecting the presence of at least some of features 2918, and identifying a quantity of such features that pass by or in front of sensors 2916A and 2916B, a distance of travel along path of travel 2914 can be identified by an electronic control system, such as electronic control system 1210 of FIG. 12. This relative distance can provide an indication of a relative position, a velocity, an acceleration, and/or direction of travel of second frame portion 2912 relative to first frame portion 2010. For example, the electronic control system can receive sensor input from sensors 2916A and 2916B as previously described with reference to operation 1320 of FIG. 13, and can determine a relative change in position of second frame portion 2012 relative to first frame portion 2010 based on a predefined value representing a distance between features 2918. In this example, the sensor input received from position sensors 2916A and 2916B can indicate the position of the frame at 1324 of FIG. 13. By comparing the relative change in position to a time over which the measurements were captured by the sensors, the electronic control system can determine a velocity and acceleration of second frame portion 2912 relative to first frame portion 2910. Additionally, by using two sensors, a direction of the motion of second frame portion 2912 relative to first frame portion 2910 can be determined by the electronic control system based on a relative timing at which the same feature was detected by each of the two sensors. However, a single sensor can be used in at least some examples to determine a direction of motion. For example, an optical sensor can be used to observe movement of a feature within consecutive image frames or within an individual image frame based on analysis of blurring of the moving feature within the image. The position, direction, velocity, and acceleration of motion obtained via sensors 2916A and 2916B can refer to measured values 2720 of FIG. 27.

Referring also to FIG. 29B, another sensor 2920 is mounted to first frame portion 2910 that can detect the presence of a feature 2922 located on an opposite side of second frame portion 2912 from features 2918. However, in other examples, sensor 2920 and feature 29122 can be located on different portions of a frame of a dynamic furniture system. For example, feature 2922 can be located on different rail or frame member that moved in unison (e.g., within a fixed reference frame) with the rail or frame member upon which features 2918 are provided.

Feature 2922 is located at a predefined position (e.g., a center of a range of back and forth motion) of second frame portion 2912 that enables the electronic control system to determine the absolute position of the second frame portion upon detecting the presence of feature 2922. As an example, the electronic control system can store data representing a spatial relationship between feature 2922 and features 2918. In combination with measurements obtained via sensors 2916A and/or 2916B of FIG. 29A, the electronic control system can determine a distance of travel of second frame portion 2912 relative to feature 2922. Sensor 2920 can take the form of an optical sensor or electromagnetic sensor (e.g., Hall effect) and feature 2922 can take any of the form previous described with reference to features 2918 of FIG. 29A.

FIG. 30 is a circuit diagram of an example control architecture 3000 that can implement the various methods and operations described herein with respect to the dynamic furniture systems of the present disclosure. Control architecture 3000 is one example of control architecture 1200 of FIG. 12.

Within the circuit diagram of FIG. 30, control architecture 3000 includes the following features: an electronic control system 3002; a power input section 3004 that includes a positive voltage terminal 3006, a neutral terminal 3008, and a ground terminal 3010 that can interface electrically with an external electrical power source (e.g., wall outlet) or a battery, a fuse 3012, and a filter 3014; a user interface section 3016 by which user input, including power supply control 3018 can be provided as an input to electronic control system 3002 via a user input device that interfaces with a positive voltage terminal 3020, a neutral voltage terminal 3022 and a fuse 3024, other control inputs 3036 can be received via additional user interfaces represented schematically at 3028, and one or more indicator lamps (or graphical displays) 3030 and 3032 that can provide visual indication feedback 3038; a first electromagnetic actuator 3046A that includes three coils 3048A, 3048B, and 3048C as examples of electromagnets; a second electromagnetic actuator 3046B that also includes three coils 3048D, 3048E, and 3048F as examples of electromagnets; a first power supply module 3044A that manages delivery of electrical energy to the first electromagnetic actuator 3046A responsive to control by electronic control system 3002; a second power supply module 3044B that manages delivery of electrical energy to the second electromagnetic actuator 3046B responsive to control by electronic control system 3002; a first thermal fuse 3050A; a second thermal fuse 3050B; a sensor section 3054 that includes a first Hall effect sensor 3056A, a second Hall effect sensor 3056B, a third Hall effect sensor 3058C, a sensor circuit board 3058, and an encoder sensor set 3060; a status indicator lamp 3062; a reset button 3064 (e.g., push button); a configuration interface section 3066 that includes three double pole switches 3068A, 3068B, and 3068C in this example; and a programming and debugging port 3072 for electronic control system 3002.

Electronic control system 3002 is an example of electronic control system 1210 of FIG. 12, which includes logic subsystem 1220, storage subsystem 1222, and input/output subsystem 1224. Components such as power input section 3004, first power supply module 3044A, and second power module 3044B can form part of power delivery system 1225 of FIG. 12.

Electromagnetic actuators 3046A and 3046B can be configured to operate as an axial flux electric motor, a radial flux electric motor, or an alternating current induction motor, depending on implementation. For example, electromagnetic actuators 3046A and 3046B can be configured to operate as described with reference to electromagnetic actuators 2600 or 2650 of FIGS. 26A and 26B, and with reference to electromagnetic actuators 1252 of FIG. 12. As an example, coils 3048A-3048F can refer to coils 2524A-2524F of FIG. 25B. Furthermore, in this example, electromagnetic actuators 3046A and 3046B can be independently operated (e.g., powered) to generate respective magnetic fields at different timings and magnetic field intensities (magnetic forces) relative to each other. While electromagnetic actuators 3046A and 3046B each include three coils that are wired together to operate in a single phase, in other examples each coil can be independently wired to support any suitable number of phases per electromagnetic actuator. For example, power supply module 3044A can instead be replaced by three power supply modules that are each independently wired to a respective coil of electromagnetic actuator 3046A to provide three electromagnets that can be independently operated to generate respective magnetic fields. Furthermore, electromagnetic actuators 3046A and 3046B can each include a different quantity of coils from the three coils depicted by FIG. 30. As part of motion control with respect to a dynamic furniture system, power supply modules 3044A and 3044B can be configured to vary a parameter of electrical energy supplied to coils 3048A-3048F responsive to control input from electronic control system 3002, including varying an amount of electrical power by varying electrical current and/or voltage of direct current, or by varying a frequency of alternating current supplied to coils 3048A-3048F. Power supply module 3044B and electromagnetic actuator 3046B can be omitted in some examples.

Hall effect sensors 3056A-3056C and encoder 3060 can be configured as described with reference to FIG. 29 and rocker positioning sensors 1242 of FIG. 12. As an example, encoder 3060 can include one or more sensors (e.g., 2916A, 2916B, 2920) and one or more features (e.g., 2918, 2922) that are detectable by the sensors. Alternatively or additionally, sensors 2916A, 2916B, 2920 can refer to examples of Hall effect sensors 3056A-3056C. In an example, Hall effect sensors 3056A-3056C can be positioned at a forward end, a center position, and a rear end opposite the center position on a frame portion of a dynamic furniture system along an axis that is parallel to a plane of back and forth motion of the frame portion.

User interface section 3016 is an example of user interfaces 1246 of FIG. 12. Logic/digital inputs provided via user interface section 3016 can include commands or settings from the user as part of a user interface. As an example, the dynamic furniture system can include on/off buttons, a dial or other control interface to increase/decrease the target amplitude of the back and forth motion (e.g., between two or more different target amplitudes), etc. As an example, a user interface can be used by electronic control system 3002 to receive settings, such as user-defined settings 1312 of FIG. 13, which can include an on/off setting, an amplitude setting that defines a target amplitude of the back and forth motion of the frame (e.g., as determined at operation 1316 of FIG. 13), a brake setting that selectively engages and disengages a braking operation or disengages motion control with respect to the back and forth motion of the frame. Output to a user can be provided via an LED driver. A user input/output interface can support wireless connections with between the dynamic furniture system and a handheld device operated by a user, and can allow the dynamic furniture system to interact with a network-based interface for data collection/storage, and providing an interface dashboard (e.g., an application program) for the user to adjust settings and observe sensor measurements of the dynamic furniture system.

Configuration interface section 3066 can provide the option to run different programs at the electronic control system based on the switch selections. Configuration interface section 3066 is another example of user interfaces 1246 of FIG. 12. For example, one switch setting can be configured to execute a program for debugging/prototype functions that can be used following production or during maintenance to test the system. Another switch setting can be activated by the operator of the system to provide one or both of the motion control and balance control described herein. Another switch setting can be used to toggle between different electromagnet/motor configurations, as an example.

In at least some examples, the methods and operations described herein may be tied to a computing system of one or more computing devices. In particular, such methods and processes may be implemented as a computer-application program or service, an application-programming interface (API), a library, and/or other computer-program product.

FIG. 12 schematically shows a non-limiting embodiment of a computing system in the form of electronic control system 1210 that can enact one or more of the methods and processes described above. This computing system is shown in simplified form, and may take the form of one or more personal computers, server computers, tablet computers, home-entertainment computers, network computing devices, gaming devices, mobile computing devices, mobile communication devices (e.g., smart phone), and/or other computing devices.

A computing system includes a logic machine (e.g., logic subsystem 1220) and a storage machine (e.g., storage subsystem 1222). Computing system may optionally include a display subsystem, input/output subsystem, and/or other components.

A logic machine, such as logic subsystem 1220 of FIG. 12, includes one or more physical devices configured to execute instructions. For example, the logic machine may be configured to execute instructions that are part of one or more applications, services, programs, routines, libraries, objects, components, data structures, or other logical constructs. Such instructions may be implemented to perform a task, implement a data type, transform the state of one or more components, achieve a technical effect, or otherwise arrive at a desired result.

The logic machine may include one or more processors configured to execute software instructions. Additionally or alternatively, the logic machine may include one or more hardware or firmware logic machines configured to execute hardware or firmware instructions. Processors of the logic machine may be single-core or multi-core, and the instructions executed thereon may be configured for sequential, parallel, and/or distributed processing. Individual components of the logic machine optionally may be distributed among two or more separate devices, which may be remotely located and/or configured for coordinated processing. Aspects of the logic machine may be virtualized and executed by remotely accessible, networked computing devices configured in a cloud-computing configuration.

A storage machine, such as storage subsystem 1222 of FIG. 12, includes one or more physical devices configured to hold instructions executable by the logic machine to implement the methods and processes described herein. When such methods and processes are implemented, the state of the storage machine may be transformed—e.g., to hold different data.

A storage machine may include removable and/or built-in devices. Storage machine may include optical memory (e.g., CD, DVD, etc.), semiconductor memory (e.g., RAM, EPROM, EEPROM, etc.), and/or magnetic memory (e.g., hard-disk drive, floppy-disk drive, tape drive, MRAM, etc.), among others. The storage machine may include volatile, nonvolatile, dynamic, static, read/write, read-only, random-access, sequential-access, location-addressable, file-addressable, and/or content-addressable devices.

It will be appreciated that a storage machine includes one or more physical devices. However, aspects of the instructions described herein alternatively may be propagated by a communication medium (e.g., an electromagnetic signal, an optical signal, etc.) that is not held by a physical device for a finite duration.

Aspects of a logic machine and a storage machine may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

The terms "module," "program," and "engine" may be used to describe an aspect of a computing system implemented to perform a particular function. In some cases, a module, program, or engine may be instantiated via a logic machine executing instructions held by a storage machine. It will be understood that different modules, programs, and/or engines may be instantiated from the same application, service, code block, object, library, routine, API, function, etc. Likewise, the same module, program, and/or engine may be instantiated by different applications, services, code blocks, objects, routines, APIs, functions, etc. The terms "module," "program," and "engine" may encompass individual or groups of executable files, data files, libraries, drivers, scripts, database records, etc.

It will be appreciated that a "service" may refer to an application program executable across multiple user sessions. A service may be available to one or more system components, programs, and/or other services. In some implementations, a service may run on one or more server-computing devices.

When included, a display subsystem may be used to present a visual representation of data held by a storage machine. This visual representation may take the form of a graphical user interface (GUI). As the herein described methods and processes change the data held by the storage machine, and thus transform the state of the storage machine, the state of the display subsystem may likewise be transformed to visually represent changes in the underlying data. A display subsystem may include one or more display devices utilizing virtually any type of technology. Such display devices may be combined with a logic machine and/or a storage machine in a shared enclosure, or such display devices may be peripheral display devices.

When included, an input/output subsystem may comprise or interface with one or more user-input devices such as a keyboard, mouse, touch screen, or game controller. In some embodiments, the input subsystem may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection and/or intent recognition; as well as electric-field sensing componentry for assessing brain activity.

A communication subsystem of the input/output subsystem may be configured to communicatively couple the computing system with one or more other computing devices. A communication subsystem may include wired and/or wireless communication devices compatible with one or more different communication protocols. As non-limiting examples, the communication subsystem may be configured for communication via a wireless telephone network, or a wired or wireless local- or wide-area network. In some embodiments, the communication subsystem may allow the computing system to send and/or receive messages to and/or from other devices via a network such as the Internet.

According to an example of the present disclosure, a dynamic furniture system comprises: a first frame portion; a set of rollers mounted to the first frame portion; a second frame portion including one or more rockers, each of the one or more rockers defining a roller-interface surface having a curved profile; wherein the set of rollers interface with the roller-interface surface of each of the one or more rockers such that the second frame portion is moveable relative to the first frame portion by rotation of the set of rollers along each roller-interface surface; a set of one or more electromagnets mounted to or integrated with the first frame portion or the second frame portion; a set of one or more magnetically-interactive elements mounted to or integrated with a different one of the first frame portion or the second frame portion from the set of one or more electromagnets; and an electronic control system interfacing electrically with the set of electromagnets, the electronic control system configured to provide motion control for the dynamic furniture system by varying a parameter of electrical energy supplied to the set of electromagnets over time to induce back and forth motion of one of the first frame portion or the second frame portion relative to the other of the first frame portion or the second frame portion. In this or other examples disclosed herein, varying the parameter of the electrical energy supplied to the set of electromagnets includes varying the parameter over a period of time of each cycle or each half cycle of the back and forth motion. In this or other examples disclosed herein, the parameter is varied over the period of time of each cycle or each half cycle according to a rate of change function. In this or other examples disclosed herein, the rate of change function defines: a change of the parameter in a first value direction at an increasing rate of change from a change of direction of the back and forth motion over a first portion of each half cycle, and at a decreasing rate of change from an end of the first portion of each half cycle over a second portion of each half cycle, and a subsequent change of the parameter in a second value direction opposite the first value direction at a subsequently increasing rate of change from an end of the second portion of each half cycle over a third portion of each half cycle, and at a subsequently decreasing rate of change from an end of the third portion of each half cycle over a fourth portion of each half cycle that concludes at another change of direction of the back and forth motion. In this or other examples disclosed herein, the parameter includes a frequency of alternating electrical current supplied to the set of electromagnets over the period of time of each cycle or each half cycle of the back and forth motion; and wherein the set of electromagnets in combination with the set of magnetically-interactive elements forms an induction motor. In this or other examples disclosed herein, the parameter includes an amount of electrical current supplied to the set of electromagnets over the period of time. In this or other examples disclosed herein, the first frame portion includes a fin, wherein the set of one or more one or more electromagnets are mounted to or integrated with the fin of the first frame portion; and wherein the set of magnetically interactive elements of the second frame portion are arranged on either side of a channel into which the fin projects. In this or other examples disclosed herein, the system further comprises one or more position sensors configured to measure a position of one of the first frame portion or the second frame portion relative to the other of the first frame portion or the second frame portion; and wherein the electronic control system further interfaces electrically with the one or more position sensors; and wherein the electronic control system is further configured to: provide the motion control for the dynamic furniture system to induce the back and forth motion by varying the parameter of electrical current supplied to the set of electromagnets over time responsive to the position measured by the one or more sensors, and a direction of motion of the back and forth motion at the position. In this or other examples disclosed herein, the system further comprises one or more position sensors configured to measure a position of one of the first frame portion or the second frame portion relative to the other of the first frame portion or the second frame portion; wherein the electronic control system further interfaces electrically with the one or more position sensors; and wherein the electronic control system is further configured to: detect a change of a direction of motion of one of the first frame portion or the second frame portion, and wherein the parameter is varied according a predefined function that is timed relative to the change of the direction of motion and relative to a subsequent change of the direction of motion. In this or other examples disclosed herein, the curved profile of each of the one or more rockers has a fixed radius of curvature along at least a portion of the rocker along which the set of rollers interface with during the back and forth motion; and/or (i.e., either or both of) wherein the curved profile of the rocker forms an arc segment of a circle along at least a portion of the rocker along which the set of rollers interface with during the back and forth motion. In this or other examples disclosed herein, the back and forth motion is pendulum-defined motion having a pendulum-defined period of oscillation of a fixed length pendulum. In this or other examples disclosed herein, the fixed length pendulum corresponds to a radius of curvature of the curved profile of each of the one or more rockers. In this or other examples disclosed herein, the set of one or more magnetically-interactive elements include one or more permanent magnets; or wherein the set of one or more magnetically-interactive elements include one or more electromagnets, and the electronic control system is further configured to supply electrical energy to the one or more electromagnets to generate a magnetic field via the one or more electromagnets. In this or other examples disclosed herein, the set of one or more magnetically-interactive elements are formed from a ferromagnetic material. In this or other examples disclosed herein, the system further comprises: a ballast supported by the first frame portion or the second frame portion, the ballast being moveable relative to the first frame portion or the second frame portion upon which the ballast is supported in a direction that is parallel to a plane of the back and forth motion; an electro-mechanical actuator interfacing electrically with the electronic control system and operable by the electronic control system to move the ballast; and wherein the electronic control system is further configured to move the ballast to achieve a target orientation of the first frame portion or the second frame portion upon which the ballast is supported.

According to another example of the present disclosure, a method performed by an electronic control system with respect to a dynamic furniture system comprises: receiving, from one or more position sensors, an indication of a position of one of a first frame portion or a second frame portion of the dynamic furniture system relative to the other of the first frame portion or the second frame portion, wherein the dynamic furniture system includes a set of rollers mounted to the first frame portion, and the second frame portion includes one or more rockers each defining a roller-interface surface having a curved profile that interfaces with the set of rollers such that the second frame portion is moveable relative to the first frame portion by rotation of the set of rollers along each roller-interface surface of the one or more rockers; and providing motion control for the dynamic furniture system by varying a parameter of electrical energy supplied to a set of electromagnets over time responsive to the position to induce back and forth motion of one of the first frame portion or the second frame portion relative to the other of the first frame portion or the second frame portion, wherein the set of electromagnets are mounted to or integrated with the first frame portion or the second frame portion, and the other of first frame portion or the second frame portion include one or more magnetically-interactive elements. In this or other examples disclosed herein, varying the parameter of the electrical energy supplied to the set of electromagnets is over a period of time of each cycle or each half cycle of the back and forth motion; and wherein varying the parameter includes varying a frequency of alternating current or an amount of electrical power supplied to the set of electromagnets over the period of time of each cycle. In this or other examples disclosed herein, the parameter is varied over the period of time of each cycle or each half cycle according to a rate of change function. In this or other examples disclosed herein, the back and forth motion is pendulum-defined motion having a pendulum-defined period of oscillation of a fixed length pendulum; and wherein the fixed length pendulum corresponds to a radius of curvature of the curved profile of each of the one or more rockers.

According to another example of the present disclosure, a dynamic furniture system comprises: a first frame portion; a set of rollers mounted to the first frame portion; a second frame portion including a rocker defining a roller-interface surface having a curved profile; wherein the set of rollers interface with the roller-interface surface of the rocker such that the second frame portion is moveable relative to the first frame portion by rotation of the set of rollers along the roller-interface surface of the rocker; a mass transfer subsystem mounted to the first frame portion or the second frame portion, the mass transfer subsystem including: a ballast portion, a ballast pathway, and a set of one or more electro-mechanical actuators operable to move the ballast portion back and forth along the ballast pathway; and an electronic control system electrically interfacing with the set of one or more electro-mechanical actuators to adjust a positioning of the ballast portion along the ballast pathway based on a first control input to provide motion control and/or balance control of the first or the second frame portion to which the mass transfer subsystem is mounted.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A dynamic furniture system, comprising:

a first frame portion;

a set of rollers mounted to the first frame portion;

a second frame portion including a rocker defining a roller-interface surface having a curved profile;

wherein the set of rollers interface with the roller-interface surface of the rocker such that the second frame portion is moveable relative to the first frame portion by rotation of the set of rollers along the roller-interface surface of the rocker;

a mass transfer subsystem mounted to the first frame portion or the second frame portion, the mass transfer subsystem including:

a ballast portion, a ballast pathway, and a set of one or more electro-mechanical actuators operable to move the ballast portion back and forth along the ballast pathway; and an electronic control system electrically interfacing with the set of one or more electro-mechanical actuators to adjust a positioning of the ballast portion along the ballast pathway based on a first control input to provide motion control and/or balance control of the first or the second frame portion to which the mass transfer subsystem is mounted.

2. The system of claim 1, wherein the first frame portion is a lower frame portion, and the second frame portion is an upper frame portion.

3. The system of claim 2, wherein the second frame portion includes an upper surface that forms at least a seat of a chair.

4. The system of claim 2, wherein the rocker of the second frame portion is supported upon the set of rollers that are mounted to the first frame portion.

5. The system of claim 4, wherein the curved profile of the roller-interface surface of the rocker is convex.

6. The system of claim 4, the curved profile of the roller-interface surface of the rocker forms an arc segment that has a fixed radius of curvature.

7. The system of claim 3, wherein the chair takes the form of a recliner.

8. The system of claim 3, wherein the second frame portion is moveable relative to the first frame portion along an axis of the rocker that is orientated along a seating direction of the chair.

9. The system of claim 1, wherein the ballast pathway takes the form of a rack that engages with a pinion of at least one electro-mechanical actuator of the set.

10. The system of claim 1, wherein the rocker is a first rocker of the second frame portion;

wherein the second frame portion further includes a second rocker defining a roller-interface surface having a curved profile;

wherein the set of rollers is a first set of two or more rollers that interface with the roller-interface surface of the first rocker; and wherein the system further comprises a second set of two or more rollers mounted to the first frame portion that interface with a roller-interface surface of the second rocker.

11. The system of claim 10, wherein the curved profile of the first rocker and the curved profile of the second rocker each forms an arc segment that has a fixed radius of curvature.

* * * * *